364420
5/6/80 OR SR 4,202,036

United States Patent [19]

Bowditch et al.

[11] 4,202,036

[45] May 6, 1980

[54] BUOYANCY CONTROL FOR OCEAN CHARACTERISTIC MEASUREMENT SYSTEM

[75] Inventors: Philip N. Bowditch, Cohasset; John M. Dahlen, Duxbury; John F. McKenna, Jr., Gloucester; John T. Shillingford, Jr., Milton; Frank J. Siraco, Malden; William E. Toth, Bolton, all of Mass.

[73] Assignee: The Charles Stark Draper Laboratory, Inc., Cambridge, Mass.

[21] Appl. No.: 934,495

[22] Filed: Aug. 16, 1978

[51] Int. Cl.[2] ..... G01F 23/00; B63G 8/14

[52] U.S. Cl. ..... 364/420; 9/8 R; 73/170 R; 92/172; 114/326; 364/556

[58] Field of Search ..... 364/420, 556; 73/170 A, 73/300-303, 185, 189; 9/8 R; 114/16 E, 25, 326, 331; 102/14; 61/69 R; 60/495, 496; 92/172; 91/216 R, 216 A, 216 B, 225

[56] References Cited

U.S. PATENT DOCUMENTS

| | | | |
|---|---|---|---|
| 3,257,672 | 6/1966 | Meyer et al. | 102/14 |
| 3,590,635 | 7/1971 | Duing | 73/170 A |
| 3,753,311 | 8/1973 | Boone | 102/14 |
| 3,952,349 | 4/1976 | Erath et al. | 9/8 A |
| 3,972,231 | 8/1976 | Richardson | 73/170 A |
| 3,983,750 | 10/1976 | Kirkland | 73/170 A |
| 4,002,066 | 1/1977 | Ratigan | 73/170 A |
| 4,020,677 | 5/1977 | Doddington et al. | 73/170 A |
| 4,034,190 | 7/1977 | White | 364/420 |
| 4,044,611 | 8/1977 | Kaname et al. | 73/170 A |
| 4,109,531 | 8/1978 | Lawford et al. | 73/301 |

OTHER PUBLICATIONS

Van Leer et al.; "The Cyclesonde: an Unattended Vertical Profiler for Scalar and Vector Quantities in the Upper Ocean"; Deep Sea Research, Permalon Press, 1974, vol. 21, pp. 385-400.

*Primary Examiner*—Errol A. Krass
*Attorney, Agent, or Firm*—Kenway & Jenney

[57] ABSTRACT

A system for measuring ocean characteristics. The system includes a sensor assembly and an associated means to control the system buoyancy to achieve cyclic ascent and descent at controlled speeds, either along a mooring line or free-drifting. Buoyancy control is provided by a pump assembly including two rolling diaphragm-sealed, low friction displacement pistons driven by a high torque d.c. motor operated at low speed. There are four functional groups of data gathering instrumentation. The first group measures horizontal water transport, and includes sensors for current (flow velocity), system azimuth, system tilt, and vertical velocity. The second group provides a determination of salinity, and includes sensors for conductivity, temperature and pressure. The third group monitors conditions within the system, and includes sensors for internal temperature and humidity. The fourth group monitors conditions utilized in the buoyancy control, and includes sensors for pressure (depth and depth rate) and piston position. A programmed microprocessor configuration provides overall operational control for the system.

14 Claims, 22 Drawing Figures

BUOYANCY CONTROL FOR OCEAN CHARACTERISTIC MEASUREMENT SYSTEM

REFERENCE TO RELATED APPLICATIONS

This application is related to our U.S. patent application Ser. Nos. 934,334 and 934,014, filed on even date herewith.

BACKGROUND OF THE INVENTION

This invention relates to oceanographic instrumentation and more particularly, to a system for cyclically measuring ocean characteristics between two levels.

Data gathering of oceanographic parameters has increased in recent years. Primarily, the prior art has utilized moored current meters to gather data representative of currents, as well as moored meters for temperature and other ocean characteristics. Time series recording of these data has been generated from fixed instruments on taut-wire moorings in the deep ocean and on continental shelf and slope locations. However, it has been observed that with the conventional current and other characteristic monitoring systems, long-term measurement in the near-surface region of the open ocean has been particularly difficult, particularly when data gathering has been taken within 200 meters of the surface. The data has exhibited gross dynamic errors introduced by the surface wave field. This upper ocean region is particularly important in studies since the dynamics are based on energy transfer between the atmosphere and the deep ocean. In addition, a significant amount of the horizontal transport of heat momentum takes place in that region.

The energy in horizontal currents is contained mainly is low frequency motions, with geostropic, tidal, and inertial motions accounting for the great bulk of the energy. In view of this relative low frequency of the parameter changes, unattended vertical profilers with periodic sampling have been developed in the prior art for monitoring certain scaler and vector quantlties in the upper ocean. As an example of the prior art, U.S. Pat. No. 3,952,349 to Erath, et al. discloses a variable buoyancy device for automatically cycling an object, or platform having instrumentation, between upper and lower limits. This variable buoyancy device utilizes control of mean density to provide the cyclic vertical motion. The density control is accomplished by means of an inflatable bladder which is used together with a compressed gas supply and valve assembly to change the displacement of the system. In operation, the bladder is alternately inflated to control the buoyancy to be negative at a preselected low external pressure, and discharged into the ocean to control the buoyancy to be positive at a preselected high external pressure. Consequently, the instrumentation package coupled to the buoyant device cycles between the specified pressure points in the ocean. However, for long-term missions, this form of buoyancy control requires a relatively large bulk and mass apparatus particularly for gas storage.

It is an object of the present invention to provide an improved system for measuring ocean parameters.

It is another object of the present invention to provide an improved system for measuring ocean parameters, including a compact means for sustaining cyclic vertical motion throughout long-term immersion.

SUMMARY OF THE INVENTION

Briefly, the present invention provides a system for measuring ocean characteristics. The system includes a sensor assembly mounted on a platform, and an associated means to control the platform buoyancy. Buoyancy control is provided by a pump assembly including seawater displacement pistons and associated cylinder assemblies for trimming the near neutrally buoyant platform. As used herein, the term platform denotes a module or assembly which contains characteristic measuring sensors and other related instrumentation, including buoyancy control instrumentation. The platform may be closed or open. In some forms of the invention, the displacement pistons include a rolling diaphragm seal to establish a water-tight seal between the pistons and the associated cylinder. A system further includes an actuator for selectively translating the pistons between two points in the associated cylinder assemblies so that the buoyancy may be trimmed as a function of the piston position. A torque motor may be used in conjunction with ball screw and ball nut assemblies to actuate the pistons. In the preferred form of the invention, two pistons are utilized, however, in alternative configurations, differing numbers of pistons may be used.

In conjunction with this buoyancy control system, an adaptive controller may be utilized in accordance with the present invention, to provide a programmable control of the system buoyancy so that the platform may be cycled in an ascent and descent mode at controlled speeds, either along a mooring line or free-drifting. The adaptive control may be responsive to various ocean characteristics outside the platform, such as may be detected by sensors for such parameters as pressure, temperature, salinity, and acoustic properties. Alternatively, the ascent and descent control signals may be generated on a time basis. The control in some forms of the invention may be a programmed microprocessor. Furthermore, the adaptive controller in accordance with the invention may be utilized in conjunction with alternative ocean parameter profiling systems known in the prior art.

In accordance with another aspect of the present invention, ocean currents may be measured in deep water or alternatively in relatively shallow water, with substantially no effect from surface wave fields. In accordance with this aspect of the invention, a neutrally buoyant platform is provided with a current sensor in a manner whereby the platform is relatively free to move in the vertical direction in response to pressure waves from the surface wave field. In some forms of this invention, the platform may be constrained to motion along a mooring line, for example, by roller assemblies affixed to the upper and lower portions of the platform. In various forms of the invention, an inertial reference system may be utilized in conjunction with a computer to generate signals representative of the ocean current. In some forms of the invention, the computer includes means for resolving the current signals into orthogonal components.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

1. General Description

Figure 1:
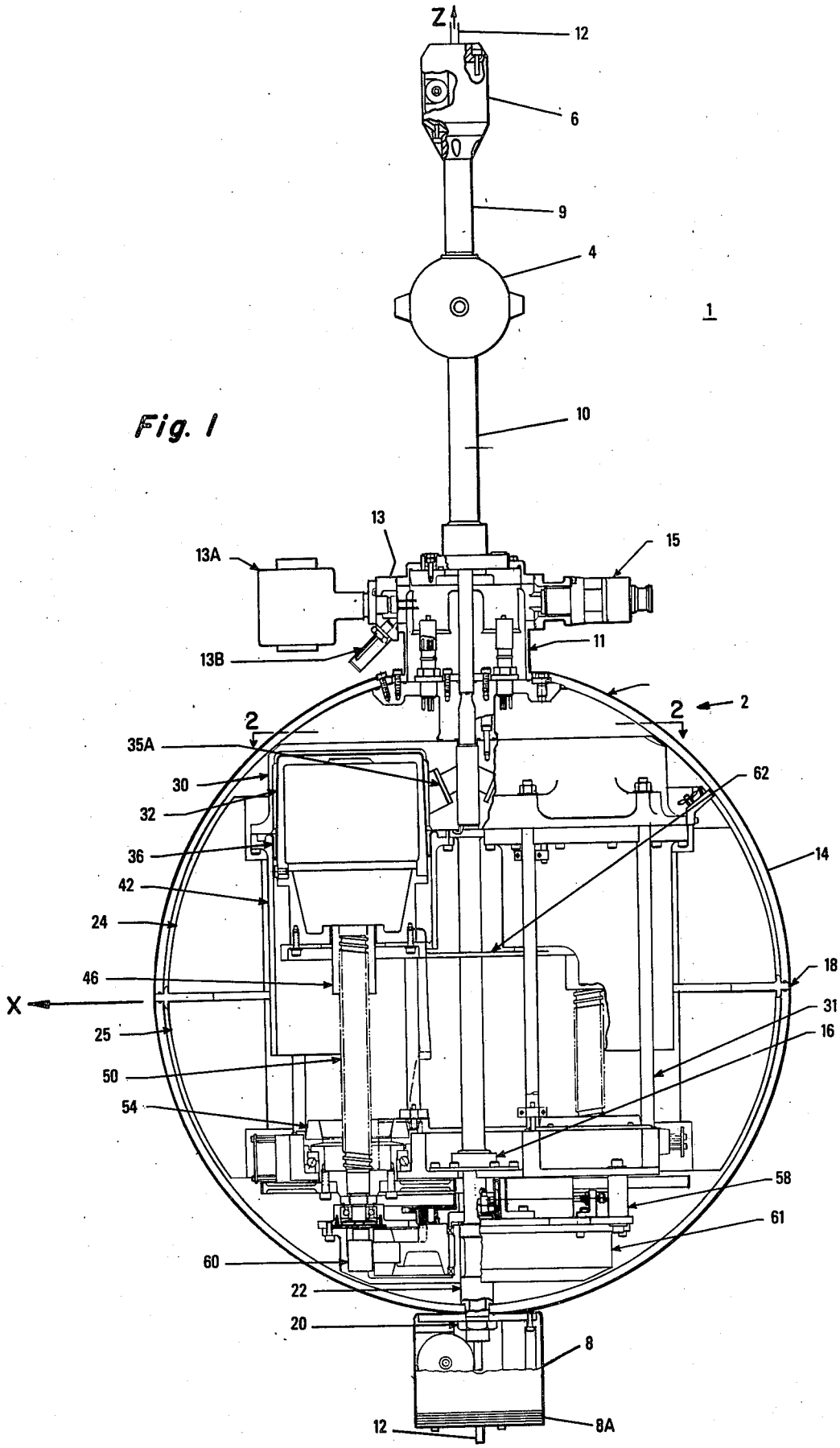
FIGS. 1 and 2 show, partially in cutaway form, an exemplary embodiment of the present invention.
Figure 2:
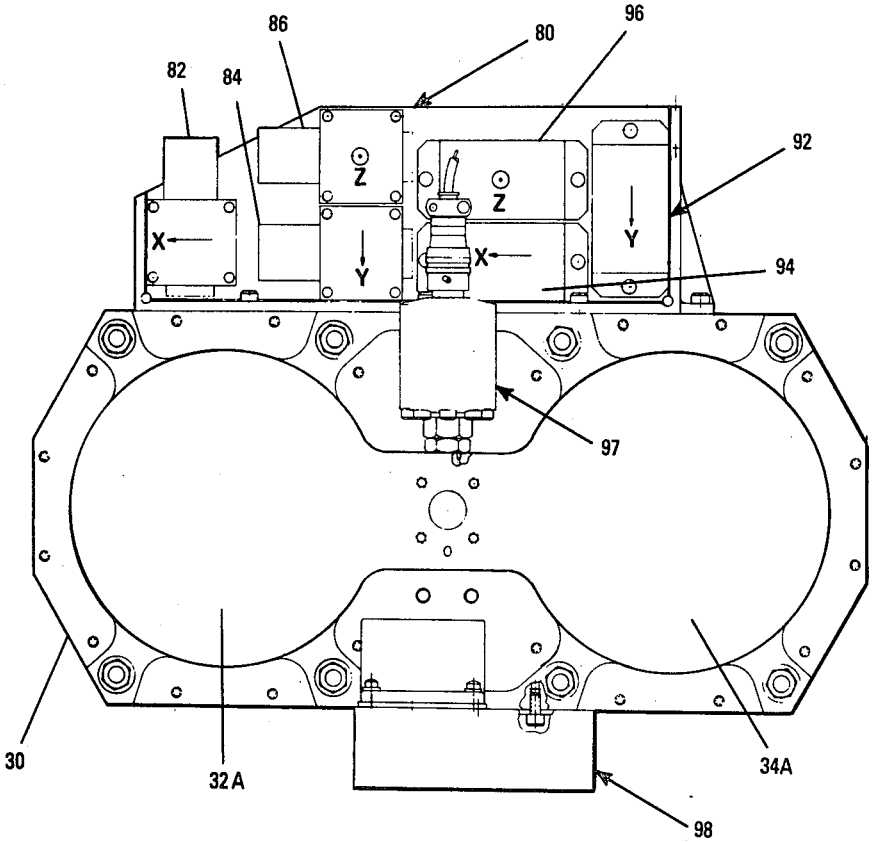

FIGS. 1 and 2 show the general assembly for the ocean characteristic monitoring system 1 of the present invention, shown in reference to a cartesian coordinate system, with the X and Z axes being shown in FIG. 1. The system 1 is shown in conjunction with a mooring line 12 passing along its central (Z) axis. In alternative embodiments, the system 1 may be free floating, i.e. adapted for operation without tracking a mooring line. In the present embodiment, structural members and fasteners which interface seawater are fabricated from titanium because of that material's characteristic high strength-to-weight ratio and good corrosion resistance to seawater. The housings of commercial external sensors are fabricated from type 316 stainless steel. Internal parts not exposed to seawater are made of aluminum or high strength steel.

Generally, the system 1 includes a spherical (56 cm diameter, 0.64 thick) instrumentation housing 2, and a spherical (10 cm diameter) electromagnetic current sensor assembly 4. In this embodiment, the current sensor 4 is rigidly coupled to the adjustable buoyancy housing 2. The sensor 4 is substantially free to move in the Z direction. Thus, axial motion of the mooring line 12 excited by a surface buoy, for example, is uncoupled from the sensor 4. In addition wave field pressure gradients which force oscillatory water particle motion, also force oscillatory motion of system 1 along the line 12 axis. As a result of the system axial freedom, however, the current sensor 4 sees only a small oscillatory flow component along the Z axis, and this oscillatory component is superimposed upon the larger steady component due to the ascent or descent speed of system 1. Consequently, the current flow measurements provided by sensor 4 are substantially independent of the surface wave field.

The spherical housing 2 and current sensor 4 include a conduit (1.0 cm diameter) along their polar (Z) axis which serves as a guide for the mooring line 12. Additionally, this conduit provides a path to the ocean for water ingested or expelled by the buoyancy control system (described more fully below). Roller assemblies 6 and 8 are positioned at the upper and lower ends, respectively of system 1, to provide tracking along a mooring line 0.7 cm diameter) with minimal frictional resistance.

The current sensor 4 is coupled to the upper roller assembly 6 by extension tube 9 and is coupled to a cylindrical header housing 11 by extension tube 10. The lower roller assembly 8 is directly coupled to the spherical housing 2.

The cylindrical header housing 11 couples the spherical housing 2 and the extension tube 10. Housing 11 isolates the housing 2 from possible water leaks into the current sensor 4 and provides a mount support for a sensor package 13, including an induction coil conductivity sensor 13A and a thermistor temperature sensor 13B, as well as a test plug 15 and an acoustic transducer (not shown) for underwater communication. In operation, the test plug and acoustic transducer are covered by a molded cap having the same shape as the sensor assembly 13 so that the system 1 is hydrostatically and hydrodynamically symmetrical about the polar (Z) axis. The internal components of housing 2 are also arranged for mass symmetry about this axis so that the overall system has minimal torques about that axis, thereby avoiding spurious azimuthal rotations which might otherwise be excited by the surface wave field.

The spherical housing assembly 2 is made up of spherical hemisphere sections 14 and 16 joined by an equatorial plate 18. The sections 14 and 16 are held in place by a preload nut 20 which compresses the portions 14 and 16 against an equatorial O-ring seal on plate 18. The nut 20 is tightened against a central post 22 which serves as the spine supporting internal components and also provides the conduit for the central mooring line 12. Battery packs 24 and 25 supply electrical power to system 1 and are connected to and supported by the equatorial plate 18.

In the present embodiment, the hemispheres 14 and 16 are spun titanium to produce a uniform grain structure with flow lines symmetrical to the Z axis. This grain structure reduces susceptibility to stress corrosion cracking. In other embodiments, alternative fabrication techniques may be utilized, such as explosive forming, forging, hydroforming, hot isostatic pressing and machining from a solid block.

A dual displacement piston assembly is positioned within the spherical housing 2. This system includes a pressure transducer 97 (shown in FIG. 2), a cylinder head 30, two displacement pistons 32 and 34, cylinder-to-conduit filters 35A and 35B, rolling diaphragm seals 36 and 38, cylinder skirts 42 and 44, ball nuts 46 and 48 and associated ball screws 50 and 52 and bumpers 54 and 56. Elements 34, 35B, 38, 44, 48, 52, 56 are not shown in FIG. 1.

The dual displacement piston assembly also includes a gear box 58, piston position encoder 99 (see FIG. 3) and a d.c. torque motor 60 within housing 61 (shown cut away in FIG. 1.) A torque equalization plate 62 couples the motion of the pistons 32 and 34.

FIG. 2 shows the cylinder head 30 of the present embodiment. Head 30 is fabricated from titanium and includes bores 32A and 34A for the pistons 32 and 34, respectively. A flow passage connects these bores to the axial conduit in central post 22 for providing flow paths for the drawing in or expelling of water in response to the motion of displacement pistons 32 and 34. The filters 35A and 35B prevent solid particles from contacting and damaging the rolling diaphragms 36 and 38. Rolling diaphragms 36 and 38 provide a seal between the cylinder provided by the pistons and bores and the interior of the remainder of the interior region of housing 2. Diaphragms 36 and 38 in the present embodiment are made from a fabric membrane impregnated with an elastomeric sealant. In the present embodiment, the rolling diaphragms are type no. 3-555-444 FCJ, manufactured by Bellofram, Burlington, Mass. These diaphragms permit a smooth, continuous near-frictionless piston motion. Also, the diaphragms isolate the aluminum pistons 32 and 34 from the corrosive effects of seawater.

The pressure transducer 97 is also mounted on the cylinder head 30, and measures pressure at the axial conduit. The cylinder head 30 also provides mounting for an attitude reference package 80 (described below) and tape recorder 98.

The pistons 32 and 34 are driven with ball-screw and ball-nut assemblies (elements 46, 48, 50 and 52). The two ball screws have opposite hand threads, and the ball nuts are coupled with a torque-equalization plate 62, so that the reaction torques which would have been transmitted to the housing 2 are cancelled. The ball screws are steel and are one inch in diameter with ¼ inch lead.

The ball screws are driven by the d.c. torque motor 60 through gear box 58 having a two-pass spur gear train. An idler gear is placed between two gears to provide the counter-rotations of the ball screws. The gear box 58 is composed of two aluminum plates coupled with four posts and spacer sleeves, the upper plate minimizes distortions since the piston axial reaction force is applied to the upper gear-box plate. The aluminum torque motor housing 61 is taper pinned and screwed to the lower gear-box plate. Eight steel tie rods (exemplified by rod 31 in FIG. 1) are used to couple the gear box 58 and motor assembly 60 to the cylinder head 30. The gear box 58 also houses a gear-driven piston-position encoder 99 (shown in FIG. 3.).

In the present embodiment, system 1 rides up and down the mooring line 12 (which may be, for example, a plastic-jacketed wire rope) guided by roller assemblies 6 and 8 located at the ends of the system 1. Assemblies 6 and 8 include three rollers whose axes are oriented 120 degrees apart and are staggered along the polar axis to allow passage over raised bumps or other imperfections which may exist or develop on the mooring line 12. External ballast weights 8A are shown to be attached at the outboard end of the lower-roller assembly 8.

The high torque d.c. motor 60 is operated near its maximum efficiency, low load speed range. With this motor form, together with the large rolling diaphragm-sealed, low-friction piston assembly, a highly energy efficient operation is achieved. This combination avoids the large electrical loss and space mass requirements of a d.c.-a.c. conversion, and permits a low gear reduction ratio resulting in low gear losses and a simple gear train.

The system 1 is nominally neutrally buoyant, that is, for the total mass, the displacement is fixed (94 kilograms and 0.091 cubic meters for the present embodiment). The spherical housing 2 provides this displacement for minimum structural mass. The total water displacement capacity for the system 1 is 4080 cubic centimeters which provide for a 1 meter/second current and a drag coefficient of 0.6 with the following budget:

(1) 1170 cubic centimeters to provide for seawater density and volume changes, (2) 750 cubic centimeters to overcome friction, (3) 1500 cubic centimeters to overcome axially component of drag due to axial motion, and (4) 660 cubic centimeters to overcome the axial component of drag due to mooring line inclination.

The dual piston arrangement permits symmetrical balance packaging of the remaining components, and provides simple torque balance using one left-hand and one right-hand thread screw jack. Furthermore, the center of mass is maintained on the polar axis as water moves in and out of the cylinders.

The system 1 further includes an attitude reference package (ARP) 80 for providing signals to a control portion for resolving the body axes current components from the current sensor 4 into north and east components ARP 80. The attitude reference package 80 is positioned within the spherical housing 2 and coupled to the exterior of the cylinder head 30, as shown in FIG. 2. Two single axis magnetometers 82 and 84 provide the primary azimuth signals. These magnetometers are mounted with their input axes being orthogonal to the polar axis. A third magnetometer 86 is mounted with its sensitive axis parallel to the polar axis to provide a signal which is used in conjunction with the others to compensate for changes in the Earth's magnetic intensity vector encountered in moving the system 1 between various mooring sites.

Two single axis accelerometers 92 and 94 are mounted in ARP 80 with their input axes orthogonal to the polar axis. Accelerometers 92 and 94 provide tilt signals used to correct the primary magnetometer signals for that portion of the Earth's vertical magnetic intensity due to the tilt of the system 1. Magnetometers 92 and 94 are also used for resolving the current components into the horizontal plane when the tilt exceeds a predetermined value, such as 10 degrees. A third accelerometer 96 is mounted with its sensitive axis parallel to the polar axis.

An electronic and computer system 100 (ECS) is mounted in two sections on either side of the piston assembly within the housing 2. ECS 100 includes conditioning electronics for the sensors, power supplies, analog-to-digital conversion networks, microprocessor controller with associated memory and logic, incremental cassette tape recorder, motor controls, and test and operator equipment interface. The microprocessor controller provides programmable control of these overall systems providing current component resolution and smoothing, ascent and descent velocity control, profiling cycle control, parameter sampling rate and averaging internal control, and data formatting.

Generally, operation of the system 1 includes the following functions: sampling, processing and recording of data, and buoyancy control. These control functions are established under program control by the microprocessor controller. The method of operation will now generally be described (with more detailed description following below) by considering the various phases of a profiling cycle, starting at the bottom stop on the mooring line.

Assuming that the system 1 has been at rest at the bottom stop on the mooring line at a predetermined depth awaiting the next measurement cycle, ascent mode is initiated at an ascent start of launch, time which occurs at predetermined intervals. Since the required net buoyancy to achieve a given ascent speed is a function of the current, the system 1 first measures the average current, temperature and conductivity over a predetermined time interval (e.g. 1 minute). In this measurement, at intervals (e.g. 2 seconds), the current sensor, magnetometer, accelerometer, thermistor and conductivity transducer signals are periodically sampled, converted and processed to obtain average temperature conductivity and north and east current components.

The motor 60 is then energized to drive the pistons. Since the system 1 cannot predict liftoff in advance due to variations in seawater density, volume, friction and drag coefficients, and the like, the pressure is monitored by transducer 97 to detect liftoff. Following liftoff, the system buoyancy has a component along the mooring line just sufficient to balance the axial components of weight, friction and drag due to line inclination. The axial component of buoyancy (added by continuing to drive the pistons after liftoff) is balanced by the axial components of inertia forces and drag due to axial motion. A steady state ascent speed is a function of current and volume displacement of the pistons after detection of liftoff. This volume displacement is monitored by the piston position encoder 99. In the present embodiment, the ascent speed is related to current and volume displacement in accordance with the following rules: if the current is less than a predetermined value (e.g. 10 centimeters/second), the motor 60 is shut down as soon as liftoff is detected (by the pressure decrease by a predetected amount (e.g. 10 mbar)). The ascent speed stabilizes shortly thereafter to a nominal value (e.g. between 11 and 15 cm/s). If the magnitude of the current $\sqrt{U^2+V^2}$, where U and V are the orthogonal components of the current in the X-Y plane, is in a predetermined range (e.g. 10–50 cm/s), the motor 60 is shutdown when the piston displacement has increased by a predetermined amount, (e.g. $[6.2\sqrt{U^2+V^2}-26]$ cm$^3$ after liftoff detection. The ascent speed thereafter stabilizes to a normal value (e.g. between 12 and 14 cm/s). For currents greater than a predetermined value (e.g. 50 cm/s), the displacement required after liftoff is some different value, for example, $[8.1\sqrt{U^2+V^2}-110]$ cm$^3$, causing the speed to stabilize in a predetermined range (e.g. 12–14 cm/s). After shutdown, the detected bottom oceanographic characteristics and the piston position are recorded on the tape recorder 98. The program control maintains the ascent speed within a prescribed deadband, and records parameter averages within prescribed depth zones. Upon entering any zone, the program controller refers to its memory for the pressure depth to the top of the zone, the ascent speed deadband limits, and the parameter sampling requirements. By way of example, the top of the first zone after liftoff may be 160 dbar, the deadband limits 10 and 16 cm/s, and the sampling period two seconds. Upon entering this zone, the parameter averaging commences and the ascent speed monitoring is performed, with the speed monitoring being achieved by monitoring pressure periodically (e.g. every thirty seconds). Whenever the indicated ascent speed is outside the established deadband, a speed change to achieve a nominal ascent speed is calculated. From that value, a volume change required to accomplish this speed change is calculated. By way of example, the following rule may relate the volume and speed changes: the volume change equals 0.63 $\sqrt{U^2+V^2}$ times the speed change for currents greater than a predetermined value, (e.g. as 20 cm/s), or the volume change equals 12 times the speed change for current values less than or equal to 20 cm/s, where the current value used is the most recent average current.

The motor 60 is then energized long enough to drive the pistons 34 and 36 until the desired volume change has been measured by the piston position encoder 99. While the motor 60 is energized, the characteristic averaging task is suspended, avoiding magnetic interference from the motor. Ascent speed monitoring continues, but is disregarded until a predetermined period (e.g. 15 seconds) after motor shutdown to allow time for the ascent speed to stabilize. The above procedure is continued until the pressure reaches the pressure limit (e.g. 160 dbar) when the parameter averages and piston position are recorded.

Measurements in each succeeding zone are performed in the same manner. As the surface is approached, the zones might be made progressively thinner to account for the progressively shorter vertical scales anticipated. Accordingly, the nominal ascent speed may be proportionately decreased to ensure remaining in each zone long enough to average over many of the longest surface-wave periods. Gradual reduction of ascent speed tends to occur naturally without control action if the currents increase as the system 1 approaches the surface. Also, the sampling period may be progressively shortened (e.g. initially to one second, and finally to 0.5 second) near the surface to capture the progressively shorter period oscillations encountered in the surface wave field. Since the ECS 100 consumes more power at higher sampling rates, it is generally advantageous to utilize the slowest satisfactory rate.

In the preferred embodiment, the tape recorder is adapted to record as many as 87,600 sets of zone parameters, or 10 zones/cycle at 1 cycle/hour for 1 year. By way of example, an average ascent speed of 10 centimeters/second results in completion of the measurement phase of a cycle from a 200-meter depth to the surface 1n just over 30 minutes. This example permits a profiling frequency of 1 cycle/hour. With ten zones, the average time per zone is 200 seconds, long enough to average over many wave periods. Furthermore, the exemplary 10 centimeter/second ascent speed biases the relative flow to approach the current probe from the top hemisphere of its field of view. This bias enhances the current sensor 4 response by moving its turbulent wake downstream from its electrodes, and by positively keeping the sensor 4 out of the wake of the spherical housing 2. This biasing of the relative flow is maintained regardless of surface wave excitation.

The above described profiling-while-ascending operation provides space-time averages, while maintaining a high degree of energy conservation. Alternatively, the system 1 can be stopped to measure at fixed levels. In the latter forms, energy may be extracted from the sea pressure while retracting the pistons. Since the motor behaves like a generator when driven by the pistons, batteries in the battery pack may be recharged while the pistons are pushed down by the sea pressure.

The descent mode is commenced upon completion of the ascent mode. A dive is performed in a manner similar to that described for liftoff, resulting in the achievement of a descent speed calculated to arrive at the bottom well in advance of the next ascent start time. The descent mode is similar to the ascent mode, except that oceanographic characteristic sensing is suspended during descent. Upon arrival at the bottom, a rest mode keeps watch, preventing inadvertent ascent due to changing conditions, while awaiting the next ascent start time.

Table 1 provides the operating range, digital resolution (least significant bit), and the smallest errors expected to be achieveable for each of the parameters processed by the preferred embodiment (described in detail in the following sections).

2. BUOYANCY CONTROL SYSTEM

TABLE 1

| Parameter | Units | Range | LSB | Absolute Error (Short Term) | In-Situ Drift/Year |
|---|---|---|---|---|---|
| Current | cm $s^{-1}$ | −400 to 400 | 0.20 | >1.3, <3% of reading | 2 |
| Temperature | °C. | −5 to 35 | 0.0040 @ −5<br>0.033 @ 35 | 0.01 | 0.005 |
| Conductivity | mmho $cm^{-1}$ | 28 to 60 | 0.0078 | 0.01 | — |
| Pressure | d bar | 8 to 213 | 0.050 | 0.2 | 0.2 |
| Specific Force | gravity acceleration | −1 to 1 (x,y axes)<br>0 to 2 (z axis) | 0.00049 | 0.005 | 0.0005 |
| Magnetic Intensity | Earth's field at CSDL | −1.2 to 1.2 | 0.00059 | 0.01 | 0.0006 |
| Piston Displ. Vol. | $cm^3$ | 0 to 4360 | 1.06 | 1 | 0 |
| Recorded Time | s | 0 to $6.87 \times 10^8$ | 0.01 | — | 30 |

Figure 3:
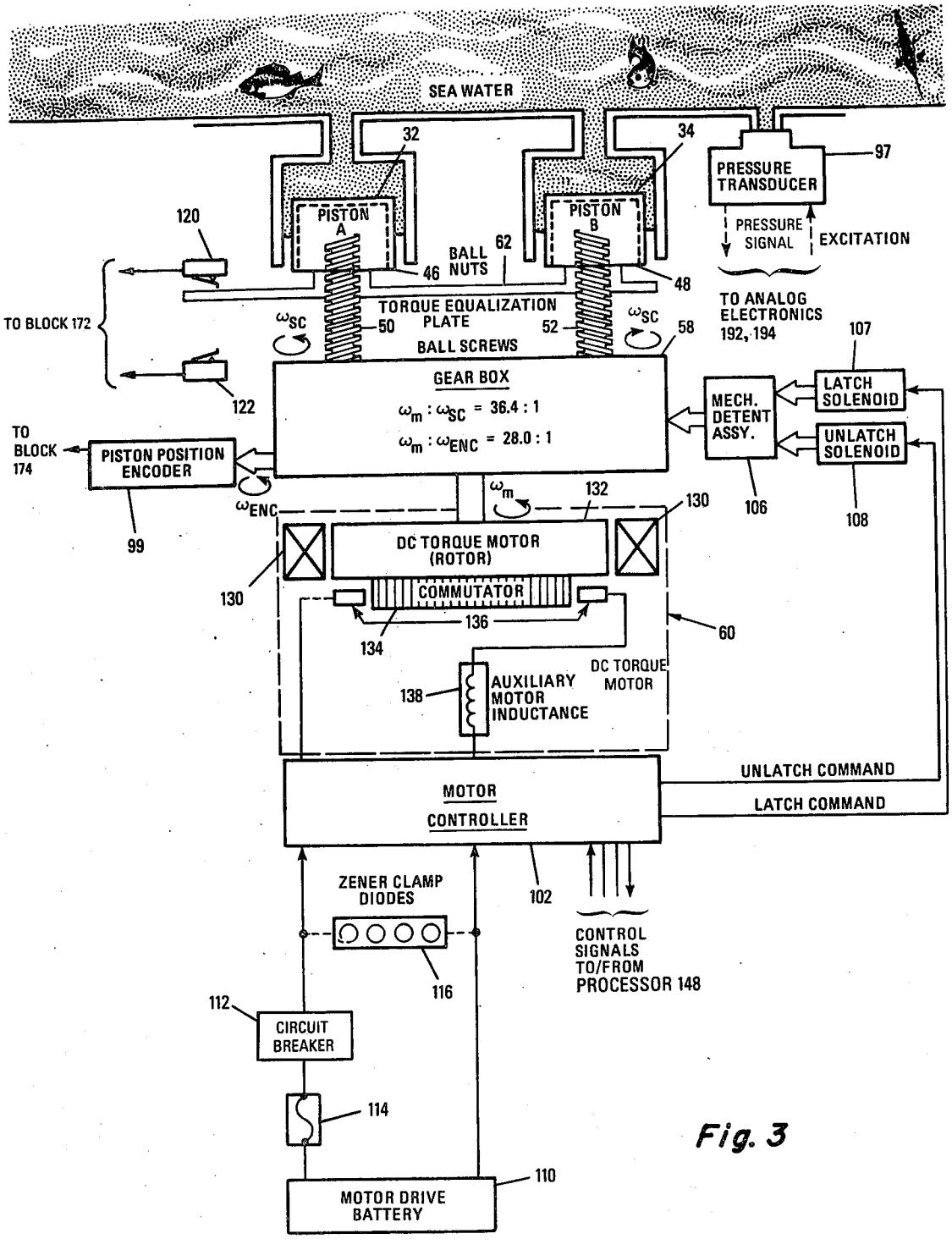
FIG. 3 shows, partially in block diagram form and partially in schematic form, the buoyancy control system for the embodiment of FIG. 1.

The buoyancy control system (BCS) is shown in schematic form in FIG. 3. The BCS provides open loop bi-directional current limited drive, and current limited dynamic braking for the dual displacement piston assembly. Primary control of the BCS is provided by a program controlled digital processor 148 (described in conjunction with ECS 100).

Generally, the buoyancy control system includes the pistons 32 and 34 as coupled by the ball nuts and ball screws (elements 46, 48, 50 and 52) and torque equalization plate 62 to the gear box 58 with the interior gear assembly. The gear assembly in box 58 is driven by the d.c. torque motor 60. Motor 60 is controlled by a microprocessor 150 (described below in conjunction with ECS 100) by way of motor controller 102. The motor controller 102 provides the directional drive signals for the motor 60 and, in addition, provides control signals to a mechanical control for the gear box 58 which includes a mechanical detent assembly 106 and associated latch solenoid 107 and unlatch solenoid 108. The directional drive and latch control signals from motor controller 102 are generated in response to control signals from the microprocessor 150 described below. The power supply for the BCS is provided by a motor drive battery 110 and associated control circuitry including circuit breaker 112, fuse 114, zener diode clamp network 116.

The torque equalization plate 62 travels between upper and lower limit switches 120 and 122, respectively, and provide relay trip control signals for a circuit breaker 112 when the plate 62 reaches predetermined extremes of motion within the housing 2. Switches 120 and 122 also provide electrical signals indicating these position limits to the processor 148. The gear box 58 also includes a mechanical coupling to the piston position encoder 99 which in turn is coupled to an interface in the processor 148. The pressure transducer 97 is electrically coupled to the analog electronics (described below in conjunction with ECS 100) so that an excitation signal triggers a response pressure signal representative of the pressure at sampling times.

In the present embodiment, the d.c. motor 60 includes a permanent magnet stator 130, loader 132, commutator 134 and brushes 136, together with an auxiliary motor inductance 138. In response to motor 60, the ball screws 50 and 52 rotate in opposite directions at an angular velocity having magnitude $w_{SC}$, the piston position encoder 99 input shaft rotates at angular velocity $w_{ENC}$ and the output angular velocity for motor 60 is $w_m$. In the present embodiment, the following relationships are utilized:

$$w_m:w_{SC}=36.4:1$$
$$w_m:w_{ENC}=28.0:1$$

In the present embodiment, the motor 60 is a permanent magnet d.c. torque motor, model 7202 with winding designation T-7202-N, manufactured by the Inland Motor Division of Kollmargen Corporation. This configuration gives a peak torque at 11 ft./lb. at 38.4 nominal armature voltage at 8.7 amps. In alternative configurations, other motors, of course, may be utilited. The present embodiment utilizes an armature voltage of 41.8 volts for a nominal sea pressure of 300 lb./in. The system provides a mechanical gear-train efficiency of 77.6%, with a motor-to-ball nut torque gain equal to 36.435:1, with the motor characteristic speed being 21.04 rad/sec with a current of 1.7 amps and motor efficiency of 75.8%. The overall drive system efficiency is 58.8%.

In operation, as described more fully below, the processor 148 dedicates four output lines for transferring control signals to motor controller 102: bit 8 (detent release, or unlatch), 9 (detent apply, or latch), 10 (drive motor on) and 11 (drive motor up or brake). In response to these output control signals, the motor controller 102 enters one of four states: (1) all elements "off", (2) dynamic brake applied, (3) drive motor up, (4) drive drive down. The motor controller 102 is a decoding network for four output bits (bits 8–11) of processor 148 to provide outputs on the control lines going to the motor 60 and to control lines going to solenoids 107 and 108. These states are decoded to control the motor 60 to be off, brake drive up or drive down. In addition the solenoids 107 and 108 are controlled to be in one of the following states: (1) both off, (2) solenoid 107 on, and 108 off (latching the pistons), (3) solenoid 107 on and 108 off (unlatching the pistons).

The mechanical detent assembly 106 is a pawl-detent mechanism used as a mechanical detent to hold the piston position once a desired position is reached. This mechanism is a mechanical latching device in both the detent and non-detent positions. Assembly 106 is cogging (i.e. detent unlatch unnecessary) for piston drive outward (uP) but self-jamming (detent unlatch required for disengagement) for piston drive inward (down).

3. Sensors

The sensors in the system 1 provide four groups of functions. The first group determines the characteristics of horizontal water transport. In this group, the following characteristics are measured:

current (flow density)
system azimuth
system tilt
vertical velocity

In operation, data derived from this functional group of operations is processed simultaneously.

The second functional group of measurements provides indication of the ocean salinity. In this group, the following characteristics are measured:

electrical conductivity
external temperature
pressure

The third functional group of measurements provide an indication of condftions inside the system of housing 2 of the system 1. In this group, the following characteristics are measured:

internal temperature
humidity

The fourth group provides data necessary for buoyancy control. In this group, the following characteristics are measured:

pressure (depth and depth rate)
shaft encoder (piston position)

In the present embodiment, the sensors for the first group of measurements are current sensor 4 and the attitude reference package (ARP) 80 (including the magnetometers and accelerometers). The current sensor 4 is a Marsh McBirney model 555 spherical electromagnetic current meter. This sensor is a two axis device adapted in system 1 to measure flow in a plane normal to the mooring line 12 passing through the center of the probe. The sensor 4 in the present embodiment is specially adapted to provide a through-tube, allowing the mooring line 12 to pass through the center.

In ARP 80, the accelerometers 92, 94 and 96 are force-balanced servo accelerometers consisting of a pendulum constantly restored to a normal position by a high-gain servo loop. The input axis is normal to the arm of the pendulum, and the internal servo loop restores the seismic mass of the pendulum to a null position with a torque motor proportional to current. In the present embodiment, the accelerometers are Columbia model SA701 forced balanced units for the horizontal axes, and model SA107 for the vertical axis. The magnetometers are Infinetics model MK-2b single axis magnetometers.

The sensors for the second group of measurements are conductivity sensor 13A, temperature sensor 13B and pressure transducer 97. The conductivity sensor 13A is a Plessey inductively coupled conductivity probe, type 2600-3 sensor head (with circuit board 5590). The thermal sensor 13B is a Fenwall thermistor probe, outline H65, fit to iso curve +0.5%, 0° to +35° C. The pressure transducer 97 is a BLH Type DHF bonded strain gauge pressure transducer.

The sensors for the third group of measurements are an internal thermal sensor (not shown) and a humidity sensor (not shown), both being positioned within housing 2. The internal thermal sensor is a Fenwall Model 100K iso curve oceanographic thermistor in a H-76 housing. The humidity sensor is a Phys-Chemical Research Corporation Model PCRC-11 humidity sensor.

The sensors for the fourth group of measurements are the pressure transducer 97 and piston position encoder 99. Encoder 99 is a Litton Industries absolute position encoder, model GCC-11-13P7.

4. Electronics and Computer System

Figure 4:
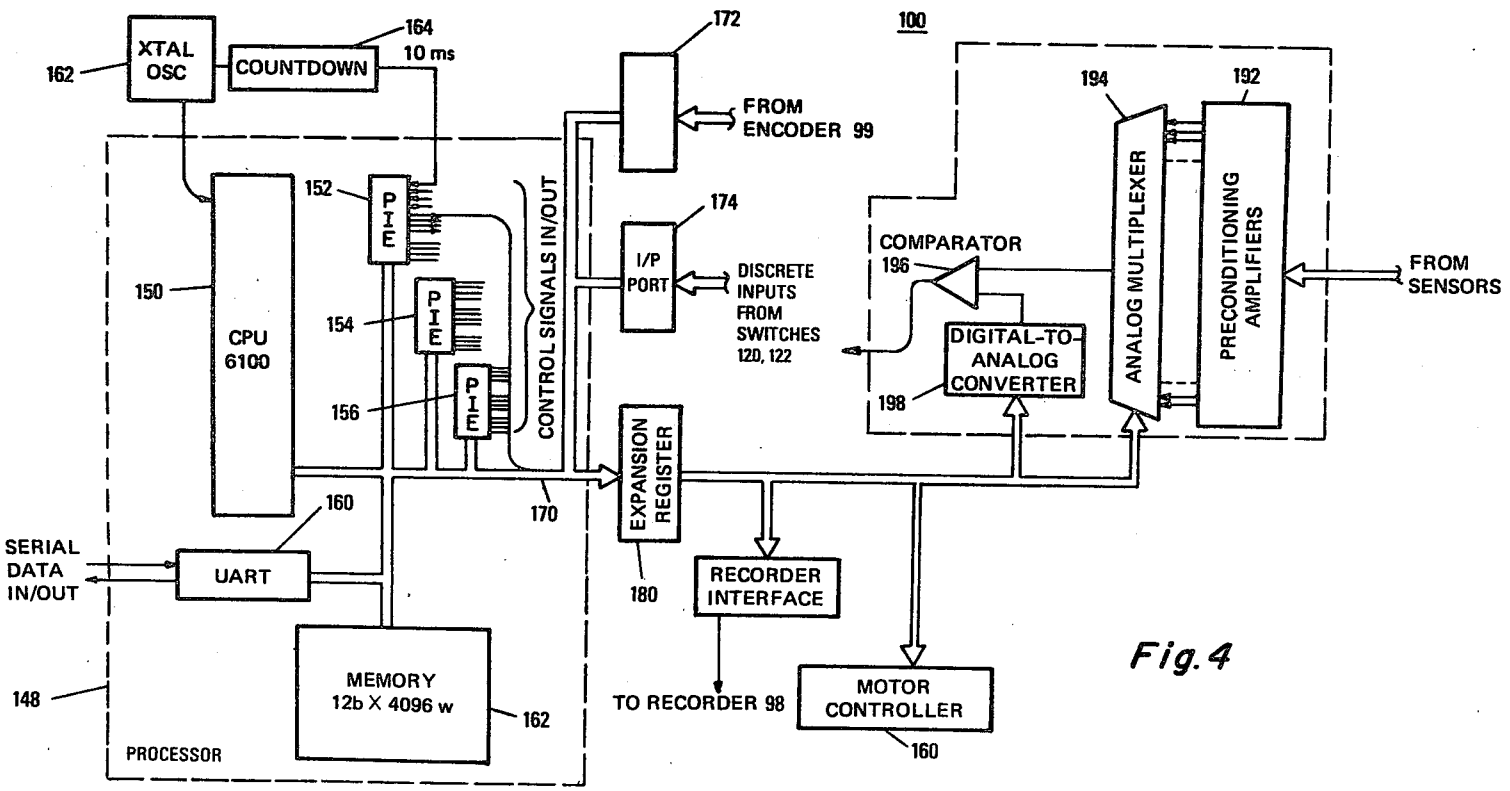
FIG. 4 shows in block diagram form, the electronics and control system (ECS) for the embodiment of FIG. 1.

The Electronics and Computer System (ECS) 100 is shown in block diagram form in FIG. 4. ECS/100 provides the following functions:

(1) Conditioning, selection, and conversion of analog sensor signals,
(2) Data formatting for recording,
(3) Timing and sequencing for all operations,
(4) Voltage regulation and switching of sensor power,
(5) Motor control,
(6) Computational capability for filtering,
(7) Component resolution and buoyancy control, and
(8) Interfaces for communication with external equipment.

In the present embodiment, the digital processor 148 of ECS 100 includes five CMOS large-scale-integrated circuits: 12-bit microprocessor (CPU) 150 (Intersil IM 6100), parallel interface elements 152, 154 and 156 (Intersil IM 6101), a universal asynchronous receiver/-transmitter (UART) 160 (Intersil IM 6402) and an associated 12-bit, 4096 word memory 161.

A crystal oscillator 162 operating at 819.2 kilohertz drives a single 14-stage binary counter 164, producing timing signals and an interrupt to the interface element 152 at 10-millisecond intervals for timekeeping purposes. The same oscillator 162 provides clock pulses to the CPU 150. The parallel interface elements (PIE's) 152, 154 and 156 provide control signals to gate data between the processor 148 and the other elements of the system 1, including motor control 160. Data transfer takes place on the three-state 12-bit 'DX' bus 170. The PIE's 152, 154 and 156 also provide sense inputs which may be tested by program, or may be used to implement a full-vectored interrupt mechanism.

In the present embodiment, the UART 160 provides serial communication with external devices, such as a teletypewriter, and an acoustic data link. The bit rate is established by an externally applied clock, allowing interfacing to devices of various speeds without requiring internal changes.

Two 12-bit parallel input ports 172 and 174 are provided: one port 172 is dedicated to the piston position encoder 99, and port 174 is coupled to discrete logic signals from the limit switches 120 and 122.

Output from the processor 148 to the remainder of the ECS 100 is via a single register, denoted the expansion register 180. With this configuration, the loading on the DX lines in bus 170 is minimized and the number of transitions at the inputs to the various output registers is reduced while the DX lines in bus 170 change state many times during each instruction (for example, the bus 170 may carry the instruction address, the instruction, a memory address, and then data). The output of the expansion register 180 changes only when an output operation takes place.

The recorder 98 of system 1 includes a Sea-Data model 610 serial digital stepping recorder and a recorder interface 184. This device records 800 4-bit characters per inch on standard 0.15-inch cassettes, giving a total capacity of 9.2×10 bits for 100-bit records with appropriate synchronizing gaps.

Figure 5:
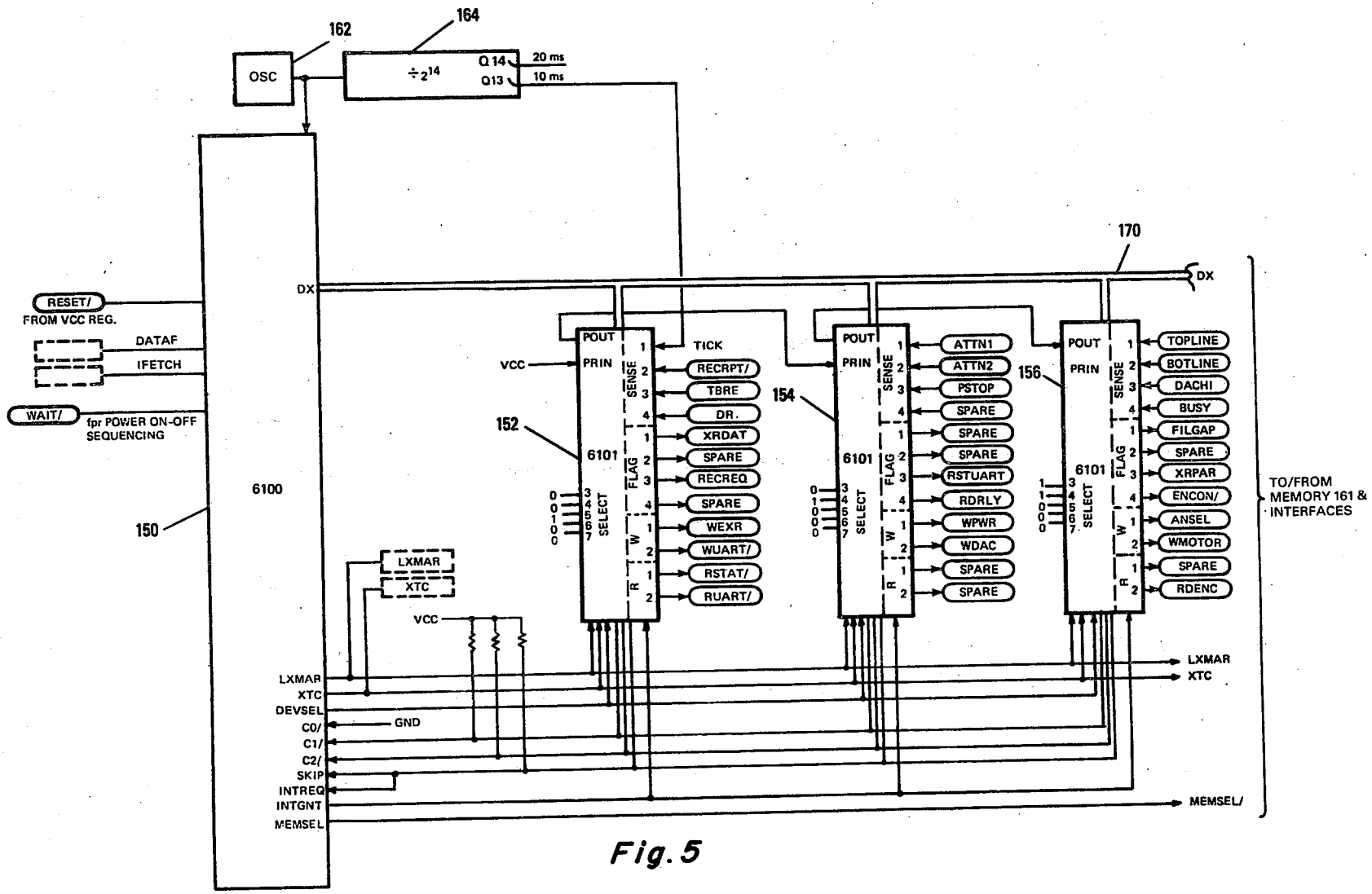
FIG. 5 shows in detailed block diagram form, the digital processor of the ECS of FIG. 4.

Details of the processor-PIE interconnections are shown in FIG. 5. Each PIE produces two read control signals, two write control signals, and four flags under program control. Each PIE also provides four sense inputs, which may be tested by skip instructions or may be used to drive the processor interrupt line. The functions of the PIE signals are listed in Table 2.

The CPU 150 executes the instruction set of the Digital Equipment Corporation PDP-8/E minicomputer. The normal instructions are described in Intersil IM6100 CMOS 12-bit Microprocessor, Intersil, Inc., August 1975.

Table 2

| PIE Address (Octal) | PIE Signal | Signal Name | Use |
|---|---|---|---|
| 04 | S1 | TICK | 10-ms signal from timer. |
| 04 | S2 | RECRPT/ | 12-bits-taken signal from recorder. |
| 04 | S3 | TBRE | UART transmitter ready for character. |
| 04 | S4 | DR | UART receiver has new character. |
| 04 | F1 | XRDAT | Strobe recorder data register. |
| 04 | F2 | Spare | |
| 04 | F3 | RECREQ | Recorder initiate pulse. |
| 04 | F4 | Spare | |
| 04 | W1 | WEXR | Strobe expansion register. |
| 04 | W2 | WUART/ | Strobe UART transmitter buffer register. |
| 04 | R1 | RSTAT/ | Gate discrete inputs to DX. |
| 04 | R2 | RUART/ | Gate UART receiver to DX. |
| 10 | S1 | ATTN1 | Signal representing state of ATTN1 relay input. |
| 10 | S2 | ATTN2 | General-purpose input discrete. |
| 10 | S3 | PSTOP | Piston at limit. |
| 10 | S4 | Spare | |
| 10 | F1 | Spare | |
| 10 | F2 | Spare | |
| 10 | F3 | RSTUART | Drives UART reset input. |
| 10 | F4 | RDRLY | Not used. |
| 10 | W1 | WPWR | Strobe power-control register. |
| 10 | W2 | WDAC | Strobe digital-to-analog converter latch. |
| 10 | R1 | Spare | |
| 10 | R2 | Spare | |
| 14 | S1 | TOPLINE | Optional input for top-of-line sensor. |
| 14 | S2 | BOTLINE | Optional input for bottom-of-line sensor. |
| 14 | S3 | DACHI | Output of analog comparator. |
| 14 | S4 | BUSY | Tape recorder busy signal. |
| 14 | F1 | FILGAP | Tape recorder file gap command (not used). |
| 14 | F2 | Spare | |
| 14 | F3 | XRPAR | Shift recorder parameter register. |
| 14 | F4 | ENCON/ | Bias to encoder common. |
| 14 | W1 | ANSEL | Strobe analog multiplexer input latch. |
| 14 | W2 | WMOTOR | Motor controller input strobe. |
| 14 | R1 | Spare | |
| 14 | R2 | RDENC | Gate encoder to DX. |

Note:
S: sense, F: flag, R: read, W: write.

Figure 6:
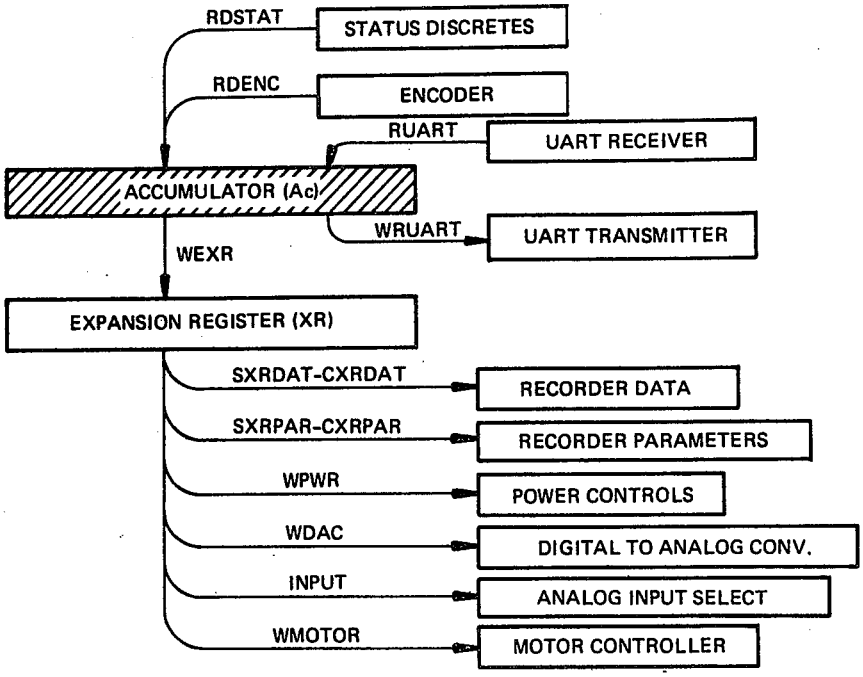
FIG. 6 illustrates the data flow in the ECS of FIG. 4.
Figure 7A:
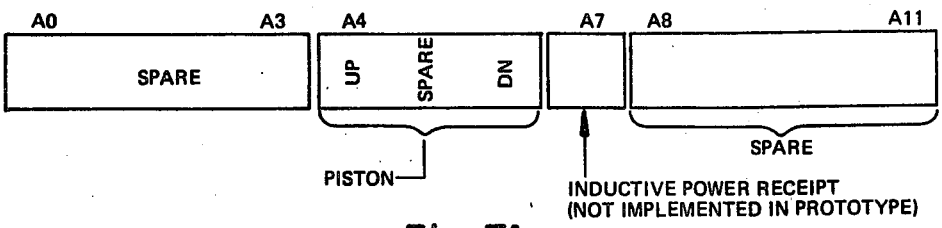
FIGS. 7A-7I show the data format for input/output instructions used in the ECS of FIG. 4.
Figure 7B:
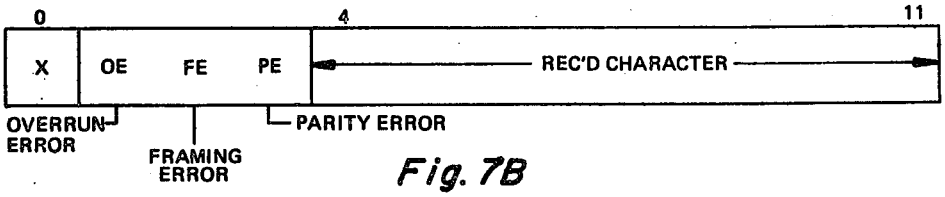
Figure 7C:
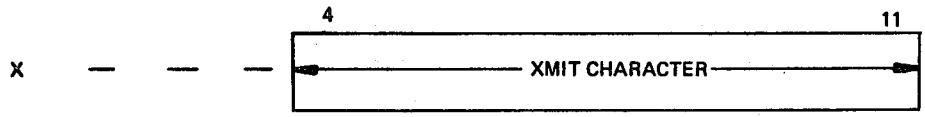
Figure 7D:
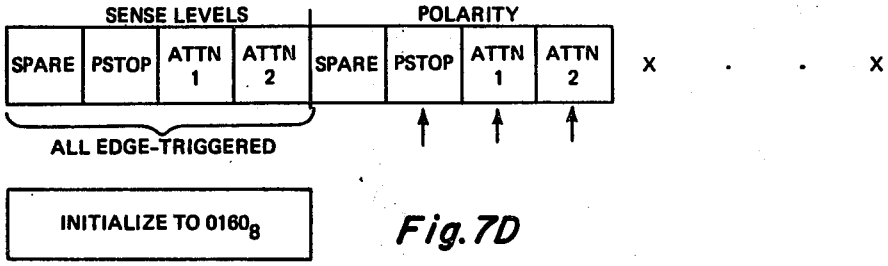
Figure 7E:
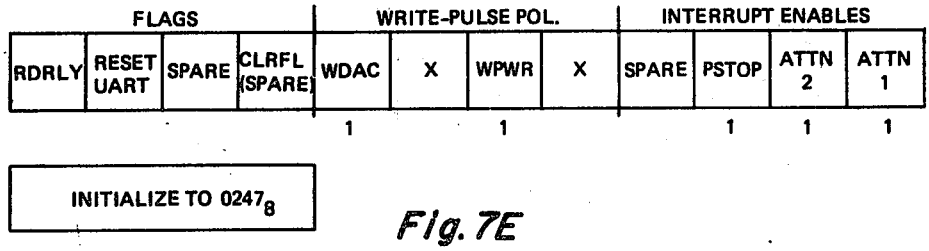
Figure 7F:
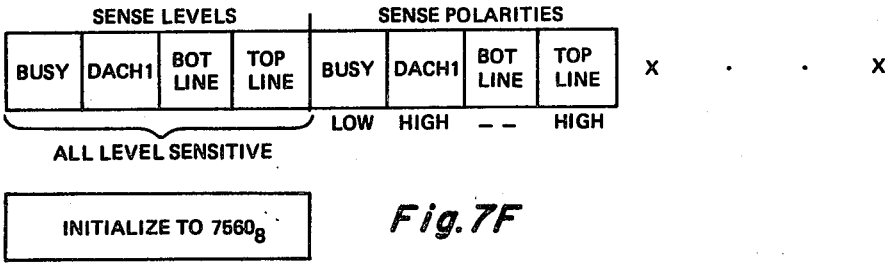
Figure 7G:
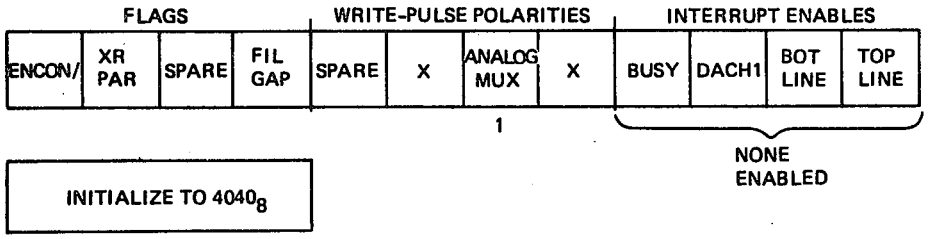
Figure 7H:
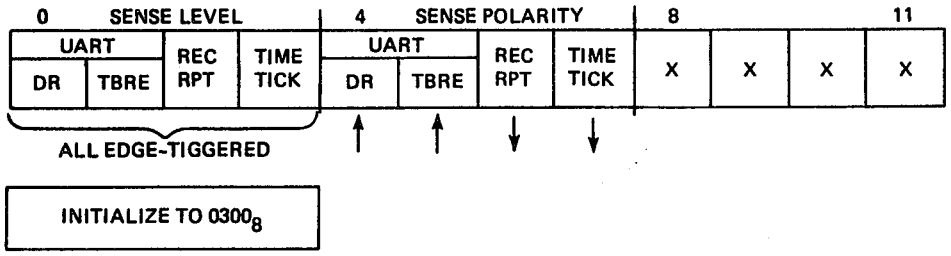
Figure 7I:
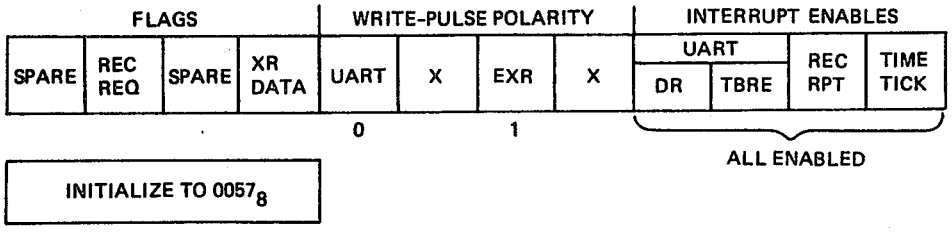

Interconnection of the CPU 150 and PIEs 152, 154, and 156 results in additional input/output-transfer (IOT) instructions specific to the present system. An overview of the ECS 100 data flow is shown in FIG. 6. Table 3 sets forth the special input/output instructions, with reference to the instruction format illustrated in FIGS. 7A–7I. For the entries in Table 3, the octal machine code for each instruction is given, followed by the mnemonic and the operation performed. Ac is the accumulator, XR is the expansion register, and V indicates the logic 'OR' operation.

As described in conjunction with FIG. 3 the motor controller 102 provides the functions of driving the motor 60 in its forward, reverse, and dynamic braking modes, and also driving the detent (latch and unlatch) solenoids 107 and 108. Commands are transferred to the controller 160 from the expansion register 180 by the signal RWMOTOR which occurs when a write motor (WMOTOR) input-output instruction is executed. Bit assignments are as follows:

Bit 8—unlatch
Bit 9—latch
Bit 10—drive up
Bit 11—drive down

If bit 8 is one, voltage is applied to the solenoid 108 that releases the detent; if bit 9 is one, voltage is applied to the solenoid 107 that applies the detent. The four states that may be specified by the two bit word formed by bits 10 and 11 are:

| Word | |
|---|---|
| 00 | Motor drive off (minimum power in controller). |
| 01 | Apply current-limited dynamic braking to motor. |
| 10 | Drive motor in down direction. |
| 11 | Drive motor in up direction. |

Table 3

| | | |
|---|---|---|
| 6100 | RDSTAT | Ac V STATUS DISCRETES → Ac (FIG. 7A) |
| 6110 | RUART | Ac V SERIAL RECEIVER → Ac (FIG. 7B) |
| 6111 | WRUART | Ac → SERIAL XMTR INITIATE (FIG. 7C) |

Table 3-continued

| | | |
|---|---|---|
| 6112 | SKPTBE | SKIP IF SERIAL XMTR READY FOR A CHARACTER |
| 6113 | SKPDR | SKIP IF NEW SERIAL CHARACTER RECEIVED |
| 6101 | WEXR | ACCUMULATOR → EXPANSION REGISTER |
| 6106 | SXRDAT | SEQUENCE TRANSFERS EXPANSION REGISTER TO RECORDER DATA REGISTER RESETS RUPT |
| 6107 | CXRDAT | COUNTER |
| 6316 | SXRPAR | SEQUENCE SHIFTS RECORDER DATA REG BIT 11 |
| 6317 | CXRPAR | INTO RECORDER CONTROL REGISTER |
| IF DO SXRDAT FIRST, THEN THIS SEQUENCE SHIFTS BIT 11 OF EXPANSION REGISTER INTO PARAMETER REGISTER | | |
| 6215 | WCRB2 | Ac → PIE 2 CONTROL REG. B (FIG. 7D) |
| 6205 | WCRA2 | Ac → PIE 2 CONTROL REG. A |
| 6204 | RCRA2 | Ac ← PIE 2 CONTROL REG. A V Ac (FIG. 7E) |
| 6315 | WCRB3 | Ac → PIE 3 CONTROL REG. B (FIG. 7F) |
| 6305 | WCRA3 | Ac → PIE 3 CONTROL REG. A |
| 6304 | RCRA3 | Ac ← (PIE 3 CONTROL REG. A) V Ac (FIG. 7G) |
| 6116 | SRREQ | SEQUENCE PRODUCES "RECORD REQUEST" |
| 6117 | CRREQ | PULSE TO RECORDER |
| 6306 | SFLGAP | SEQUENCE PRODUCES "FILE GAP REQUEST" |
| 6307 | CFLGAP | PULSE TO RECORDER (WHICH IS IGNORED) |
| 6102 | SKIPTK | SKIP IF TIME-TICK HAS RISEN |
| 6103 | SKIPRR | SKIP IF RECORDER INTERRUPT HAS RISEN |
| 6202 | SKIPA1 | SKIP IF ATTN1 HAS RISEN |
| 6203 | SKIPA2 | SKIP IF ATTN2 HAS RISEN |
| 6212 | SKIPPS | SKIP IF PSTOP HAS RISEN (PISTON AT STOP) |
| 6302 | SKIPTL | SKIP IF TOP OF LINE SENSOR - 1 |
| 6303 | SKIPBL | SKIP IF BOTTOM OF LINE SENSOR = 1 |
| 6312 | SKIPOH | SKIP IF COMPARATOR SAYS DAC >INPUT |
| 6313 | SKBUSY | SKIP IF TAPE RECORDER NOT BUSY |
| 6201 | WPWR | XR → POWER CONTROLS |
| 6211 | WDAC | XR → DIGITAL-TO-ANALOG CONVERTER |

CODE IS OFFSET BINARY, i.e.

| 0 | 1 | 2 | 3 | 4 | 5 | 6 | 7 | 8 | 9 | 10 | 11 | | |
|---|---|---|---|---|---|---|---|---|---|---|---|---|---|
| 0 | 0 | . | . | . | . | . | . | . | . | . | 0 | → | −10V |
| 1 | 0 | . | . | . | . | . | . | . | . | . | 0 | → | 0V |
| 1 | 1 | 1 | . | . | . | . | . | . | . | . | 1 | → | +10V |

| | | |
|---|---|---|
| 6311 | WMOTOR | XR → MOTOR CONTROLLER |
| ENCODER IS POWERED WHEN FLAG 4 OF CONTROL REG. A OF PIE 3 IS 0. ENCODER IS UNPOWERED WHEN FLAG 4 OF CRA OF PIE 3 IS 1. ACCESSED VIA WCRA3 AND RCRA3. | | |
| 6310 | RDENC | ENCODER V Ac → Ac |
| 6301 | INPUT | XR → ANALOG INPUT SELECT |
| 6216 | SMR | PULSES MASTER RESET LINE TO UART |
| 6217 | CMR | AT TURNON OR TO CLEAR ERROR BITS |
| 6114 | WVR1 | Ac → VECTOR ADDRESS FOR RUPTS ON PIE 1, i.e., TICK, RECRPT, UART TBRE, AND UART DR |
| 6214 | WVR2 | Ac → VECTOR ADDRESS FOR RUPTS ON PIE 2, i.e., ATTN1, ATTN2, PSTOP |
| 6314 | WVR3 | SETS VECTOR ADDRESS FOR PIE 3 (TOP & BOTTOM OF LINE DACHI, TR BUSY) IT IS ANTICIPATED THAT THESE WILL NOT INTERRUPT THE PRECESSOR) |
| 6115 | WCRB1 | Ac → PIE 1 CONTROL REGISTER B (FIG. 7H) |
| 6105 | WCRA1 | Ac → PIE 1 CONTROL REG. A |
| 6104 | RCRA1 | Ac ← (PIE 1 CONTROL REG. A) V Ac (FIG. 7I) |

Figure 8:
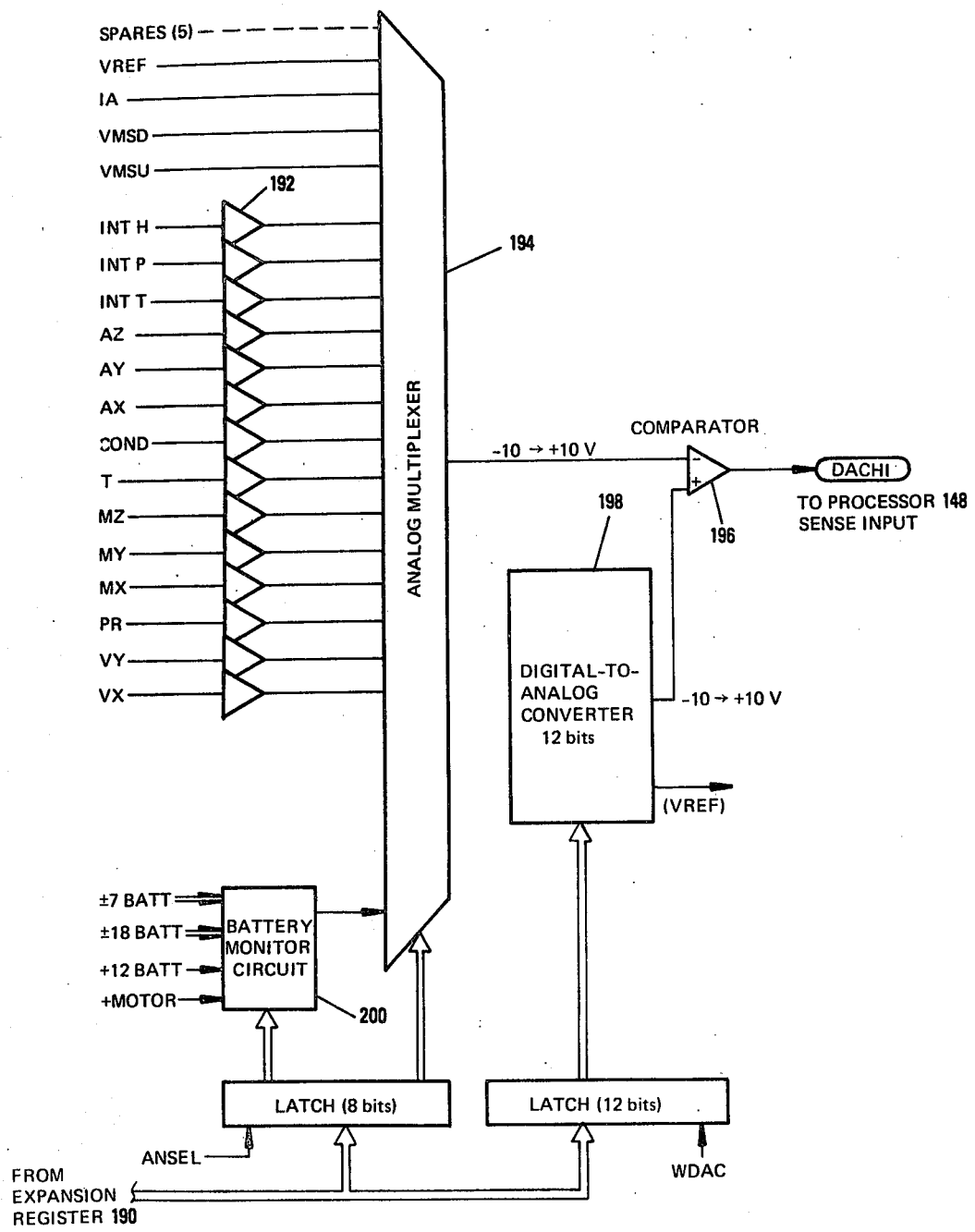
FIG. 8 shows in detailed block diagram form, the analog portion of the ECS of FIG. 4.

A detailed block diagram of the analog portion 190 of ECS 100 is shown in FIG. 8. Individual preconditioning and scaling amplifiers 192 associated with each input produce outputs that vary from −10 to +10 volts over the chosen sensor range. Table 4 shows the selection codes and design end points for the analog inputs to the ECS 100.

A single channel is selected via a 24-input analog multiplexer 194 and applied to a precision comparator 196 along with the output of a 12-bit digital-to-analog converter 198. The output from comparator 196 connects to a processor sense input (DACHI) which may be tested by program. Analog-to-digital conversion is accomplished by a successive-approximation routine resident in program memory.

Battery monitor circuit 200 permits the selection of an attenuated battery voltage cfor conversion, including the +MOTOR signal from the motor controller 102. The other three signals representing the motor behavior are brought to the multiplexer, as is the ECS 100 internal reference voltage which is obtained from the digital-to-analog converter 198.

5. Programmed Microprocessor

Table 4

| Select Code (Octal) | Symbol | Variable |
|---|---|---|
| XX01 | VX | X velocity |
| XX02 | VY | Y velocity |
| XX03 | PR | External pressure |
| XX04 | MX | X magnetometer |
| XX05 | MY | Y magnetometer |

Table 4-continued

| Select Code (Octal) | Symbol | Variable |
|---|---|---|
| XX06 | MZ | Z magnetometer |
| XX07 | T | External temperature |
| XX10 | COND | Conductivity |
| XX11 | AX | X accelerometer |
| XX12 | AY | Y accelerometer |
| XX13 | AZ | Z accelerometer |
| XX14 | INT T | Internal temperature |
| XX15 | INT P | Internal Pressure |
| XX16 | — | — |
| XX17 | VMSU | Motor voltage 1 |
| XX20 | VMSD | Motor voltage 2 |
| XX21 | IA | Motor current |
| XX22 | VREF | Reference 2.5 V |
| XX23 | — | — |
| XX24 | — | — |
| XX25 | — | — |
| XX26 | — | — |
| XX27 | — | — |
| X0XX | — | — |
| X100 | — | — |
| X200 | −18B | −18 V battery |
| X300 | −7B | −7 V battery |
| X400 | +12B | +12 V battery |
| X500 | +MOTOR | Motor battery |
| X600 | +18B | +18 V battery |
| X700 | +7B | +7 V battery |

A microprocessor 150 and associated memory 161 provide the overall control for system 1 so that the assent and decent rates may be precisely controlled without exact foreknowledge of the critical parameters of line tilt, local water density, mooring line friction and current velocity profile. All this is accomplished minimal interfering effects of wave induced motion. Furthermore, the system 1 provides output signals representative of the resolution of the ocean current in absolute north and east components so that all of the desired averages of these components are recorded. In performing this control function, the microprocessor 150 performs two primary functions during operation:

(1) ascent/descent rate and scheduling control, using pressure and current data and affected by motor-driven change of buoyancy.

(2) data gathering via datatizing of analog sensor outputs, processing and recording of that data.

Figure 9:
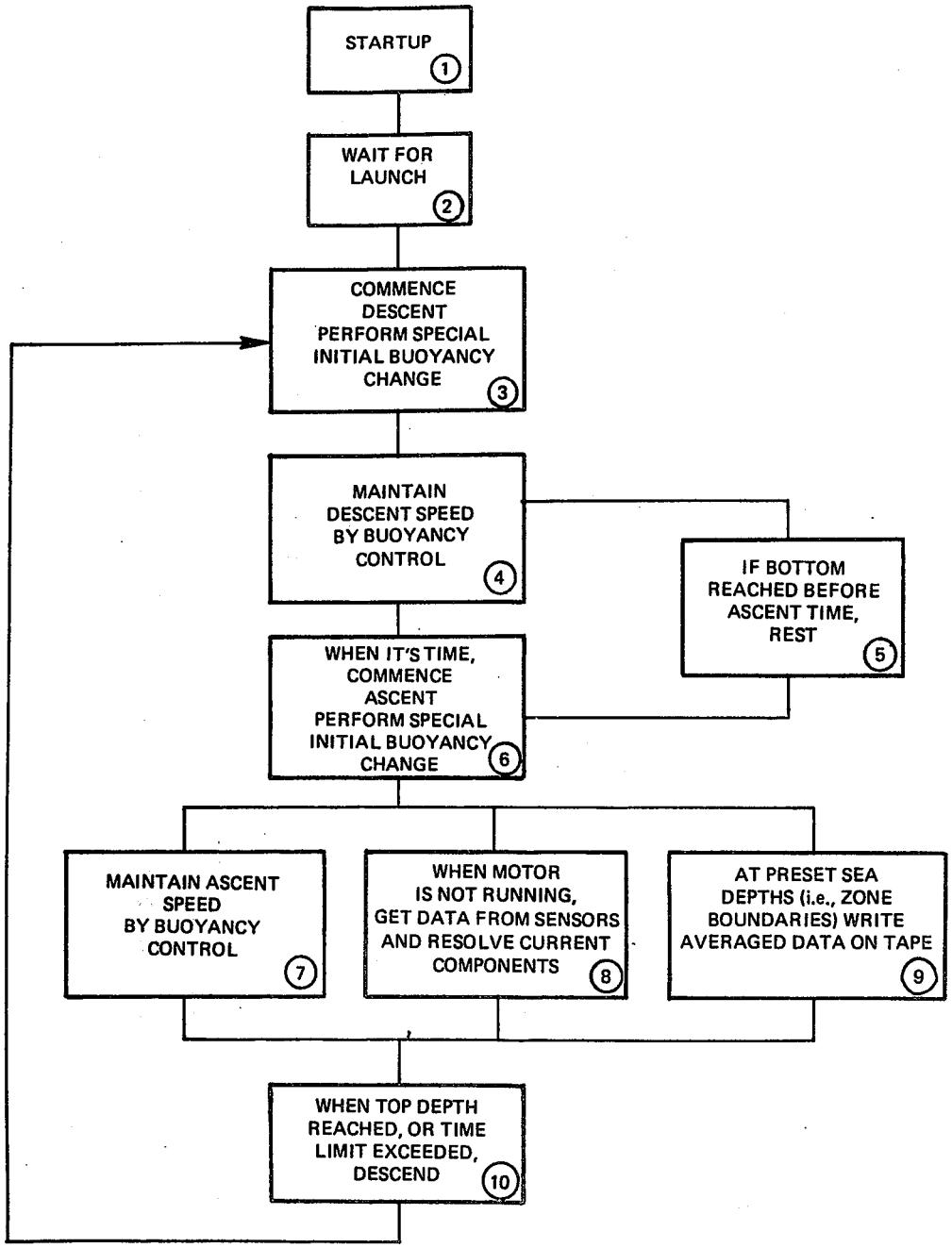
FIG. 9 shows in block diagram form, the tasks performed by the programmed microprocessor of the ECS of FIG. 4.

FIG. 9 shown in block diagram form the tasks performed by the programmed microprocessor 150. The encircled reference numerals in FIG. 9 relate to the following numbered paragraphs explaining the various subtasks.

1. Startup is initiated manually. Prior to startup, the clock and microprocessor 150 may be operating and most system functions may be exercised for test purposes.

2. System 1 remains dormant until a preset time and pressure are reached.

3. To commence descent (or ascent) the buoyancy motor runs until a defined displacement change has been obtained after leaving the upper (or lower) stop. This displacement is computed in real time, as a simple function of local current magnitude, and (descent only) of the time available before the next ascent.

4. Periodically, pressure is sensed, and adjusted ascent/descent rate of the system is calculated. If the system has had sufficient time to reach terminal velocity after the previous buoyancy change, then a decision is made as to whether or not further buoyancy change is necessary, based on whether the ascent/descent velocity is within specified limits. These limits may be changed for each zone during ascent; By way of example, typical values might be in the range 7 to 13 centimeters/second for ascent, or in the range −7 to −20 centimeters/second for descent. If buoyancy change is necessary, the amount, in piston-position encoder units, is calculated as a function of the desired speed change, the value and result of the last buoyancy change, and the local current magnitude.

5. The "bottom" is determined solely by pressure.

6. Same as paragraph 3 above. Ascent commences at predetermined times.

7. Same as paragraph 4 above. Typically, ascent may take 30 minutes.

8. Current, accelerometer, and magnetometer data are sensed frequency, e.g. every 0.5 to 4 seconds. All data is saved directly on the onboard tape recorder 98. In alternative embodiments, only zone averages of resolved current velocity components may be recorded.

9. At preset zones, i.e. pressures, time is determined and temperature, pressure, and conductivity are averaged, and recorded for each zone.

10. The "top" is defined solely by pressure. The "time limit" for ascent is reached when all the time remaining before the next ascent is needed for descent.

Figure 10:
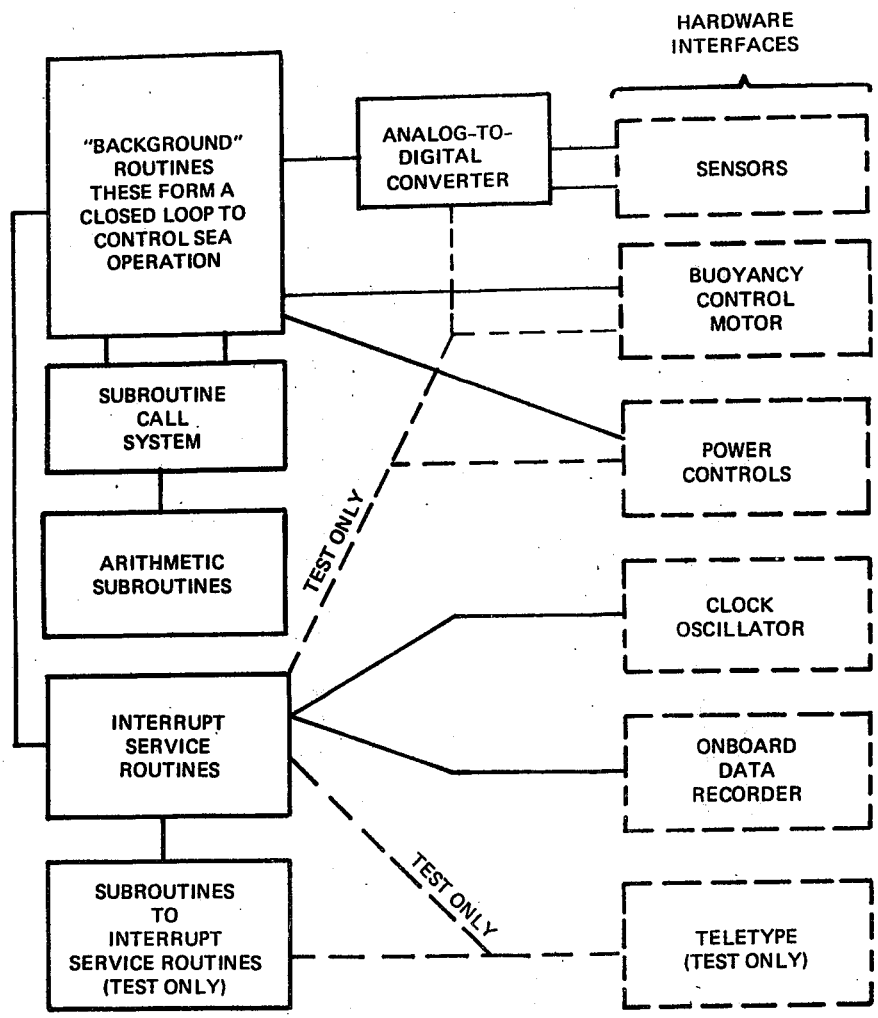
FIG. 10 shows an overview of the background and interrupt routines for the microprocessor of the ECS of FIG. 4.
Figure 11:
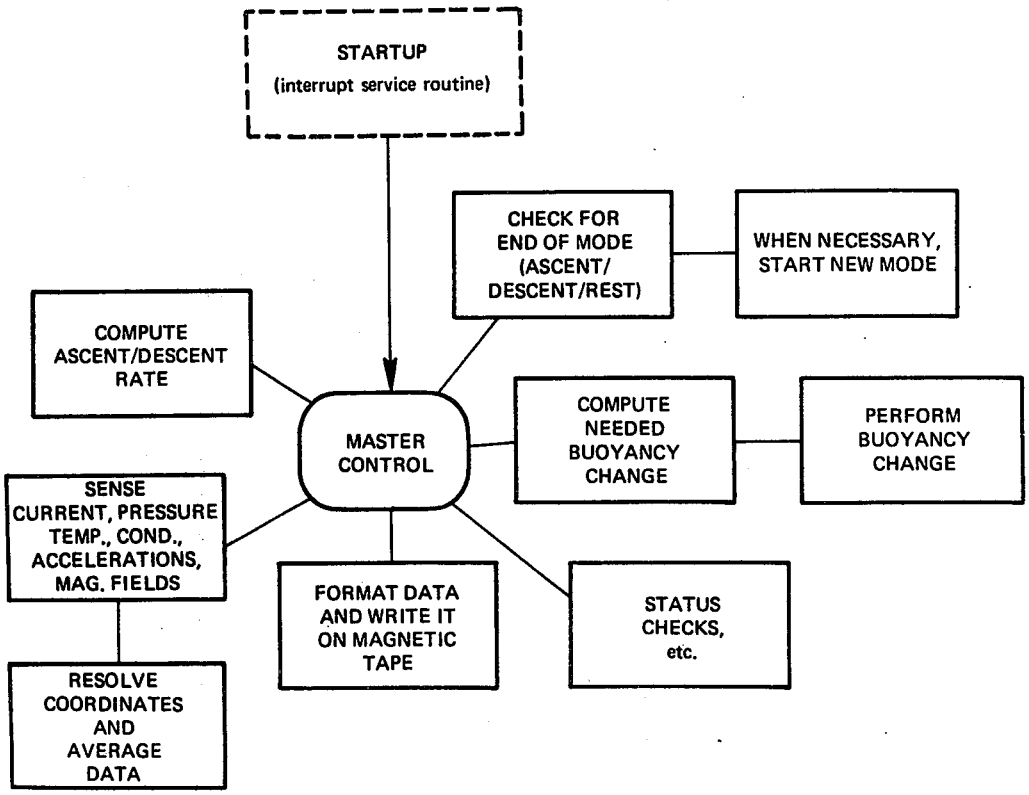
FIGS. 11-13 show component routines for the background, arithmetic and service tasks for the microprocessor of the ECS of FIG. 4.
Figure 12:
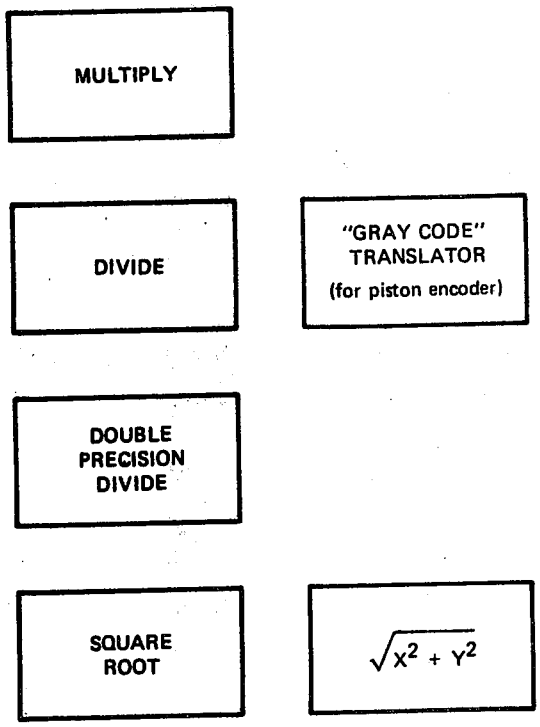
Figure 13:
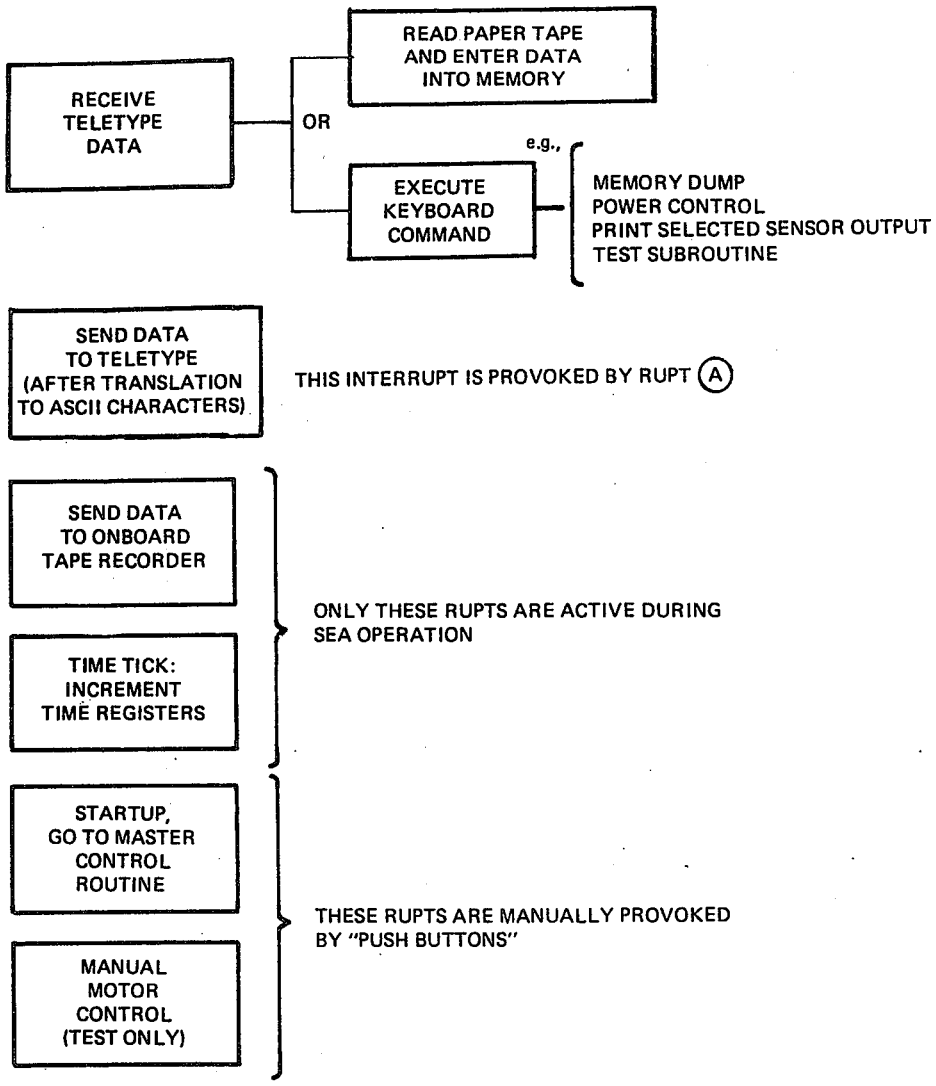
Figure 14:
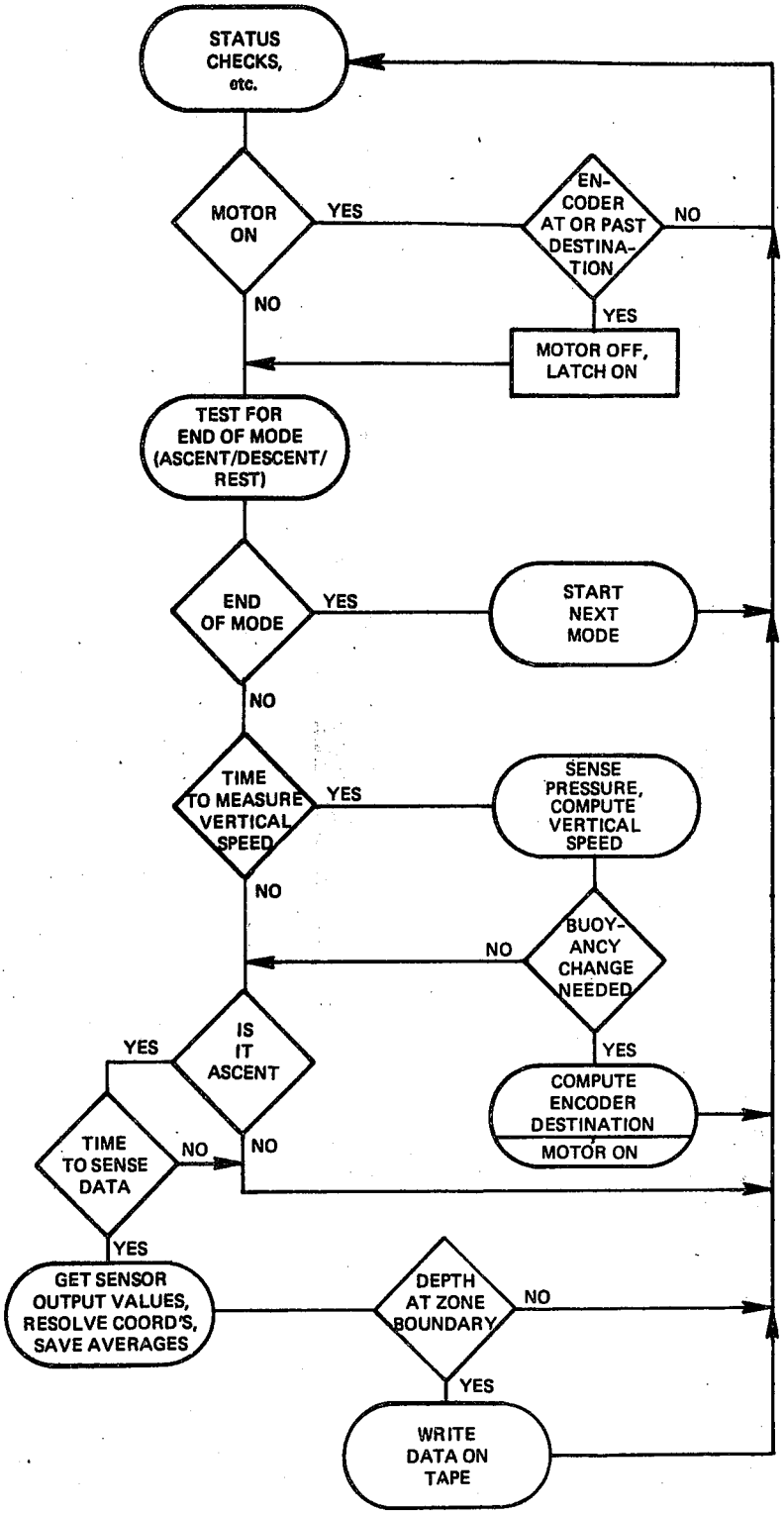
FIG. 14 shows in detailed flow chart form, the master control routine for the microprocessor of the ECS of FIG. 4.

The microprocessor 150 is functionally equivalent to a Digital Equipment Corporation PDP8/E computer using the same instruction set. FIG. 10 shows an overview of the background and interrupt routines and how those routines interrupt with the hardware. FIGS. 11–13 show major component routines of the background and arithmetic subroutines, and interrupt service routines, respectively. FIG. 14 is a detailed flow chart of the logic of the master control routine. From these flow charts and the above description, the particular instructions for executing them for controlling the operation of system 1 may be readily configured by one skilled in the art. The numeric machine instructions in machine language form are shown in the appendix.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

APPENDIX

TABLE OF CONTENTS PCM BETA PROGRAMS, 7/78. DAY=221 19:00 08/09/78

| MEMBER | SSI | TTR | RECORDS | PAGE |
|---|---|---|---|---|
| ABVAL | | 0000.13 | 31 | 1 |
| ATCD | | 0000.18 | 63 | 2 |
| ATTN1 | | 0012.05 | 31 | 4 |
| ATTN2 | | 001B.06 | 80 | 5 |
| BDIVID | | 0001.06 | 84 | 7 |
| BUD1C | | 0016.10 | 92 | 9 |
| DATGET | | 0016.09 | 59 | 11 |
| DELAY | | 0001.10 | 32 | 13 |
| DFDIV | | 0002.05 | 34 | 14 |
| DUMPACKG | | 0002.0A | 30 | 15 |
| EDGET | | 0017.0B | 91 | 16 |
| ENCSET | | 0002.0E | 34 | 18 |
| ENDLYR | | 0013.01 | 47 | 19 |
| ENDMA | | 0019.09 | 57 | 20 |
| ENDMD | | 0015.0A | 57 | 21 |
| ENDMR | | 0012.01 | 28 | 22 |
| ENDMR2 | | 0003.01 | 28 | 23 |
| GPAYBI | | 0003.05 | 34 | 24 |
| INITA | | 001A.07 | 113 | 25 |
| INITD | | 0018.0F | 80 | 27 |
| INITIAL | | 001B.0F | 269 | 29 |
| INITR | | 0016.03 | 47 | 34 |
| INITR2 | | 0018.08 | 59 | 35 |
| LAUNCH | | 0014.08 | 142 | 37 |
| MASTER | | 001E.01 | 255 | 40 |
| MOFF | | 0003.0A | 59 | 45 |
| MOON | | 0004.01 | 50 | 47 |
| MULT | | 0004.07 | 57 | 48 |
| NDELB | | 0004.0E | 93 | 49 |
| PARAM | | 001A.01 | 44 | 51 |
| PSTOP | | 0005.0A | 62 | 52 |
| PBEGIN | | 0006.04 | 36 | 54 |
| RECRPT | | 0006.09 | 30 | 55 |
| RUPTSERV | | 0005.0D | 68 | 56 |
| SQRT | | 0007.05 | 47 | 58 |
| SUBOVR | | 0007.0B | 70 | 59 |
| SYSOVR | | 0008.04 | 77 | 61 |
| TAVE64 | | 0013.0E | 78 | 63 |
| TESTRC | | 0008.0D | 45 | 65 |
| TIMERUPT | | 0009.04 | 41 | 66 |
| TPGET | | 0013.07 | 56 | 67 |
| UARTCOMS | | 0009.0A | 279 | 68 |
| UARTSERV | | 000B.0A | 220 | 73 |
| UARTTPPE | | 000D.06 | 99 | 77 |
| UMOFF | | 000E.03 | 59 | 79 |
| USUBS | | 000E.0A | 177 | 81 |
| VMAGET | | 000F.0E | 86 | 85 |
| WRITE | | 0010.0A | 172 | 87 |
| ZDGET | | 0012.0A | 57 | 91 |

****** END OF DIRECTORY 49 MEMBERS - 3 BLOCKS USED - 158 BYTES PLUS 14 BLOCKS UNUSED ******

ABVAL

```
1BEGIN PASS 1                                                                    0000000
                                                                                 0000000
                                                                                 0000000
 END OF PASS 1                                                                   0000000
1BEGIN PASS 2                                                                    0000000
                                                                                 0000000
    1                 /  ABSOLUTE VALUE                                          0000000
    2                 /      ABVAL(ACC.) LEFT IN ACC. AND 131 IS FLIP-FLOPPED    0000000
    3                 /        (0 -- -1) AS A FLAG IF ACC. WAS NEGATIVE.         0000000
    4                 /                                                          0000000
    5          5543   RETURN=JMP I 143                                           0000000
    6          7140   *7140                                                      0000000
    7   7140   7500   ABVAL,   SMA                                               0000000
    8   7141   5543            RETURN                                            0000000
    9   7142   7041            CIA                                               0000000
   10   7143   3122            DCA 122          / TEMPORARY SAVE                 0000000
   11   7144   1131            TAD 131                                           0000000
   12   7145   7440            SZA              / FLAG ZERO ?                    0000000
   13   7146   7201            CLA IAC          / NO, ACC. = 1                   0000000
   14   7147   7041            CMA IAC          / YES,  ACC = ACC - 1            0000000
   15   7150   7040            CMA                                               0000000
   16   7151   3131            DCA 131          / DEPOSIT FLAG                   0000000
   17   7152   1122            TAD 122          / ABVAL                          0000000
   18   7153   5543            RETURN                                            0000000
                                                                                 0000000
 END OF PASS 2                                                                   0000000
                                                                                 0000000
    0 ERRORS DETECTED                                                            0000000
1SYMBOL TABLE                                                                    0000000
                                                                                 0000000
 ABVAL  7140    RETURN 5543                                                      0000000
```

****** END OF MEMBER ABVAL 31 RECORDS ******

```
ATOD

1BEGIN PASS 1

 END OF PASS 1
1BEGIN PASS 2

                        / SELECTS ANALOG INPUT (IN ACCUMULATOR BEFORE CALL),
                        /  WAITS 10 OR 30 MILLISECONDS FOR TRANSIENT (30 IF BATTERY MONITOR), AND
                        /  LEAVES BINARY VALUE OF SELECTED INPUT IN 30 AND ACCUMULATOR
                        /
                 4140   CALL=JMS 140
                 5543   RETURN=JMP I 143
                 6101   WEXR=6101
                 6211   WDAC=6211
                 6312   SKIPDH=6312
                 7363   DELAY3=7363
                 6301   INPUT=6301
                 7362   DELAY2=7362
                 0030    *30
          0030   0000   APPROX,  0
                 3400   *3400
          3400   6101   ATOD,    WEXR
          3401   6301           INPUT                  / SELECT ANALOG INPUT
          3402   0241           AND BITS
          3403   7450           SNA                    / BATTERY MONITOR ?
          3404   5210           JMP NBM                / NO
          3405   7300           CLL CLA                / YES
          3406   4140           CALL
          3407   7362           DELAY2                 / WAIT 10 MS
          3410   4140   NBM,    CALL
          3411   7363           DELAY3                 / WAIT 10 MS
          3412   7330           CLA CLL CML RAR        / 4000
          3413   7421           MQL
          3414   3030           DCA APPROX             / 0 INTO APPROX
          3415   1030   ADLOOP, TAD APPROX
          3416   7501           MQA                    / APPROX OR BITPOS
          3417   6101           WEXR
          3420   6211           WDAC
          3421   7200           CLA
          3422   1030           TAD APPROX             / RECOVER APPROX AND KILL TIME
          3423   6312           SKIPDH                 / DAC TOO HIGH?
          3424   7501           MQA                    / NO,  OR IN BITPOS
          3425   3030           DCA APPROX             /       AND PUT BACK
          3426   7701           CLA MQA
          3427   7110           CLL RAR                / UPDATE BITPOSITION
          3430   7450           SNA                    / DONE?
          3431   5234           JMP ADOUT              / YES
          3432   7421           MQL                    / NO,  CONTINUE
          3433   5215           JMP ADLOOP
          3434   7300   ADOUT,  CLA CLL
          3435   6101           WEXR
          3436   6211           WDAC
          3437   1030           TAD APPROX             / THIS LEAVES OFFSET BINARY
          3440   5543           RETURN                 /   VALUE IN ACC. AND APPROX
          3441   0700   BITS,   0700

 END OF PASS 2

    0 ERRORS DETECTED
1SYMBOL TABLE

 ADLOOP 3415   ADOUT  3434   APPROX 0030   ATOD   3400   BITS   3441   CALL   4140   DELAY2 7362   DELAY3 7363
 INPUT  6301   NBM    3410   RETURN 5543   SKIPDH 6312   WDAC   6211   WEXR   6101

******** END OF MEMBER ATOD        63 RECORDS ********


ATTN1

1BEGIN PASS 1

 END OF PASS 1
1BEGIN PASS 2

                        /  INTERRUPT ROUTINE TO RESET AND START TIME REGISTERS
                        /       20,21,22.
                        /
                 6105   WCRA1=6105
                 5340   *5340
          5340   7300   ATTN1,   CLL CLA
          5341   3020           DCA 20          / CLEAR TIME WORDS--
          5342   3021           DCA 21
          5343   3022           DCA 22
          5344   3065           DCA 65          / CLEAR COUNTER OF RESETS
          5345   3054           DCA 54          / CLEAR PSTOP FLAG
          5346   3006           DCA 6           / CLEAR UPLIM COUNTER
          5347   3007           DCA 7           / CLEAR LOWLIM COUNTER
          5350   1354           TAD K57
          5351   6105           WCRA1           / ENABLE TIME RUPT
          5352   7300           CLL CLA
          5353   5432           JMP I 32        / RETURN
          5354   0057   K57,    57

 END OF PASS 2

    0 ERRORS DETECTED
1SYMBOL TABLE

 ATTN1  5340   K57    5354   WCRA1  6105

******** END OF MEMBER ATTN1       31 RECORDS ********
```

```
ATTN2

1BEGIN PASS 1


 END OF PASS 1
1BEGIN PASS 2

                    /  CALLED BY SYSOVR WHEN MAGNET IS REMOVED.
                    /  THIS STARTS POWER AND ENCODER, ENTERS WAIT MODE, AND
                    /    DOES APPROPRIATE INITIALIZING.  SYSTEM IS NORMALLY IN
                    /    IDLE MODE BEFORE ATTN2 IS CALLED.
                    /
            6101    WEXR=6101
            6201    WPWR=6201
            4500    TPGET=4500
            4140    CALL=JMS 140
            5543    RETURN=JMP I 143
            7360    DELAY=7360
            6304    RCRA3=6304
            6305    WCRA3=6305
            5000    DATGET=5000
                    /
            3040    *3040
    3040    7301    ATTN2,   CLA CLL IAC
    3041    3055             DCA 55        / SET AIR PURGE FLAG
    3042    3107             DCA 107       / CLEAR DELTA B DAMPING FLAG
    3043    3031             DCA 31        / CLEAR DESCENT FORMAT 3 COUNTER
    3044    1314             TAD M164
    3045    3106             DCA 106       / ENDMODE POSTPONEMENT COUNTER
    3046    1021             TAD 21        / TIME (40.96 SEC. UNITS)
    3047    1176             TAD 176       / WAIT TIME   (  "  )
    3050    3024             DCA 24        / SAVE AS ASCENT END TIME
    3051    1173             TAD 173       / FULL CYCLE TIME
                    /        CLL RAR       / DIVIDE BY 2
    3052    1021             TAD 21        / TIME NOW
    3053    3025             DCA 25        / SAVE TIME OF NEXT ASCENT
                    /        CLA CMA       / 7777 INTO ACC.
                    /        WEXR
                    /        WPWR          / ALL POWER ON
                    /        DCA 57        / SAVE POWER WORD
    3054    4140             CALL
    3055    7360             DELAY         / .1 SECOND
    3056    7200             CLA
    3057    6304             RCRA3
    3060    7421             MQL
    3061    7330             CLA CLL CML RAR    / ENCODER ON BIT
    3062    7501             MQA           / CRA3 OR (INCLUSIVE) ENCODER ON BIT
    3063    6305             WCRA3         / ENCODER ON
    3064    4140             CALL
    3065    4500             TPGET         / GET EXTERNAL PRESSURE INTO 136 AND ACC.
    3066    3137             DCA 137       / SAVE AS OLD P
    3067    3023             DCA 23        / ZERO Z DOT STOPWATCH
    3070    1313             TAD ENDDA     /  ENDMODE(DESCENT) ADDRESS
    3071    3067             DCA 67        / SAVE ON PAGE 0.
    3072    7307             CLA CLL IAC RTL    / 4
    3073    3177             DCA 177       / MODE ID = WAIT
    3074    1311             TAD PL        / ADD. OF P TOP OF LAYER. SET TO BOTTOM LAYER
    3075    3161             DCA 161       /   SO ENDMA WON'T START DESCENT PREMATURELY.
    3076    1312             TAD M10       / WRITE 10 FRAMES OF JUNK ---
    3077    3134             DCA 134
    3100    4140             CALL
    3101    5000             DATGET
    3102    2134             ISZ 134
    3103    5300             JMP .-3
    3104    7300             CLL CLA
    3105    6101             WEXR
    3106    6201             WPWR          / POWER OFF
    3107    3057             DCA 57        / POWER WORD
    3110    5543             RETURN
    3111    3200    PL,      3200
    3112    7766    M10,     -12
    3113    6041    ENDDA,   6041          / ADDRESS OF ENDMODE(DESCENT)
    3114    7552    M164,    -226

 END OF PASS 2

    0 ERRORS DETECTED
1SYMBOL TABLE

 ATTN2  3040    CALL   4140    DATGET 5000    DELAY  7360    ENDDA  3113    M10    3112    M164   3114    PL     3111
 RCRA3  6304    RETURN 5543    TPGET  4500    WCRA3  6305    WEXR   6101    WPWR   6201

******** END OF MEMBER ATTN2       80 RECORDS ********


BDIVID

1BEGIN PASS 1                                                                                                   0000000
                                                                                                                0000000
                                                                                                                0000000
 END OF PASS 1                                                                                                  0000000
1BEGIN PASS 2                                                                                                   0000000
                                                                                                                0000000
                    /  UNSIGNED BASIC DIVIDE.                                                                   0000000
                    /      DIVISOR IN ACC.                                                                      0000000
                    /      DIVIDEND IN 132, 133                                                                 0000000
                    /      QUOTIENT IN 130,   REMAINDER IN 132                                                  0000000
                    /   LINK ON ENTRY:  0 MEANS HIGH ORDER QUOT. DESIRED                                        0000000
                    /         1 MEANS LOW ORDER QUOT. DESIRED (ASSUMES DIVISOR                                  0000000
                    /            >LEFT HAND DIVIDEND AND < 4000 OCTAL)                                          0000000
                    /                                                                                           0000000
            5543    RETURN=JMP I 143                                                                            0000000
            4140    CALL=JMS 140                                                                                0000000
```

BDIVID

```
 11          0121    MASK=121                                                    0000000
 12          0130    QUOT=130                                                    0000000
 13          0135    DIVIS=135                                                   0000000
 14          0134    L=134                                                       0000000
 15          7200    *7200                                                       0000000
 16   7200   3135    BDIVID,  DCA DIVIS          / DIVISOR                       0000000
 17   7201   1264             TAD DCOUNT                                         0000000
 18   7202   3134             DCA L              / LOOP COUNTER                  0000000
 19   7203   3130             DCA QUOT           / CLEAR QUOTIENT                0000000
 20   7204   7240             CLA CMA                                            0000000
 21   7205   3121             DCA MASK           / INITIALIZE MASK               0000000
 22   7206   7430             SZL                                                0000000
 23   7207   5220             JMP DSTART         / SKIP 12 BIT ROTATION OF DIVIDEND 0000000
 24                                             /      FOR LOW ORDER QUOTIENT.   0000000
 25   7210   7201             CLA IAC                                            0000000
 26   7211   3121             DCA MASK           / CHANGE MASK                   0000000
 27   7212   1132             TAD 132            / ROTATE DIVIDEND 12--          0000000
 28   7213   7421             MQL                                                0000000
 29   7214   1133             TAD 133                                            0000000
 30   7215   3132             DCA 132                                            0000000
 31   7216   7501             MQA                                                0000000
 32   7217   3133             DCA 133                                            0000000
 33   7220   7100    DSTART,  CLL                                                0000000
 34   7221   1132             TAD 132            / ROTATE DIVIDEND 1 LEFT--      0000000
 35   7222   7004             RAL                                                0000000
 36   7223   3132             DCA 132                                            0000000
 37   7224   1133             TAD 133                                            0000000
 38   7225   7004             RAL                                                0000000
 39   7226   3133             DCA 133                                            0000000
 40   7227   7430             SZL                                                0000000
 41   7230   2132             ISZ 132                                            0000000
 42   7231   1132             TAD 132                                            0000000
 43   7232   0121             AND MASK           / MASK LH (-13-L) BITS IF HIGH QUOT. 0000000
 44   7233   7141             CLL CIA            / MINUS                         0000000
 45   7234   1135             TAD DIVIS          / DIVISOR - ACC.                0000000
 46   7235   7420             SNL                / ACC. > DIVIS?                 0000000
 47   7236   5241             JMP D2             / YES                           0000000
 48   7237   7440    ZTEST,   SZA                / NO;  ACC. = DIVISOR ?         0000000
 49   7240   5247             JMP RELOOP         / NO                            0000000
 50   7241   7300    D2,      CLL CLA            / YES                           0000000
 51   7242   1135             TAD DIVIS                                          0000000
 52   7243   7041             CIA                                                0000000
 53   7244   1132             TAD 132            / LH DIVIDEND                   0000000
 54   7245   3132             DCA 132                                            0000000
 55                                             / LH DIVIDEND = LH DIVIDEND - DIVISOR. 0000000
 56   7246   2130             ISZ QUOT           / INCREMENT QUOTIENT            0000000
 57   7247   2134    RELOOP,  ISZ L              / LOOP COUNTER                  0000000
 58   7250   5253             JMP .+3                                            0000000
 59   7251   7300             CLA CLL                                            0000000
 60   7252   5543             RETURN                                             0000000
 61   7253   7300             CLL CLA                                            0000000
 62   7254   1130             TAD QUOT           / ROTATE QUOTIENT               0000000
 63   7255   7004             RAL                                                0000000
 64   7256   3130             DCA QUOT                                           0000000
 65   7257   7120             STL                                                0000000
 66   7260   1121             TAD MASK           / ADD RH ONE TO MASK            0000000
 67   7261   7004             RAL                                                0000000
 68   7262   3121             DCA MASK                                           0000000
 69   7263   5220             JMP DSTART                                         0000000
 70   7264   7764    DCOUNT,  -14                / -12 DECIMAL, LOOP CONSTANT.   0000000
                                                                                 0000000
 END OF PASS 2                                                                   0000000
                                                                                 0000000
    0 ERRORS DETECTED                                                            0000000
15YMBOL TABLE                                                                    0000000
                                                                                 0000000
 BDIVID 7200    CALL   4140    DCOUNT 7264    DIVIS  0135    DSTART 7220    D2     7241    L      0134    MASK   0121  0000000
 QUOT   0130    RELOOP 7247    RETURN 5543    ZTEST  7237                                                                0000000
```

****** END OF MEMBER BDIVID 84 RECORDS ******

BUOYC

```
1BEGIN PASS 1

 END OF PASS 1
1BEGIN PASS 2

  1                 / TESTS TO SEE IF BUOYANCY CHANGE IS NECESSARY, AND
  2                 /     IF IT IS CALLS NDELB TO GET ENCODER DESTINATION
  3                 /     AND STARTS MOTOR.
  4                 /
  5          6310   RDENC=6310
  6          3500   GRAYBI=3500
  7          6101   WEXR=6101
  8          2510   MOON=2510
  9          6311   WMOTOR=6311
 10          5600   EDGET=5600
 11          5543   RETURN=JMP I 143
 12          4140   CALL=JMS 140
 13          7360   DELAY=7360
 14          4600   NDELB=4600
 15                 /
 16          4400   *4400
 17   4400   7300   BUOYC,   CLA CLL
 18   4401   1077            TAD 77          / FLAG FROM LAUNCH ROUTINE, SET BEFORE LIFTOFF
 19   4402   7440            SZA             / SET?
 20   4403   5543            RETURN          / YES, RETURN
 21   4404   1167            TAD 167         / NO,  GET MOTOR FLAG
 22   4405   7440            SZA             / MOTOR ON ?
```

BUOYC

```
23   4406  5543            RETURN          / YES
24   4407  1107            TAD 107         / NO,  GET DELTA B DAMPING FLAG
25   4410  7450            SNA             / SET ?
26   4411  5215            JMP .+4         / NO, CONTINUE  (+3 HERE, FOR TEST, CAUSES RETURN)
27   4412  7200            CLA             / YES, CLEAR AND RETURN--
28   4413  3107            DCA 107
29   4414  5543            RETURN
30   4415  1175            TAD 175         / Z DOT
31   4416  7041            CIA
32   4417  1570            TAD I 170       / Z DOT MINIMUM - Z DOT
33                 /  THIS A - B ASSUMES ABVAL(A OR B) < 3777 AND IF AB < 0,
34                 /       THEN ABVAL(A) + ABVAL(B) < 4000  (OCTAL).
35   4420  7510            SPA             / ZDOT < Z DOT MIN. ?
36   4421  5235            JMP BU1         / NO
37   4422  4140            CALL            / YES
38   4423  4457            NDELB2          / ROUTINE TO COMPUTE NEEDED DELTA B
39                 / AND ENCODER DESTINATION--- DELTA B IN 166, E.D. IN 156 AND ACC.
40   4424  7300    BUED,   CLA CLL
41   4425  1256            TAD MOTDN
42   4426  4140            CALL
43   4427  2510            MOON            / MOTOR DOWN
44   4430  1175    BZ,     TAD 175
45   4431  3165            DCA 165         / OLD Z DOT = Z DOT
46   4432  1127            TAD 127
47   4433  3126            DCA 126         / OLD V MAG. = V MAG.
48   4434  5543            RETURN
49   4435  7300    BU1,    CLL CLA
50   4436  1175            TAD 175         / Z DOT INTO ACC.
51   4437  7041            CIA
52   4440  1560            TAD I 160       / Z DOT MAXIMUM
53   4441  7500            SMA             / Z DOT > MAX. ?
54   4442  5253            JMP BU2         / NO
55   4443  7300            CLL CLA         / YES
56   4444  4140            CALL            /
57   4445  4461            NDELB3          / COMPUTE NEEDED DELTA B AND E.D.
58   4446  7300    BUEE,   CLA CLL
59   4447  1255            TAD MOTUP
60   4450  4140            CALL
61   4451  2510            MOON             / MOTOR UP
62   4452  5230            JMP BZ           / MOTOR FLAG
63   4453  7300    BU2,    CLA CLL          / HERE IF Z DOT IS OK
64   4454  5543            RETURN
65   4455  0003    MOTUP,  0003
66   4456  0002    MOTDN,  0002
67                 /
68                 /  COMPUTE SIMPLE-MINDED BUOYANCY CORRECTION--
69                 /
70   4457  7300    NDELB2, CLL CLA
71   4460  1265            TAD KB
72   4461  1266    NDELB3, TAD KB2
73   4462  4140            CALL
74   4463  5600            EDGET           / GET AND LOAD ENCODER DEST.
75   4464  5543            RETURN
76   4465  7042    KB,     -736            / -30 (DECIMAL) CUBIC INCHES
77   4466  0357    KB2,    357             / +15 CU. IN.
```

END OF PASS 2

0 ERRORS DETECTED

1SYMBOL TABLE

```
BUED   4424   BUEE   4446   BUOYC  4400   BU1    4435   BU2    4453   BZ     4430   CALL   4140   DELAY  7360
EDGET  5600   GRAYBI 3500   KB     4465   KB2    4466   MOON   2510   MOTDN  4456   MOTUP  4455   NDELB  4600
NDELB2 4457   NDELB3 4461   RDENC  6310   RETURN 5543   WEXR   6101   WMOTOR 6311
```

****** END OF MEMBER BUOYC  92 RECORDS ******

DATGET

1BEGIN PASS 1

END OF PASS 1

1BEGIN PASS 2

```
1                  /  ROUTINE TO WRITE FAST ASCENT DATA.
2                  /
3          4140    CALL=JMS 140
4          5543    RETURN=JMP I 143
5          6400    WRITE=6400
6          6101    WEXR=6101
7          6201    WPWR=6201
8          7360    DELAY=7360
9                  /
10         5000    *5000
11   5000  7301    DATGET, CLL CLA IAC
12   5001  1057            TAD 57          / POWER WORD
13   5002  7450            SNA             / ALL POWER ON ?
14   5003  5217            JMP D2          / YES
15   5004  7340            CLL CLA CMA     / NO, 7777
16   5005  6101            WEXR
17   5006  6201            WPWR            / ALL POWER ON
18   5007  3057            DCA 57          / NEW POWER WORD
19   5010  1242            TAD NUM         / WAIT 4 SEC. FOR TRANSIENT
20   5011  3130            DCA 130
21   5012  4140            CALL
22   5013  7360            DELAY
23   5014  2130            ISZ 130
24   5015  5212            JMP .-3
25   5016  3033            DCA 33          / CLEAR DATAGET STOPWATCH
26   5017  1223    D2,     TAD PADD        / DATA CODE LIST START ADDRESS
27   5020  4140            CALL
28   5021  6400            WRITE           / DATA ONTO RECORDER
29   5022  5543            RETURN
30   5023  5024    PADD,   PAR
```

```
DATGET

   31   5024  5003    PAR,     5003          / FORMAT CODE 3
   32   5025  3000             3000          / COMPOSITE TIME
   33   5026  0003             0003          / PRESSURE
   34   5027  0001             1             / VX
   35   5030  0002             2             / VY
   36   5031  0010             10            / CONDUCTIVITY
   37   5032  0007             7             / TEMPERATURE
   38   5033  0011             11            / AX
   39   5034  0012             12            / AY
   40   5035  0013             13            / AZ
   41   5036  0004             4             / MX
   42   5037  0005             5             / MY
   43   5040  0006             6             / MZ
   44   5041  7777             7777          / TERMINATOR
   45   5042  7730    NUM,     -50

 END OF PASS 2

    0 ERRORS DETECTED
1SYMBOL TABLE

 CALL   4140    DATGET 5000    DELAY  7360    D2     5017    NUM    5042    PADD   5023    PAR    5024    RETURN 5543
 WEXR   6101    WFWR   6201    WRITE  6400

******** END OF MEMBER DATGET      59 RECORDS ********


DELAY


1BEGIN PASS 1


 END OF PASS 1
1BEGIN PASS 2

    1                  /  ROUTINE TO DELAY EITHER .01 OR .02 OR .1 SECONDS.
    2                  /
    3          0121    LOOP=121
    4          4140    CALL=JMS 140
    5          5543    RETURN=JMP I 143
    6          7360    *7360
    7   7360   7300    DELAY,   CLA CLL          / HERE FOR .1 SEC. DELAY
    8   7361   1371             TAD P84SEC
    9   7362   1372    DELAY2,  TAD P11SEC       / HERE FOR .02 SEC DELAY
   10   7363   1373    DELAY3,  TAD P05SEC       / HERE FOR .01 SEC DELAY
   11   7364   3121             DCA LOOP         /
   12   7365   2121             ISZ LOOP
   13   7366   5365             JMP .-1
   14   7367   7100             CLL
   15   7370   5543             RETURN
   16   7371   5100    P84SEC,  -2700
   17   7372   7550    P11SEC,  -0230
   18   7373   7550    P05SEC,  -0230

 END OF PASS 2

    0 ERRORS DETECTED
1SYMBOL TABLE

 CALL   4140    DELAY  7360    DELAY2 7362    DELAY3 7363    LOOP   0121    P05SEC 7373    P11SEC 7372    P84SEC 7371
 RETURN 5543

******** END OF MEMBER DELAY       32 RECORDS ********


DPDIV


1BEGIN PASS 1                                                                                                          0000000
                                                                                                                       0000000
                                                                                                                       0000000
 END OF PASS 1                                                                                                         0000000
1BEGIN PASS 2                                                                                                          0000000
                                                                                                                       0000000
    1                  /  UNSIGNED DOUBLE PRECISION DIVIDE.                                                            0000000
    2                  /     DIVISOR IN ACC.                                                                           0000000
    3                  /     DIVIDEND IN 132, 133                                                                      0000000
    4                  /     QUOTIENT LEFT IN 124, 125                                                                 0000000
    5                  /     REMAINDER LEFT IN 132.                                                                    0000000
    6                  /                                                                                               0000000
    7          4140    CALL=JMS 140                                                                                    0000000
    8          5543    RETURN=JMP I 143                                                                                0000000
    9          7200    BDIVID=7200                                                                                     0000000
   10          7300    *7300                                                                                           0000000
   11   7300   7100    DPDIV,   CLL              / FLAG TO BDIVID FOR HIGH ORDER QUOT.                                 0000000
   12   7301   4140             CALL                                                                                   0000000
   13   7302   7200             BDIVID                                                                                 0000000
   14   7303   1130             TAD 130                                                                                0000000
   15   7304   3124             DCA 124          / LH QUOTIENT                                                         0000000
   16   7305   1135             TAD 135          / RESTORE DIVISOR                                                     0000000
   17   7306   4140             CALL                                                                                   0000000
   18   7307   7200             BDIVID                                                                                 0000000
   19   7310   1130             TAD 130                                                                                0000000
   20   7311   3125             DCA 125          / RH QUOTIENT                                                         0000000
   21   7312   5543             RETURN                                                                                 0000000
                                                                                                                       0000000
 END OF PASS 2                                                                                                         0000000
                                                                                                                       0000000
    0 ERRORS DETECTED                                                                                                  0000000
1SYMBOL TABLE                                                                                                          0000000
                                                                                                                       0000000
 BDIVID 7200    CALL   4140    DPDIV  7300    RETURN 5543                                                             0000000

******** END OF MEMBER DPDIV       34 RECORDS ********
```

DUMBACKG

1BEGIN PASS 1

END OF PASS 1
1BEGIN PASS 2

```
                        / DUMMY BACKGROUND ROUTINE FOR TEST.
                        /
             4140       CALL=JMS 140
             6200       TESTRC=6200
             2540       *2540
   2540      7301       BACKST,  CLA CLL IAC
   2541      1177                TAD 177          / MODE
   2542      7440                SZA              / RECORDER TEST?
   2543      5340                JMP BACKST       / NO
   2544      7000                NOP
   2545      7000                NOP
   2546      3177                DCA 177          / CLEAR FLAG
   2547      1153                TAD 153          / COUNTER OF FRAMES ON TAPE
   2550      4140                CALL
   2551      6200                TESTRC           / RECORDER TEST PROGRAM
   2552      5340                JMP BACKST
   2553      2540       BA,      BACKST
```

END OF PASS 2

0 ERRORS DETECTED
1SYMBOL TABLE

BA 2553 BACKST 2540 CALL 4140 TESTRC 6200

****** END OF MEMBER DUMBACKG 30 RECORDS ******

EDGET

1BEGIN PASS 1

END OF PASS 1
1BEGIN PASS 2

```
                        /  ROUTINE TO COMPUTE ENCODER DESTINATION, GIVEN DESIRED
                        /     SIGNED DELTA BUOYANCY (IN ENCODER UNITS, I.E. CC.)
                        /     IN ACCUMULATOR.
                        /  NOTE:  DESIRED DELTA B IS RAISED TO + OR - 20 IF ITS
                        /       ABVAL IS LESS THAN 20.
                        /  ACHIEVABLE SIGNED DELTA B IS LEFT IN 166.
                        /  ENCODER DESTINATION IS LEFT IN 156 AND ACC.
                        /
             7362       DELAY2=7362
             6140       ENCGET=6140
             4140       CALL=JMS 140
             5543       RETURN=JMP I 143
             5600       *5600
   5600      3166       EDGET,   DCA 166
   5601      7100                CLL
   5602      1166                TAD 166          / DELTA B
   5603      7510                SPA
   5604      5235                JMP DBNEG        / HERE IF DELTA B > 0
   5605      1270                TAD DELBMN       / IF DELTA B < 20, DELTA B = 20
   5606      7430                SZL              / < 20 ?
   5607      5213                JMP EDX          / NO
   5610      7200                CLA              / YES
   5611      1271                TAD DELBM
   5612      3166                DCA 166          / NEW DELTA B
   5613      4140       EDX,     CALL
   5614      6140                ENCGET           / GET ENCODER INTO 117 AND ACC.
   5615      1166                TAD 166          / DELTA B (>0)
   5616      3156                DCA 156          / SAVE TENTATIVE E. D.
   5617      1156                TAD 156
   5620      7430                SZL              / OVERFLOW 7777 ?
   5621      5225                JMP TFIX         / YES
   5622      1274                TAD ENCTN        / NO.
   5623      7420                SNL              / OVERFLOW TOP LIMIT?
   5624      5265                JMP XEND         / NO
   5625      7200       TFIX,    CLA              / YES
   5626      1272                TAD ENCTOP
   5627      3156                DCA 156          / ENCODER DESTINATION
   5630      1117                TAD 117          / ENCODER NOW
   5631      7041                CIA
   5632      1272                TAD ENCTOP
   5633      3166                DCA 166          / DELTA B ACHIEVABLE
   5634      5265                JMP XEND
   5635      1271       DBNEG,   TAD DELBM        / HERE IF DELTA B <= 0
                                                 /  IF DELTA B > -20, DELTA B = -20
   5636      7420                SNL              / > -20 ?
   5637      5243                JMP EDY          / NO
   5640      7200                CLA              / YES
   5641      1270                TAD DELBMN
   5642      3166                DCA 166          / NEW DELTA B
   5643      7300       EDY,     CLA CLL
   5644      1117                TAD 117          / ENCODER NOW
   5645      1166                TAD 166          / DELTA B (<0)
   5646      3156                DCA 156
   5647      1156                TAD 156          / SAVE TENTATIVE E.D.
   5650      7420                SNL              / UNDERFLOW 0000 ?
   5651      5256                JMP BFIX         / YES
   5652      7100                CLL              / NO
   5653      1275                TAD ENCBN
   5654      7430                SZL              / UNDER BOTTOM LIMIT ?
   5655      5265                JMP XEND         / NO
   5656      7200       BFIX,    CLA              / YES
   5657      1273                TAD ENCBOT
   5660      3156                DCA 156          / E.D.
   5661      1117                TAD 117          / ENCODER NOW
   5662      7041                CIA
   5663      1273                TAD ENCBOT
   5664      3166                DCA 166          / DELTA B ACHIEVABLE
```

```
EDGET
   68   5665  7200    XEND,    CLA
   69   5666  1156             TAD 156          / E.D.
   70   5667  5543             RETURN
   71   5670  7754    DELBMN,  -24              / 20 CC, MINIMUM DELTA B
   72   5671  0024    DELBM,   24
   73   5672  7315    ENCTOP,  7315
   74   5673  0450    ENCBOT,  0450
   75   5674  0463    ENCTN,   -7315
   76   5675  7330    ENCEN,   -0450

 END OF PASS 2

   0 ERRORS DETECTED
1SYMBOL TABLE

 BFIX   5656   CALL   4140   DBNEG  5635   DELAY2 7362   DELBM  5671   DELBMN 5670   EDGET  5600   EDX    5613
 EDY    5643   ENCBN  5675   ENCBOT 5673   ENCGET 6140   ENCTN  5674   ENCTOP 5672   RETURN 5543   TFIX   5625
 XEND   5665

******** END OF MEMBER EDGET       91 RECORDS ********

ENCGET

1BEGIN PASS 1

 END OF PASS 1
1BEGIN PASS 2

    1                 /  GET BINARY ENCODER POSITION INTO 117 AND ACC.
    2                 /
    3         5543    RETURN=JMP I 143
    4         6310    RDENC=6310
    5         3500    GRAYBI=3500
    6         4140    CALL=JMS 140
    7         6140    *6140
    8   6140  7300    ENCGET,  CLL CLA
    9   6141  6310             RDENC
   10   6142  4140             CALL
   11   6143  3500             GRAYBI          / GRAY CODE TRANSLATOR
   12   6144  1354             TAD M77         / TEST FOR ENCODER GLITCH---
   13   6145  7450             SNA             / ENCODER = 77 OCTAL ?
   14   6146  5351             JMP E2          / YES, USE OLD ENC. VALUE INSTEAD
   15   6147  1355             TAD K77         / NO, RESTORE.
   16   6150  3117             DCA 117
   17   6151  1117    E2,      TAD 117
   18   6152  7100             CLL
   19   6153  5543             RETURN
   20   6154  7701    M77,     -77
   21   6155  0077    K77,     77

 END OF PASS 2

   0 ERRORS DETECTED
1SYMBOL TABLE

 CALL   4140   ENCGET 6140   E2     6151   GRAYBI 3500   K77    6155   M77    6154   RDENC  6310   RETURN 5543

******** END OF MEMBER ENCGET      34 RECORDS ********

ENDLYR

1BEGIN PASS 1

 END OF PASS 1
1BEGIN PASS 2

    1                 /  ROUTINE TO SENSE END OF SAMPLING ZONE DURING ASCENT.
    2                 /
    3         5543    RETURN=JMP I 143
    4         4140    CALL=JMS 140
    5         4500    TPGET=4500
    6         5114    INITA2=5114
    7         6200    TAVE64=6200
    8         4700    *4700
    9   4700  7200    ENDLYR,  CLA
   10   4701  1077             TAD 77
   11   4702  7500             SMA            / SPECIAL INIT(ASCENT) RUN?
   12   4703  5311             JMP ENDN       / NO
   13   4704  2077             ISZ 77         / YES, GO TO INITA SECOND ENTRY POINT IF DONE
   14   4705  5543             RETURN
   15   4706  4140             CALL
   16   4707  5114             INITA2
   17   4710  5543             RETURN
   18   4711  7340    ENDN,    CLL CLA CMA    / -1
   19   4712  1177             TAD 177        / MODE ID
   20   4713  7440             SZA            / ASCENT ?
   21   4714  5543             RETURN         / NO
   22   4715  4140             CALL           / YES
   23   4716  6200             TAVE64         / PRESSURE INTO 136 AND ACC. (64 POINT AVERAGE)
   24   4717  7041             CIA
   25   4720  1561             TAD I 161      / PRESSURE OF TOP OF LAYER
   26   4721  7420             SNL            / P < P LAYER TOP?
   27   4722  5543    ENDER,   RETURN         / NO
   28   4723  2160    ENDLR2,  ISZ 160        / YES, INCREMENT LAYER PARAMETER
   29   4724  2170             ISZ 170        /      ADDRESSES
   30   4725  2164             ISZ 164
   31   4726  2161             ISZ 161
   32   4727  2171             ISZ 171
   33   4730  5543             RETURN

 END OF PASS 2

   0 ERRORS DETECTED
1SYMBOL TABLE

 CALL   4140   ENDER  4722   ENDLR2 4723   ENDLYR 4700   ENDN   4711   INITA2 5114   RETURN 5543   TAVE64 6200
 TPGET  4500

******** END OF MEMBER ENDLYR      47 RECORDS ********
```

```
ENDMA

1BEGIN PASS 1

 END OF PASS 1
1BEGIN PASS 2

                        /   TEST FOR END OF ASCENT.
                        /
                4140    CALL=JMS 140
                5543    RETURN=JMP I 143
                2510    MOON=2510
                5200    INITD=5200
                4734    INITR2=4734
                0021    T1=21
                        /
                6000    *6000
        6000    7300    ENDMA,   CLL CLA
        6001    1136             TAD 136        / PRESSURE
        6002    7041             CIA
        6003    1562             TAD I 162      / PRESSURE TO TERMINATE ASCENT
        6004    7430             SZL            / P < LIMIT?
        6005    5215             JMP EXA        / YES, BEGIN DESCENT
        6006    5543             RETURN         / NO.  DON'T USE TIME TO END ASCENT.
        6007    7300    ENDMA2,  CLL CLA        / FORMERLY HERE FROM MASTER WHEN IN WAIT MODE.
        6010    1021             TAD T1
        6011    7041             CIA
        6012    1024             TAD 24        / MODE END TIME
        6013    7440             SZA           / T1 = M.E.T. ?
        6014    5543             RETURN        / NO
        6015    7301    EXA,     CLL CLA IAC
        6016    3107             DCA 107         / SET DELTA B DAMPING FLAG TO CRIPPLE BUOYC
        6017    1055             TAD 55          / PURGE FLAG
        6020    7450             SNA             / SET?
        6021    5231             JMP EXB         / NO
        6022    7300             CLA CLL         / YES
        6023    3055             DCA 55          / CLEAR PURGE FLAG
        6024    1240             TAD ENCLIM
        6025    3156             DCA 156         / ENCODER DEST. = UPPER LIMIT
        6026    7325             CLL CLA CML IAC RAL   / 3
        6027    4140             CALL
        6030    2510             MOON            / MOTOR UP
        6031    2106    EXB,     ISZ 106       / ENDMODE COUNTER, TO ALLOW DELAY AFTER UPLIM
        6032    5543             RETURN
        6033    2006             ISZ 6         / HERE AFTER DELAY-- INCREMENT UPLIM COUNTER
        6034    7000             NOP
        6035    4140             CALL          /
        6036    5200             INITD
        6037    5543             RETURN
        6040    7315    ENCLIM,  7315
END OF PASS 2
   0 ERRORS DETECTED
1SYMBOL TABLE

 CALL   4140    ENCLIM 6040    ENDMA  6000    ENDMA2 6007    EXA    6015    EXB    6031    INITD  5200    INITR2 4734
 MOON   2510    RETURN 5543    T1     0021
******** END OF MEMBER ENDMA        57 RECORDS ********

ENDMD

1BEGIN PASS 1

 END OF PASS 1
1BEGIN PASS 2

                        /  TEST FOR END OF DESCENT.
                        /
                4140    CALL=JMS 140
                5543    RETURN=JMP I 143
                5300    INITR=5300
                0021    T1=21
                5050    INITA=5050
                6041    *6041
                        /ENDMD,   CLL CLA        / DON'T USE TIME TO END DESCENT
                        /         TAD T1
                        /         CIA
                        /         TAD 25         / ASCENT START TIME
                        /         SZA            / T1 = A.S.T. ?
                        /         JMP EXD        / NO
                        /         CALL           / YES
                        /         INITA
                        /         RETURN
        6041    7300    EXD,      CLA CLL
        6042    1136              TAD 136        / PRESSURE
        6043    7041              CIA
        6044    1670              TAD I TERMD    / P LIMIT
        6045    7430              SZL            / PRESS. > PRESS. LIMIT ?
        6046    5543              RETURN         / NO
        6047    7301              CLL CLA IAC    / YES, 1
        6050    3107              DCA 107        / SET DELTA B DAMPING FLAG TO CRIPPLE BUOYC
        6051    2106              ISZ 106        /  ENDMODE COUNTER, FOR DELAY.
        6052    5543              RETURN
        6053    2007              ISZ 7          / LOWLIM COUNTER
        6054    7000              NOP
        6055    7300              CLL CLA
        6056    1055              TAD 55         / PURGE FLAG
        6057    7450              SNA            / SET?
        6060    5265              JMP EZ         / NO
        6061    7300              CLL CLA        / YES
        6062    1021              TAD T1
        6063    1271              TAD M45        / 45 MINUTES
        6064    3025              DCA 25         / NEW ASCENT START TIME
        6065    4140    EZ,       CALL           /
        6066    5300              INITR
        6067    5543              RETURN
        6070    3350    TERMD,    3350           / ADDRESS OF PRESSURE FOR TERMINATION
        6071    0102    M45,      102
                                                 /      OF DESCENT.

END OF PASS 2
```

```
   0 ERRORS DETECTED
1SYMBOL TABLE

 CALL   4140    EXD    6041    EZ     6065    INITA  5050    INITR  5300    M45    6071    RETURN 5543    TERMD  6070
 T1     0021

******** END OF MEMBER ENDMD       57 RECORDS ********

ENDMR

1BEGIN PASS 1

 END OF PASS 1
1BEGIN PASS 2

     1                 /  ROUTINE TO TEST FOR END OF REST.
     2          4140   CALL=JMS 140
     3          5543   RETURN=JMP I 143
     4          5050   INITA=5050
     5          0021   T1=21
     6          6100   *6100
     7   6100   7300   ENDMR,   CLL CLA
     8   6101   1021            TAD T1
     9   6102   7041            CIA
    10   6103   1025            TAD 25          / ASCENT START TIME
    11   6104   7440            SZA             / T1 = A.S.T. ?
    12   6105   5543            RETURN          / NO
    13   6106   4140            CALL            / YES
    14   6107   5050            INITA
    15   6110   5543            RETURN

 END OF PASS 2

   0 ERRORS DETECTED
1SYMBOL TABLE

 CALL   4140    ENDMR  6100    INITA  5050    RETURN 5543    T1     0021

******** END OF MEMBER ENDMR       28 RECORDS ********

ENDMR2

1BEGIN PASS 1

 END OF PASS 1
1BEGIN PASS 2

     1                 /  ROUTINE TO TEST FOR END OF REST.
     2          4140   CALL=JMS 140
     3          5543   RETURN=JMP I 143
     4          5200   INITD=5200
     5          0021   T1=21
     6          6120   *6120
     7   6120   7300   ENDMR,   CLL CLA
     8   6121   1021            TAD T1
     9   6122   7041            CIA
    10   6123   1026            TAD 26          / DESCENT START TIME
    11   6124   7440            SZA             / T1 = D.S.T. ?
    12   6125   5543            RETURN          / NO
    13   6126   4140            CALL            / YES
    14   6127   5200            INITD
    15   6130   5543            RETURN

 END OF PASS 2

   0 ERRORS DETECTED
1SYMBOL TABLE

 CALL   4140    ENDMR  6120    INITD  5200    RETURN 5543    T1     0021

******** END OF MEMBER ENDMR2      28 RECORDS ********

GRAYBI

1BEGIN PASS 1

 END OF PASS 1
1BEGIN PASS 2

     1                 /  GRAY CODE TO BINARY CONVERTER.
     2                 /
     3          5543   RETURN=JMP I 143
     4          0060   *60
     5   0060   0000   GRBCNT,  0
     6          3500   *3500
     7   3500   7421   GRAYBI,  MQL           / SAVE INPUT
     8   3501   1316            TAD NEG13     / SET UP LOOP COUNTER
     9   3502   3060            DCA GRBCNT
    10   3503   7501            MQA           / RECOVER INPUT
    11   3504   7040            CMA           / COMPLEMENT, SINCE ENCODER
    12   3505   7004   GRLOOP,  RAL           / ROTATE
    13   3506   2060            ISZ GRBCNT    / DONE?
    14   3507   5311            JMP GRTEST    / NO
    15   3510   5543            RETURN        / YES
    16   3511   7420   GRTEST,  SNL           / L = 0 ?
    17   3512   5305            JMP GRLOOP    / YES,  JUST ROTATE
    18   3513   7004            RAL           / NO, ROTATE AND INVERT
    19   3514   7020            CML
    20   3515   5306            JMP GRLOOP+1      / CONTINUE
    21   3516   7763   NEG13,   -15

 END OF PASS 2

   0 ERRORS DETECTED
1SYMBOL TABLE

 GRAYBI 3500    GRBCNT 0060    GRLOOP 3505    GRTEST 3511    NEG13  3516    RETURN 5543

******** END OF MEMBER GRAYBI      34 RECORDS ********
```

```
INITA
1BEGIN PASS 1

 END OF PASS 1
1BEGIN PASS 2

                        /  ROUTINE TO START ASCENT.
                        /
                 4140   CALL=JMS 140
                 5543   RETURN=JMP I 143
                 6101   WEXR=6101
                 6201   WPWR=6201
                 6301   INPUT=6301
                 3400   ATOD=3400
                 6311   WMOTOR=6311
                 4500   TPGET=4500
                 7360   DELAY=7360
                 6400   WRITE=6400
                 2510   MOON=2510
                 6200   TAVE64=6200
                        /
                 5050   *5050
         5050    7201   INITA,   CLA IAC
         5051    3177            DCA 177        / MODE ID = 1
                        /        TAD ALLON
                        /        WEXR
                        /        WPWR           / POWER ON
                        /        DCA 57         / SAVE POWER CONTROL WORD
         5052    7000            NOP
         5053    7000            NOP
         5054    7000            NOP
         5055    7000            NOP
         5056    7300            CLL CLA
         5057    1333            TAD FLAG77     / -60 DECIMAL
         5060    3077            DCA 77         / SET FLAG AS COUNTER
         5061    7000            NOP
         5062    7000            NOP
         5063    7000            NOP
         5064    1363            TAD M164       / -164 DECIMAL
         5065    7000            NOP
         5066    3106            DCA 106        / ENDMODE COUNTER
         5067    1362            TAD ENDAA      /  ENDMODE(ASCENT) ADDRESS
         5070    3067            DCA 67
         5071    1021            TAD 21         / PRESENT TIME (40.96 SEC. UNITS)
         5072    1173            TAD 173        / FULL CYCLE TIME
         5073    3025            DCA 25         / SAVE TIME OF NEXT ASCENT
         5074    1174            TAD 174        / DESCENT MINIMUM TIME
         5075    7141            CLL CIA
         5076    1025            TAD 25
         5077    3024            DCA 24         / ASCENT END TIME
         5100    1334            TAD SPL
         5101    3171            DCA 171        / ADDRESS OF SAMPLING PERIOD
         5102    1335            TAD ZDL1
         5103    3160            DCA 160        / ADDRESS OF Z DOT UPPER LIMIT
         5104    1336            TAD ZDL2
         5105    3170            DCA 170        / ADDRESS OF Z DOT LOWER LIMIT
         5106    1341            TAD ZDP
         5107    3164            DCA 164        / ADDRESS OF Z DOT OPTIMUM
         5110    1337            TAD PL
         5111    3161            DCA 161        / ADDRESS OF PRESSURE OF TOP OF LAYER
         5112    3033            DCA 33         / ZERO DATAGET STOPWATCH
         5113    5543            RETURN         / DON'T RETURN IN TEST RUN
         5114    7201   INITA2,  CLA IAC        / ENTRY POINT FROM ENDLAYER  (BUT NOT IN FIRST RUNS)
                                                /    HERE AFTER BOTTOM DATA GOTTEN.
         5115    3077            DCA 77         / SET LAUNCH FLAG
         5116    1343            TAD MMADD      / DATA CODE LIST ADDRESS
         5117    4140            CALL
         5120    6400            WRITE          / MAINTANANCE MONITOR DATA ONTO TAPE
         5121    4140            CALL
         5122    6200            TAVE64         / PRESSURE INTO 136 AND ACC. (64 POINT AVERAGE)
         5123    3076            DCA 76         / SAVE LAUNCH PRESSURE
         5124    1340            TAD MOTUP
         5125    4140            CALL
         5126    2510            MOON           / MOTOR UP
         5127    1342            TAD ENCLIM
         5130    3156            DCA 156        / ENCODER DEST. = TOP LIMIT, FOR SAFETY
         5131    5543            RETURN
         5132    7777   ALLON,   7777           / ALL POWER ON.
         5133    7704   FLAG77,  -74
         5134    3230   SPL,     3230           / ADDRESS OF SAMPLING PERIOD
         5135    3260   ZDL1,    3260           / ADD. OF Z DOT UPPER LIMIT
         5136    3310   ZDL2,    3310           / ADD. OF Z DOT LOWER LIMIT
         5137    3200   PL,      3200           / ADD. OF P TOP OF LAYER
         5140    0003   MOTUP,   0003           / MOTOR UP BITS
         5141    3450   ZDP,     3450           / ADD. OF Z DOT OPTIMUM
         5142    7315   ENCLIM,  7315           / ENCODER LIMIT, MAX. BUOYANCY
         5143    5144   MMADD,   MMD
         5144    5004   MMD,     5004           / FORMAT CODE 4
         5145    0022            0022           / V REF
         5146    0600            0600           / +18 B
         5147    0200            0200           / -18 B
         5150    0400            0400           / +12 B
         5151    0700            0700           / +7 B
         5152    0300            0300           / -7 B
         5153    0022            0022           / (DITTO---)
         5154    0600            0600
         5155    0200            0200
         5156    0400            0400
         5157    0700            0700
         5160    0300            0300
         5161    7777            7777          / TERMINATOR
         5162    6000   ENDAA,   6000          / ENDMODE(ASCENT) ADDRESS
         5163    7552   M164,    -226          / -164 DECIMAL

 END OF PASS 2

   0 ERRORS DETECTED
```

```
1SYMBOL TABLE

 ALLON  5132    ATOD   3400    CALL   4140    DELAY  7360    ENCLIM 5142    ENDAA  5162    FLAG77 5133    INITA  5050
 INITA2 5114    INPUT  6301    MMADD  5143    MND    5144    MOON   2510    MOTUP  5140    M164   5163    PL     5137
 RETURN 5543    SPL    5134    TAVE64 6200    TPGET  4500    WEXR   6101    WMOTOR 6311    WPWR   6201    WRITE  6400
 ZDL1   5135    ZDL2   5136    ZDP    5141

******** END OF MEMBER INITA      113 RECORDS ********


INITD

1BEGIN PASS 1

 END OF PASS 1
1BEGIN PASS 2

     1                  /  START DESCENT MODE.
     2                  /
     3          4140    CALL=JMS 140
     4          3700    VMAGET=3700
     5          6101    WEXR=6101
     6          6311    WMOTOR=6311
     7          6400    WRITE=6400
     8          7360    DELAY=7360
     9          5543    RETURN=JMP I 143
    10          4500    TPGET=4500
    11          6201    WPWR=6201
    12          2510    MOON=2510
    13          6200    TAVE64=6200
    14                  /
    15          5200    *5200
    16   5200   7305    INITD,   CLA CLL IAC RAL
    17   5201   3177             DCA 177          / MODE ID = 2
    18   5202   1257             TAD M164         / -164 DECIMAL
    19   5203   7000             NOP
    20   5204   3106             DCA 106          / ENDMODE COUNTER
    21   5205   1260             TAD M30
    22   5206   3031             DCA 31           / FORMAT 3 FRAME COUNTER
    23   5207   1247             TAD ENDDA
    24   5210   3067             DCA 67             / ENDMODE(DESCENT) ADDRESS
    25   5211   7301             CLL CLA IAC
    26   5212   3077             DCA 77             / SET LAUNCH FLAG
    27   5213   7340             CLL CLA CMA        / -1
    28   5214   3040             DCA 40             / FORMAT 5 5-SECOND COUNTER
    29   5215   1250             TAD ZDLD1          / LOAD ADDRESSES OF Z DOT LIMITS--
    30   5216   3160             DCA 160            /   MAX.
    31   5217   1251             TAD ZDLD2
    32   5220   3170             DCA 170            /   MIN.
    33   5221   1252             TAD ZDDP
    34   5222   3164             DCA 164            / Z DOT OPTIMUM
    35   5223   1253             TAD FKZD1          / COMPUTE NEEDED Z DOT.   FOR PROTOTYPE
    36   5224   3650             DCA I ZDLD1        /      LET THIS BE DEGENERATE.
    37   5225   1254             TAD FKZD2
    38   5226   3651             DCA I ZDLD2
    39   5227   1255             TAD FKZDP          / Z DOT OPTIMUM
    40   5230   3652             DCA I ZDDP
    41   5231   4140             CALL
    42   5232   6200             TAVE64           / GET PRESSURE  (64 POINT AVERAGE)
    43   5233   3076             DCA 76           / SAVE LAUNCH PRESSURE
    44   5234   1256             TAD MOTDN
    45   5235   4140             CALL
    46   5236   2510             MOON             / MOTOR DOWN
    47   5237   1246             TAD ENCLIM
    48   5240   3156             DCA 156          / ENCODER DEST. = BOTTOM LIMIT, FOR SAFETY
    49   5241   1261             TAD PPWR
    50   5242   6101             WEXR
    51   5243   6201             WPWR             / PRESSURE POWER ON
    52   5244   3057             DCA 57           / SAVE POWER WORD
    53   5245   5543             RETURN
    54   5246   0450    ENCLIM,  0450             / ENCODER LIMIT, MIN. BUOYANCY
    55   5247   6041    ENDDA,   6041             / ENDMODE(DESCENT) ADDRESS
    56   5250   0600    ZDLD1,   600              / Z DOT LIMIT ADDRESSES (RAM)
    57   5251   0601    ZDLD2,   601
    58   5252   0602    ZDDP,    602              / Z DOT OPTIMUM ADDRESS
    59   5253   2000    FKZD1,   2000             / Z DOT LIMITS, IN MM/SEC.
    60   5254   0062    FKZD2,   0062             /     FAST DESCENT OK
    61   5255   0144    FKZDP,   0144             / Z DOT DESIRED, 100 MM/SEC
    62   5256   0002    MOTDN,   0002             / MOTOR DOWN BIT
    63   5257   7552    M164,    -226
    64   5260   7742    M30,     -36
    65   5261   5001    PPWR,    5001

 END OF PASS 2

    0 ERRORS DETECTED
1SYMBOL TABLE

 CALL   4140    DELAY  7360    ENCLIM 5246    ENDDA  5247    FKZDP  5255    FKZD1  5253    FKZD2  5254    INITD  5200
 MOON   2510    MOTDN  5256    M164   5257    M30    5260    PPWR   5261    RETURN 5543    TAVE64 6200    TPGET  4500
 VMAGET 3700    WEXR   6101    WMOTOR 6311    WPWR   6201    WRITE  6400    ZDDP   5252    ZDLD1  5250    ZDLD2  5251

******** END OF MEMBER INITD      80 RECORDS ********
```

INITIAL

1BEGIN PASS 1

END OF PASS 1
1BEGIN PASS 2

```
                 /   ROUTINE TO INITIALIZE MICROPROCESSOR.
                 /
          4140   CALL=JMS 140
          6311   WMOTOR=6311
          6201   WPWR=6201
          6101   WEXR=6101
          6115   WCRB1=6115
          6105   WCRA1=6105
          6215   WCRB2=6215
          6205   WCRA2=6205
          6315   WCRB3=6315
          5300   INITR=5300
          6140   ENCGET=6140
          2510   MOON=2510
          6305   WCRA3=6305
          6114   WVR1=6114
          6214   WVR2=6214
          0140   CALLX=140
          0143   RETX=143
          0144   STACK=144
          6106   SXRDAT=6106
          6107   CXRDAT=6107
          6316   SXRPAR=6316
          6317   CXRPAR=6317
          7000   CALLY=7000
          7011   RETY=7011
          6110   RUART=6110
          7040   UCALY=7040
          0100   UCALX=100
          7051   URETY=7051
          0103   URETX=103
          0104   USTACK=104
          6203   SKIPA2=6203
          6211   WDAC=6211
          6216   SMR=6216
          6217   CMR=6217
          3040   ATTN2=3040
          4734   INITR2=4734
          7776   *7776
   7776   7400           INIT
   7777   5776           JMP I .-1
          7400   *7400                 / PAGE 36  (OCTAL)
   7400   7300   INIT,   CLA CLL
   7401   7001           IAC           / DELAY TO ALLOW POWER UP ---
   7402   7440           SZA
   7403   5201           JMP .-2
   7404   1335           TAD K1        / LOAD PIE CONTROL REGISTERS--
   7405   6115           WCRB1
   7406   7300           CLA CLL
   7407   1336           TAD K2
   7410   6105           WCRA1
   7411   7200   IX,     CLA
   7412   1341           TAD K4
   7413   6205           WCRA2
   7414   7200           CLA
   7415   1342           TAD K5
   7416   6315           WCRB3
   7417   7200           CLA
   7420   1343           TAD K6
   7421   6305           WCRA3
   7422   7200           CLA
   7423   1344           TAD K7        / LOAD RUPT VECTOR ADDRESSES
   7424   6114           WVR1
   7425   7200           CLA
   7426   1345           TAD K8
   7427   6214           WVR2
   7430   7300           CLL CLA
   7431   1346           TAD C1        / UART BUFFER WRITE POINTER
   7432   3146           DCA 146
   7433   3041           DCA 41        / PAPER TAPE FLAG OFF
   7434   3043           DCA 43        / MEMORY DUMP FLAG OFF
   7435   3044           DCA 44        / LEADER-TRAILER FLAG = 0
   7436   3045           DCA 45        / PAPER TAPE BYTE FLAG = 0
   7437   3046           DCA 46        / TIMER MONITOR FLAG = 0
   7440   3150           DCA 0150      / CLEAR UART ARGUMENT REGISTERS--
   7441   3151           DCA 0151
   7442   7001           IAC
   7443   3042           DCA 42        / TBRE FLAG = 1 (I.E. TBRE OFF)
   7444   7100           CLL
   7445   6101           WEXR
   7446   6311           WMOTOR        / MOTOR OFF, DETENT OFF
   7447   3167           DCA 167       / MOTOR FLAG = 0
   7450   7200           CLA
   7451   6101           WEXR
   7452   6201           WPWR          / ALL POWER CONTROLS OFF
   7453   3057           DCA 57        / POWER WORD
   7454   5256           JMP PAST      / TAPE RECORDER INITIALIZATION--
   7455   0754   K,      0754          / 37 DECIMAL CHARACTERS PER FRAME
   7456   7200   PAST,   CLA
   7457   1255           TAD K
   7460   6106           SXRDAT
   7461   6101   LOOP,   WEXR
   7462   7110           CLL RAR
   7463   7450           SNA
   7464   5270           JMP ENDINT
   7465   6316           SXRPAR
   7466   6317           CXRPAR
   7467   5261           JMP LOOP
   7470   6107   ENDINT, CXRDAT
   7471   1347   INITS,  TAD JUMPI        / SUBROUTINE OVERHEAD INITIALIZATION--
```

INITIAL

```
7472  3141            DCA CALLX+1
7473  1350            TAD KCALLY
7474  3142            DCA CALLX+2
7475  1351            TAD KRETY
7476  3143            DCA RETX
7477  1352            TAD BASE
7500  3144            DCA STACK
7501  1353   INITUS,  TAD UJUMPI       / RUPT SUBROUTINE OVERHEAD INITIALIZE--
7502  3101            DCA UCALX+1
7503  1354            TAD UKCALY
7504  3102            DCA UCALX+2
7505  1355            TAD UKRETY
7506  3103            DCA URETX
7507  1356            TAD UBASE
7510  3104            DCA USTACK
7511  1357            TAD KRUPTA
7512  3032            DCA 32        / RUPT RETURN ADDRESS
7513  1360            TAD K5402     / JMP I 2
7514  3001            DCA 1
7515  1361            TAD K2150     / RECRPT ADDRESS
7516  3002            DCA 2
7517  1362            TAD K620      / RECORDER BUFFER ADDRESS
7520  3010            DCA 10
7521  3177            DCA 177       / MODE ID = 0 , IDLE
7522  1363            TAD K66
7523  3066            DCA 66        / "JMP I 67"
7524  3077            DCA 77        / CLEAR "LAUNCH" FLAG
7525  1364            TAD KZDTI
7526  3155            DCA 155       / Z DOT TIME INTERVAL
7527  7000            NOP
7530  7000            NOP
7531  7000            NOP
7532  7000            NOP
7533  5734            JMP I .+1     / GO TO NEXT PAGE
7534  7600            7600
7535  0300   K1,      0300          / CRB1
7536  0057   K2,      0057          / CRA1, TIME RUPT ENABLED
7537  1160   K3,      1160          / CRB2, ATTN2 LEV SENS +; ATTN1, PSTOP EDGE SENS +
7540  1120   K3B,     1120          /   ATTN2 LEVEL SENSITIVE -, "        "
7541  0245   K4,      0245          / CRA2,  ATTN1 ENABLED, PSTOP ENABLED.
7542  7560   K5,      7560          / CRB3
7543  4240   K6,      4240          / CRA3, WITH ENCODER ON
7544  3360   K7,      3360          / VR1
7545  3364   K8,      3364          / VR2
7546  0200   C1,      0200
7547  5542   JUMPI,   JMP I CALLX+2    / SUBROUTINE INIT CONSTANTS
7550  7000   KCALLY,  CALLY
7551  7011   KRETY,   RETY
7552  0720   BASE,    0720          / START ADDRESS OF STACK IN RAM
7553  5502   UJUMPI,  JMP I UCALX+2  / RUPT SUBROUTINE CONSTANTS--
7554  7040   UKCALY,  UCALY
7555  7051   UKRETY,  URETY
7556  1000   UBASE,   1000          / START OF STACK IN RAM
7557  2156   KRUPTA,  2156          / RUPT RETURN ADDRESS
7560  5402   K5402,   5402
7561  2150   K2150,   2150
7562  0620   K620,    620
7563  5467   K66,     JMP I 67      / FOR PAGE 0
7564  5670   KZDTI,   5670          / Z DOT TIME INTERVAL, 30 SEC. IN .01 SEC.
                                    /       UNITS.
               /
               /
       7600    *7600
7600  1300            TAD PTLTA
7601  3162            DCA 162       / ADD. OF PRESSURE OF TOP LAYER TOP
7602  1301            TAD NRT
7603  3163            DCA 163       / NOMINAL REST TIME (40.96 SEC. UNITS)
7604  1302            TAD FCT
7605  3173            DCA 173       / FULL CYCLE TIME   (   "    )
7606  1303            TAD DMT
7607  3174            DCA 174       / DESCENT MIN. TIME (    "   )
7610  1304            TAD SYS1      / SYSOVR ADDRESSES FOR BRANCH (DUMMY)
7611  3071            DCA 71
7612  1305            TAD SYS2
7613  3072            DCA 72
7614  1306            TAD TWAIT
7615  3176            DCA 176       / WAIT TIME
7616  1307            TAD VMAG
7617  3126            DCA 126       / GUESS AT CURRENT MAGNITUDE
7620  1307            TAD VMAG
7621  3127            DCA 127
7622  1310            TAD SPADD
7623  3171            DCA 171         / ADD. OF SAMPLING PERIOD
7624  1311            TAD PL
7625  3161            DCA 161         / ADD. OF PRESSURE OF BOTTOM LAYER TOP
7626  1312            TAD SAFENC
7627  3117            DCA 117         / SAFE PAST ENCODER VALUE
7630  1313            TAD KDELB       / FIXED DELTA B AFTER LIFTOFF, IN CC.
7631  3037            DCA 37
7632  1314            TAD LFTBIT      / DELTA PRESSURE TO DEFINE LIFTOFF, NEGATIVE.
7633  3047            DCA 47
7634  6101            WEXR
7635  6211            WDAC          / CLEAR DAC
7636  6216            SMR
7637  6217            CMR           / RESET UART
7640  1315            TAD K3X
7641  6215            WCRB2
7642  6203            SKIPA2        / TEST IF ATTN2 HIGH
7643  5275            JMP XYZ       / NO, MAGNET IS ON
7644  7200            CLA           / YES, MAGNET IS OFF, RESPECIFY POLARITY
7645  1316            TAD K3BX
7646  6215            WCRB2
7647  2065            ISZ 65        / INCREMENT COUNTER OF RESETS
7650  7000            NOP
7651  7000            NOP
7652  7000            NOP
7653  6001            ION           / INTERRUPTS ENABLED
7654  4140            CALL
```

```
INITIAL

  209   7655  3040            ATTN2          / RESTART MISSION
  210   7656  3055            DCA 55         / CLEAR PURGE FLAG
  211   7657  4140            CALL
  212   7660  6140            ENCGET         / READ ENCODER
  213   7661  1320            TAD NENCL      / NEGATIVE LOWER ENCODER LIMIT - 2
  214   7662  7420            SNL            / ENCODER < LIMIT + 2 ?
  215   7663  5272            JMP CIN        / YES
  216   7664  7300            CLL CLA        / NO
  217   7665  1317            TAD ENCL       / LOWER ENCODER LIMIT
  218   7666  3156            DCA 156        / SAVE ENCODER DESTINATION
  219   7667  7305            CLL CLA IAC RAL    / 2
  220   7670  4140            CALL
  221   7671  2510            MOON           / MOTOR DOWN
  222   7672  4140    CIN,    CALL
  223   7673  5300            INITR          / ENTER REST MODE, WHICH WILL WAIT FOR ASCENT.
  224   7674  5276            JMP .+2
  225   7675  6001    XYZ,    ION            / INTERRUPTS ENABLED.
  226   7676  5677            JMP I .+1
  227   7677  4000            4000           / GO TO BACKGROUND
  228   7700  3201    PTLTA,  3201           / 1 + ADD. OF PRESSURE OF TOP LAYER TOP
  229   7701  0002    NRT,    0002           / MINIMUM REST TIME (40.96 SEC. UNITS) + 1
  230   7702  0130    FCT,    0130           / FULL CYCLE TIME    (  "  )
  231   7703  0002    DMT,    0002           / DESCENT MINIMUM TIME  (  "  )
  232   7704  4246    SYS1,   4246           / BRANCH RETURN ADDRESS IN SYSOVR
  233   7705  4251    SYS2,   4251           /     "
  234   7706  0002    TWAIT,  0002           / WAIT TIME AFTER MAGNET OFF (40.96 SEC. UNITS)
  235   7707  0100    VMAG,   0100           / INITIAL VALUE FOR CURRENT MAGNITUDE
  236                                        /  (.33 CM/SEC PER BIT)
  237   7710  3230    SPADD,  3230           / ADD. OF SAMPLING PERIOD
  238   7711  3200    PL,     3200           / ADD. OF PRESSURE OF BOTTOM LAYER TOP
  239   7712  4000    SAFENC, 4000
  240   7713  0020    KDELB,    20
  241   7714  7764    LFTBIT, -14
  242   7715  1160    K3X,    1160
  243   7716  1120    K3BX,   1120
  244   7717  0450    ENCL,   0450
  245   7720  7326    NENCL,  -0452
  246                 /

 END OF PASS 2

    0 ERRORS DETECTED
1SYMBOL TABLE

 ATTN2  3040    BASE   7552    CALL   4140    CALLX  0140    CALLY  7000    CIN    7672    CMR    6217    CXRDAT 6107
 CXRPAR 6317    C1     7546    DMT    7703    ENCGET 6140    ENCL   7717    ENDINT 7470    FCT    7702    INIT   7400
 INITR  5300    INITR2 4734    INITS  7471    INITUS 7501    IX     7411    JUMPI  7547    K      7455    KCALLY 7550
 KDELB  7713    KRETY  7551    KRUPTA 7557    KZDTI  7564    K1     7535    K2     7536    K2150  7561    K3     7537
 K3B    7540    K3BX   7716    K3X    7715    K4     7541    K5     7542    K5402  7560    K6     7543    K620   7562
 K66    7563    K7     7544    K8     7545    LFTBIT 7714    LOOP   7461    MOON   2510    NENCL  7720    NRT    7701
 PAST   7456    PL     7711    PTLTA  7700    RETX   0143    RETY   7011    RUART  6110    SAFENC 7712    SKIPA2 6203
 SMR    6216    SPADD  7710    STACK  0144    SXRDAT 6106    SXRPAR 6316    SYS1   7704    SYS2   7705    TWAIT  7706
 UBASE  7556    UCALX  0100    UCALY  7040    UJUMPI 7553    UKCALY 7554    UKRETY 7555    URETX  0103    URETY  7051
 USTACK 0104    VMAG   7707    WCRA1  6105    WCRA2  6205    WCRA3  6305    WCRB1  6115    WCRB2  6215    WCRB3  6315
 WDAC   6211    WEXR   6101    WMOTOR 6311    WPWR   6201    WVR1   6114    WVR2   6214    XYZ    7675

******** END OF MEMBER INITIAL    269 RECORDS ********

INITR

1BEGIN PASS 1

 END OF PASS 1
1BEGIN PASS 2

    1                   /   START REST MODE.
    2                   /
    3           5543    RETURN=JMP I 143
    4           6101    WEXR=6101
    5           6201    WPWR=6201
    6                   /
    7           5300    *5300
    8   5300    7325    INITR,  CLA CLL CML IAC RAL  / 3 INTO ACC.
    9   5301    3177            DCA 177              / MODE ID = 3
   10   5302    1327            TAD ENDRA
   11   5303    3067            DCA 67               / ADDRESS OF ENDMODE(REST)
   12   5304    1330            TAD ZDLR1            / Z DOT MAX ADDRESS
   13   5305    3160            DCA 160
   14   5306    1331            TAD ZDLR2            / Z DOT MIN ADDRESS
   15   5307    3170            DCA 170
   16   5310    1332            TAD ZDPR             / Z DOT OPTIMUM ADDRESS
   17   5311    3164            DCA 164
   18   5312    6101            WEXR            / ALL POWER OFF
   19   5313    6201            WPWR
   20   5314    3057            DCA 57          / SAVE NEW POWER WORD
   21   5315    1025            TAD 25              / ASCENT START TIME
   22   5316    7041            CIA
   23   5317    1021            TAD 21              / TIME NOW
   24   5320    7510            SPA                 / IS NOW < ASCENT START TIME ?
   25   5321    5543            RETURN              / YES
   26   5322    7300            CLL CLA             / NO, UPDATE A.S.T.
   27   5323    1025            TAD 25
   28   5324    1173            TAD 173             / FULL CYCLE TIME (1 HOUR)
   29   5325    3025            DCA 25
   30   5326    5543            RETURN
   31   5327    6100    ENDRA,  6100                / ADDRESS OF ENDMODE(REST)
   32   5330    3346    ZDLR1,  3346                / ADD. OF Z DOT MAX.
   33   5331    3347    ZDLR2,  3347                / ADD. OF Z DOT MIN.
   34   5332    3357    ZDPR,   3357                / ADD. OF Z DOT OPTIMUM

 END OF PASS 2

    0 ERRORS DETECTED
1SYMBOL TABLE

 ENDRA  5327    INITR  5300    RETURN 5543    WEXR   6101    WPWR   6201    ZDLR1  5330    ZDLR2  5331    ZDPR   5332

******** END OF MEMBER INITR       47 RECORDS ********
```

```
INITR2

1BEGIN PASS 1


 END OF PASS 1
1BEGIN PASS 2

     1                  /   START REST MODE.
     2                  /
     3          5543    RETURN=JMP I 143
     4          2510    MOON=2510
     5          6101    WEXR=6101
     6          6201    WPWR=6201
     7          4140    CALL=JMS 140
     8                  /
     9          4734    *4734
    10   4734  7327     INITR,   CLA CLL CML IAC RTL  / 6 INTO ACC.
    11   4735  3177              DCA 177              / MODE ID = 6
    12   4736  6101              WEXR
    13   4737  6201              WPWR                 / ALL POWER OFF
    14   4740  3057              DCA 57               / POWER WORD
    15   4741  1372              TAD ENDRA
    16   4742  3067              DCA 67               / ADDRESS OF ENDMODE(REST)
    17   4743  1373              TAD ZDLR1            / Z DOT MAX ADDRESS
    18   4744  3160              DCA 160
    19   4745  1374              TAD ZDLR2           / Z DOT MIN ADDRESS
    20   4746  3170              DCA 170
    21   4747  1375              TAD ZDPR             / Z DOT OPTIMUM ADDRESS
    22   4750  3164              DCA 164
    23   4751  1021              TAD 21              / TIME NOW
    24   4752  1163              TAD 163             / REST TIME
    25   4753  3026              DCA 26        / DESCENT START TIME.
    26   4754  1055              TAD 55        / PURGE FLAG
    27   4755  7450              SNA           / SET ?
    28   4756  5543              RETURN        / NO
    29   4757  7300              CLA CLL       / YES
    30   4760  3055              DCA 55        / CLEAR PURGE FLAG
    31   4761  7005              IAC RAL
    32   4762  1026              TAD 26        / ADD 82 SEC. TO DESCENT START TIME---
    33   4763  3026              DCA 26
    34   4764  1376              TAD ENCLIM
    35   4765  3156              DCA 156       / ENCODER DESTINATION = UPPER LIMIT
    36   4766  1377              TAD MOTUP
    37   4767  4140              CALL
    38   4770  2510              MOON
    39   4771  5543              RETURN
    40   4772  6120     ENDRA,   6120                 / ADDRESS OF ENDMODE(REST)
    41   4773  3344     ZDLR1,   3344                  / ADD. OF Z DOT MAX.
    42   4774  3345     ZDLR2,   3345                  / ADD. OF Z DOT MIN.
    43   4775  3356     ZDPR,    3356                  / ADD. OF Z DOT OPTIMUM
    44   4776  7315     ENCLIM,  7315
    45   4777  0003     MOTUP,   0003

 END OF PASS 2

    0 ERRORS DETECTED
1SYMBOL TABLE
 CALL   4140    ENCLIM 4776    ENDRA  4772    INITR  4734    MOON   2510    MOTUP  4777    RETURN 5543    WEXR   6101
 WPWR   6201    ZDLR1  4773    ZDLR2  4774    ZDPR   4775

******** END OF MEMBER INITR2      59 RECORDS ********

LAUNCH


1BEGIN PASS 1


 END OF PASS 1
1BEGIN PASS 2

     1                  /  COMPUTES ASCENT OR DESCENT LAUNCH BY NOTICING LIFT-OFF,THEN
     2                  /     COMPUTING ENCODER DESTINATION AND CLEARING LAUNCH FLAG.
     3                  /  DELTA BUOYANCY IS LEFT IN 166
     4                  /  ENCODER DESTINATION IS LEFT IN 156
     5                  /
     6          5543    RETURN=JMP I 143
     7          4140    CALL=JMS 140
     8          4500    TPGET=4500
     9          3600    MULT=3600
    10          5600    EDGET=5600
    11          6400    WRITE=6400
    12          6200    TAVE64=6200
    13                  /
    14          5400    *5400
    15   5400  7300     LAUNCH,  CLL CLA       / HERE FROM MASTER IF MOTOR ON AND LAUNCH FLAG SET
    16   5401  4140              CALL
    17   5402  6200              TAVE64        / PRESSURE INTO 136 AND ACC. (64 POINT AVERAGE)
    18   5403  7344              CLL CLA CMA RAL    / -2
    19   5404  1167              TAD 167       / MOTOR FLAG
    20   5405  7440              SZA           / ?
    21   5406  5221              JMP LMUP      / UP
    22   5407  7300              CLL CLA       / DOWN, GET PRESSURE
    23   5410  1136              TAD 136
    24   5411  7041              CIA
    25   5412  1076              TAD 76        / LAUNCH PRESSURE
    26   5413  7420              SNL           / P < P LAUNCH?
    27   5414  5227              JMP LMX       / NO, P LAUNCH OK
    28   5415  7200     LMQ,     CLA           / YES, UPDATE P LAUNCH
    29   5416  1136              TAD 136
    30   5417  3076              DCA 76
    31   5420  5543              RETURN        / SKIP REMAINDER OF LAUNCH ROUTINE
    32   5421  7300     LMUP,    CLL CLA
    33   5422  1136              TAD 136       / HERE IF MOTOR UP, GET PRESSURE
    34   5423  7041              CIA
```

LAUNCH

```
 35  5424  1076            TAD 76        / LAUNCH PRESSURE
 36  5425  7420            SNL           / P > P LAUNCH ?
 37  5426  5215            JMP LMQ       / YES
 38  5427  7510    LMX,    SPA
 39  5430  7041            CIA           / ABSOLUTE VALUE
 40  5431  1047            TAD 47        / NUM. OF PRESSURE BITS FOR LIFTOFF, NEGATIVE
 41  5432  7510            SPA           / DELTA PRESSURE < LIFTOFF CRITERION ?
 42  5433  5543            RETURN        / YES, DO NOTHING
 43  5434  7300            CLA CLL       / NO, COMPUTE ENCODER DESTINATION
 44  5435  1127            TAD 127       / CURRENT MAGNITUDE
 45  5436  7041            CIA
 46  5437  1334            TAD VM10
 47  5440  7510            SPA           / < 10 CM/SEC ?
 48  5441  5244            JMP GT10      / NO, JUMP AHEAD
 49  5442  7200            CLA           / YES, DELTA B = 0
 50                  / NOTE:  EDGET WILL INCREASE DELTA B TO THE MINIMUM MOTOR RUN, 20 CC.
 51  5443  5304            JMP LEND
 52  5444  1335    GT10,   TAD VM40
 53  5445  7510            SPA           / < 50 CM/SEC ?
 54  5446  5266            JMP GT50      / NO, JUMP AHEAD
 55  5447  7200            CLA
 56  5450  1127            TAD 127       / CURRENT MAGNITUDE
 57  5451  7421            MQL
 58  5452  1336            TAD FACT1
 59  5453  4140            CALL
 60  5454  3600            MULT
 61  5455  7300            CLA CLL
 62  5456  1133            TAD 133       / LOW ORDER PRODUCT, UNITS OF .13 CC
 63  5457  7010            RAR           / DIVIDE BY 8, MAKING UNITS CC--
 64  5460  7100            CLL
 65  5461  7010            RAR
 66  5462  7100            CLL
 67  5463  7010            RAR
 68  5464  1332            TAD K8        / CONSTANT.  NOW, ABVAL(DELTA B) IS IN ACC.
 69  5465  5304            JMP LEND
 70  5466  7300    GT50,   CLA CLL       / HERE IF CURRENT MAGNITUDE > 50 CM/SEC
 71  5467  1127            TAD 127       / CURRENT MAG.
 72  5470  7010            RAR           / DIVIDE BY 8
 73  5471  7100            CLL
 74  5472  7010            RAR
 75  5473  7100            CLL
 76  5474  7010            RAR
 77  5475  7421            MQL
 78  5476  1337            TAD FACT2     / MAGIC FACTOR
 79  5477  4140            CALL
 80  5500  3600            MULT
 81  5501  7300            CLA CLL
 82  5502  1133            TAD 133       / LOW ORDER PRODUCT, UNITS OF .12 CC
 83  5503  1333            TAD K9        / NOW, ABVAL(DELTA B) IS IN ACC.
 84  5504  7001    LEND,   IAC           / GUARANTEE DELTA B NOT = 0
 85  5505  3157            DCA 157       / SAVE AS ABVAL(DELTA B) BY COMPLICATED RULE.
 86  5506  1037            TAD 37        / FIXED DELTA B FOR FIRST TESTS, IN CC.
 87  5507  3166            DCA 166       / SAVE
 88  5510  7344            CLA CLL CMA RAL   / -2
 89  5511  1177            TAD 177       / MODE ID
 90  5512  7440            SZA           / ASCENT?
 91  5513  5317            JMP LX        / YES
 92  5514  1166            TAD 166       / NO, NEGATE DELTA B.
 93  5515  7041            CIA
 94  5516  3166            DCA 166
 95  5517  1166    LX,     TAD 166
 96  5520  4140            CALL
 97  5521  5600            EDGET         / LOAD ENCODER DESTINATION AND ACHIEVABLE DELTA B
 98  5522  7300            CLA CLL
 99  5523  3077            DCA 77        / LAUNCH FLAG OFF
100  5524  1340            TAD DLADD     / ADDRESS OF DATA CODE LIST
101  5525  4140            CALL
102  5526  6400            WRITE         / DATA INTO RECORDER
103  5527  3175            DCA 175       / MAKE DELTA B ZERO TO GET NDELB OF ON THE RIGHT
104                  / FOOT.  THE FIRST BUOYC WILL UNDERESTIMATE ABVAL(DELTA B).
105  5530  5543            RETURN
106  5531  7776    MINUS2, -2
107  5532  7746    K8,     -32           / -26 (DECIMAL) CC
108  5533  7610    K9,     -170          / -120 (DECIMAL) CC
109  5534  0036    VM10,   0036          / 10 CM/SEC. IF 1 BIT = .33 CM/SEC
110  5535  0170    VM40,   0170          / 40 CM/SEC.    "       .33
111  5536  0023    FACT1,  0023          / 6.2 X 3+ = 19
112  5537  0030    FACT2,  0030          / 8.1 X 3 = 24
113  5540  5541    DLADD,  DLIST
114  5541  5001    DLIST,  5001          / FORMAT CODE 1
115  5542  6000            6000          / STATUS
116  5543  2020            2020          / TIME --
117  5544  2021            2021
118  5545  2022            2022
119  5546  2136            2136          / PRESSURE FROM PAGE 0
120  5547  1000            1000          / ENCODER
121  5550  2175            2175          / Z DOT
122  5551  2127            2127          / CURRENT MAGNITUDE AVERAGE
123  5552  2157            2157          / DELTA B BY COMPLICATED RULE
124  5553  2007            2007          / LOWLIM COUNTER
125  5554  2156            2156          / ENCODER DESTINATION.
126  5555  0500            0500          / + MOTOR
127  5556  7777            7777          / TERMINATOR

 END OF PASS 2

    0 ERRORS DETECTED
1SYMBOL TABLE

 CALL   4140   DLADD  5540   DLIST  5541   EDGET  5600   FACT1  5536   FACT2  5537   GT10   5444   GT50   5466
 K8     5532   K9     5533   LAUNCH 5400   LEND   5504   LMQ    5415   LMUP   5421   LMX    5427   LX     5517
 MINUS2 5531   MULT   3600   RETURN 5543   TAVE64 6200   TPGET  4500   VM10   5534   VM40   5535   WRITE  6400

******** END OF MEMBER LAUNCH     142 RECORDS ********
```

MASTER

```
1BEGIN PASS 1


 END OF PASS 1
1BEGIN PASS 2

                        /  OUTER LOOP OF BACKGROUND.
                        /
                4140    CALL=JMS 140
                5543    RETURN=JMP I 143
                4200    SYSOVR=4200
                6000    ENDMA=6000
                3700    VMAGET=3700
                6400    WRITE=6400
                5000    DATGET=5000
                4700    ENDLYR=4700
                6201    WPWR=6201
                6101    WEXR=6101
                6311    WMOTOR=6311
                0066    ENDMDA=66
                4300    ZDGET=4300
                6140    ENCGET=6140
                5400    LAUNCH=5400
                4400    BUOYC=4400
                7360    DELAY=7360
                6007    ENDMA2=6007
                4500    TPGET=4500
                5710    MOFF=5710
                2510    MOON=2510
                        /
                4000    *4000
        4000    4140    MASTER,  CALL
        4001    4200             SYSOVR
        4002    1155             TAD 155        / Z DOT TIME INTERVAL (.01 SEC UNITS)
        4003    7041             CIA
        4004    1023             TAD 23         / Z DOT STOPWATCH
        4005    7420             SNL            / WATCH > TIME INTERVAL ?
        4006    5211             JMP M1         / NO
        4007    4140             CALL
        4010    7061             MAST1          / YES,  GO TO SUBSECTION NO. 1
        4011    7200    M1,      CLA
        4012    1177             TAD 177        / MODE ID
        4013    1256             TAD MINUS4
        4014    7440             SZA            / WAIT MODE?
        4015    5236             JMP M2         / NO
        4016    3033             DCA 33         / YES, ZERO DATAGET STOPWATCH
        4017    1024             TAD 24         /ENDTIME
        4020    7041             CIA
        4021    1021             TAD 21         / TIME NOW
        4022    7440             SZA            / EQUAL ?
        4023    5236             JMP M2         / NO
        4024    7305             CLL CLA IAC RAL        / YES,  2 INTO ACC.
        4025    3177             DCA 177        / MODE = DESCENT
        4026    1260             TAD TPWR
        4027    6101             WEXR
        4030    6201             WPWR          / PRESSURE POWER ON
        4031    3057             DCA 57        / SAVE POWER WORD
        4032    4140             CALL
        4033    2510             MOON           / RATTLE SOLENOIDS, WRITE DATA
        4034    4140             CALL           /       FORMAT 1.
        4035    5710             MOFF
        4036    7300    M2,      CLA CLL
        4037    1167             TAD 167        / MOTOR FLAG
        4040    0257             AND BIT10
        4041    7450             SNA            / MOTOR ON ?
        4042    5245             JMP M3         / NO
        4043    4140             CALL           / YES
        4044    3640             MAST2          / GO TO SUBSECTION NO. 2
        4045    7300    M3,      CLA CLL
        4046    1571             TAD I 171      / SAMPLING PERIOD
        4047    7041             CIA
        4050    1033             TAD 33         / DATAGET STOPWATCH (.01 SEC. UNITS)
        4051    7420             SNL            / TIME TO GET DATA?
        4052    5200             JMP MASTER     / NO
        4053    4140             CALL           / YES
        4054    4064             MAST3          / GO TO SUBSECTION NO. 3
        4055    5200             JMP MASTER     / CLOSE MAIN BACKGROUND LOOP
        4056    7774    MINUS4,  -4
        4057    0002    BIT10,   0002
        4060    5001    TPWR,    5001
                        /
                        /
                        /
                7061    *7061
        7061    4140    MAST1,   CALL           / HERE EACH 30 SEC. (BY Z DOT STOPWATCH).
        7062    4300             ZDGET          / Z DOT INTO 175
        7063    1167             TAD 167        / MOTOR FLAG
        7064    7440             SZA            / MOTOR ON ?
        7065    5543             RETURN         / YES
        7066    1327             TAD MIN4       / NO,  -4
        7067    1177             TAD 177        / MODE ID
        7070    7440             SZA            / WAIT MODE ?
        7071    5276             JMP NXT        / NO
        7072    1331             TAD DLA        / YES, GET STANDBY DATA LIST ADDRESS
        7073    4140             CALL           /
        7074    6400             WRITE          / DATA ONTO TAPE
        7075    5543             RETURN
        7076    7344    NXT,     CLA CLL CMA RAL      / -2
        7077    1177             TAD 177              / MODE ID
        7100    7440             SZA            / DESCENT?
        7101    5324             JMP NWT        / NO.
        7102    1031             TAD 31         / FORMAT 3 FRAME COUNTER.
        7103    7440             SZA            / SET?
```

```
MASTER
 98   7104  5311            JMP NZT        / YES
 99   7105  7300            CLL CLA        / NO
100   7106  1330            TAD F1ADD      / ADDRESS OF FORMAT 1 DATA CODE LIST
101   7107  4140            CALL
102   7110  6400            WRITE           / DATA ONTO TAPE.
103   7111  1055    NZT,    TAD 55          / PURGE FLAG
104   7112  7450            SNA             / SET?
105   7113  5324            JMP NWT         / NO
106   7114  4140            CALL            / YES
107   7115  5000            DATGET          / FORMAT 3 DATA ONTO TAPE
108   7116  7300            CLL CLA
109   7117  1337            TAD PPWR
110   7120  6101            WEXR
111   7121  6201            WPWR            / ALL POWER OFF, EXCEPT PRESSURE
112   7122  3057            DCA 57          / ZERO INTO PWER WORD
113   7123  5543            RETURN
114   7124  4140    NWT,    CALL           / HERE IF MOTOR OFF AND NOT WAIT MODE
115   7125  4400            BUOYC          / START MIDCOURSE BUOYANCY CHANGE IF REQUIRED
116   7126  5543            RETURN
117   7127  7774    MIN4,   -4
118   7130  5541    F1ADD,  5541
119   7131  7132    DLA,    DL
120   7132  5000    DL,     5000           / FORMAT CODE 0
121   7133  6000            6000           / STATUS
122   7134  3000            3000           / COMPOSITE TIME
123   7135  0003            0003           / PRESSURE
124   7136  7777            7777           / TERMINATOR
125   7137  5001    PPWR,   5001
126                 /
127                 /
128                 /
129         3640    *3640
130   3640  7300    MAST2,  CLL CLA        / HERE IF MOTOR ON
131   3641  1077            TAD 77         / LAUNCH FLAG
132   3642  7450            SNA            / SET?
133   3643  5246            JMP SKL        / NO
134   3644  4140            CALL           / YES
135   3645  5400            LAUNCH
136   3646  7300    SKL,    CLL CLA
137   3647  1167            TAD 167        / MOTOR FLAG
138   3650  7010            RAR            / NOW, LINK = 0 IF DOWN, 1 IF UP
139   3651  7430            SZL
140   3652  5264            JMP MUP        / UP
141   3653  4140            CALL           / DOWN
142   3654  6140            ENCGET         / READ ENCODER
143   3655  7041            CIA
144   3656  1156            TAD 156        / ENCODER DESTINATION
145   3657  7420            SNL            / ENCODER <= DESTINATION ?
146                                        / N.B. MAX. ENCODER = MAX. BUOYANCY
147   3660  5543            RETURN         / NO
148   3661  4140            CALL           / YES, CALL MOTOR OFF INSTRUCTIONS
149   3662  5710            MOFF
150   3663  5543            RETURN
151   3664  4140    MUP,    CALL           / HERE IF MOTOR UP
152   3665  6140            ENCGET         / READ ENCODER
153   3666  7041            CIA
154   3667  1156            TAD 156         / ENCODER DESTINATION
155   3670  7430            SZL             / ENC. >= DEST. ?
156   3671  5543            RETURN          / NO
157   3672  4140            CALL            / MOTOR OFF AND LATCHED.
158   3673  5710            MOFF
159   3674  5543            RETURN
160                 /
161                 /
162                 /
163         4064    *4064
164   4064  7300    MAST3,  CLA CLL         / HERE EACH 1 SEC., EXCEPT DURING WAIT.
165   4065  7000            NOP
167   4067  7000            NOP
168   4070  3033            DCA 33          / ZERO DATAGET STOPWATCH
169   4071  1167            TAD 167         / MOTOR FLAG
170   4072  7450            SNA             / MOTOR ON ?
171   4073  5301            JMP MX          / NO
172   4074  7200            CLA             / YES
173   4075  1353            TAD DBLA        / ADDRESS OF DELTA B MONITOR DATA CODE LIST
174   4076  4140            CALL
175   4077  6400            WRITE           / DATA ONTO TAPE
176   4100  5543            RETURN
177   4101  7340    MX,     CLL CLA CMA      / -1
178   4102  1177            TAD 177          / MODE ID
179   4103  7440            SZA              / ASCENT?
180   4104  5313            JMP NAS          / NO
181   4105  4140            CALL            / YES
182   4106  3700            VMAGET          / UPDATE CURRENT MAGNITUDE AVERAGE
183   4107  4140            CALL
184   4110  5000            DATGET          / WRITE SEA DATA ON TAPE
185   4111  4140            CALL
186   4112  4700            ENDLYR          / TEST FOR END OF SAMPLING LAYER
187   4113  4140    NAS,    CALL
188   4114  4500            TPGET           / READ PRESSURE, SINCE SOME ENDMODES NEED IT.
189   4115  7344            CLL CLA CMA RAL    / -2
190   4116  1177            TAD 177
191   4117  7440            SZA            / DESCENT?
192   4120  5350            JMP NAD        / NO
193   4121  1031            TAD 31         / FORMAT 3 FRAME COUNTER
194   4122  7450            SNA            / SET?
195   4123  5336            JMP MDP        / NO
196   4124  4140            CALL           / YES
197   4125  5000            DATGET         / FORMAT 3 DATA ONTO TAPE
198   4126  2031            ISZ 31         / INCREMENT FMT. 3 COUNTER
199   4127  5350            JMP NAD        / NON-ZERO
200   4130  7300            CLL CLA        / HERE IF COUNTER ZEROED
201   4131  1260            TAD TPWR
202   4132  6101            WEXR
203   4133  6201            WPWR
```

```
MASTER

  204   4134  3057            DCA 57        / POWER OFF, EXCEPT PRESSURE
  205   4135  5350            JMP NAD
  206   4136  1055    MDP,    TAD 55        / PURGE FLAG
  207   4137  7440            SZA           / SET?
  208   4140  5350            JMP NAD       / YES
  209   4141  2040            ISZ 40        / NO, WRITE ONLY EACH 5 SEC. ---
  210   4142  5350            JMP NAD
  211                 /       NOP
  212                 /       NOP
  213   4143  1367            TAD DPTA      / ADDRESS OF FORMAT 5 DATA CODE LIST
  214   4144  4140            CALL
  215   4145  6400            WRITE         / PRESSURE ONTO TAPE
  216   4146  1370            TAD MIN5
  217   4147  3040            DCA 40
  218                 /       NOP
  219                 /       NOP
  220   4150  4140    NAD,    CALL
  221   4151  0066            ENDMDA         / ENDMODE TEST
  222   4152  5543            RETURN
  224   4154  5002    DBL,    5002           / FORMAT CODE 2
  225   4155  3000            3000           / COMPOSITE TIME
  226   4156  0003            3              / PRESSURE
  227   4157  1000            1000           / ENCODER
  228   4160  0017            17             / VMSU
  229   4161  0020            20             / VMSD
  230   4162  0021            21             / IA
  231   4163  7777            7777           / TERMINATOR
  232   4164  5005    DPT,    5005            / FORMAT CODE 5
  233   4165  2136            2136            / PRESSURE FROM PAGE 0
  234   4166  7777            7777            / TERMINATOR
  235   4167  4164    DPTA,   DPT
  236   4170  7773    MIN5,   -5

 END OF PASS 2

    0 ERRORS DETECTED
1SYMBOL TABLE

 BIT10  4057   BUOYC  4400   CALL   4140   DATGET 5000   DBL    4154   DBLA   4153   DELAY  7360   DL     7132
 DLA    7131   DPT    4164   DPTA   4167   ENCGET 6140   ENDLYR 4700   ENDMA  6000   ENDMA2 6007   ENDMDA 0066
 FIADD  7130   LAUNCH 5400   MASTER 4000   MAST1  7061   MAST2  3640   MAST3  4064   MDP    4136   MINUS4 4056
 MIN4   7127   MIN5   4170   MOFF   5710   MOON   2510   MUP    3664   MX     4101   M1     4011   M2     4036
 M3     4045   NAD    4150   NAS    4113   NWT    7124   NXT    7076   NZT    7111   PPWR   7137   RETURN 5543
 SKL    3646   SYSOVR 4200   TPGET  4500   TPWR   4060   VMAGET 3700   WEXR   6101   WMOTOR 6311   WPWR   6201
 WRITE  6400   ZDGET  4300

******** END OF MEMBER MASTER      255 RECORDS ********

MOFF

1BEGIN PASS 1

 END OF PASS 1
1BEGIN PASS 2

    1                 /  ROUTINE TO TURN MOTOR OFF AND APPLY LATCH.
    2                 /
    3         4140    CALL=JMS 140
    4         5543    RETURN=JMP I 143
    5         7360    DELAY=7360
    6         6311    WMOTOR=6311
    7         6101    WEXR=6101
    8                 /
    9         5710    *5710
   10   5710  7301    MOFF,   CLL CLA IAC
   11   5711  6101            WEXR
   12   5712  6311            WMOTOR         / MOTOR OFF, BRAKES ON
   13   5713  7346            CLA CLL CMA RTL   / -3
   14   5714  1167            TAD 167        / MOTOR FLAG
   15   5715  7440            SZA            / UP ?
   16   5716  5321            JMP MDOWN      / NO
   17   5717  7000            NOP            / YES
   18   5720  7000            NOP
   19   5721  4140    MDOWN,  CALL
   20   5722  7360            DELAY          / 100 MS
   21   5723  7000            NOP
   22   5724  7000            NOP
   23   5725  4140            CALL
   24   5726  7360            DELAY
   25   5727  7000            NOP
   26   5730  7000            NOP
   27   5731  7307            CLA CLL IAC RTL     / 4
   28   5732  7001            IAC            / 5
   29   5733  6101            WEXR
   30   5734  6311            WMOTOR         / MOTOR STILL OFF, BRAKES STILL ON, LATCH SOL. ON
   31   5735  4140            CALL
   32   5736  7360            DELAY
   33   5737  4140            CALL
   34   5740  7360            DELAY
   35   5741  4140            CALL
   36   5742  7360            DELAY
   37   5743  4140            CALL
   38   5744  7360            DELAY
   39   5745  7200            CLA
   40   5746  6101            WEXR
   41   5747  6311            WMOTOR         / ALL OFF
   42   5750  3167            DCA 167        / ZERO INTO MOTOR FLAG
   43   5751  7001            IAC
   44   5752  3107            DCA 107        / DELTA B DAMPING FLAG = +1
   45   5753  3077            DCA 77         / LAUNCH FLAG = 0
   46   5754  5543            RETURN
 END OF PASS 2

    0 ERRORS DETECTED
1SYMBOL TABLE
 CALL   4140   DELAY  7360   MDOWN  5721   MOFF   5710   RETURN 5543   WEXR   6101   WMOTOR 6311

******** END OF MEMBER MOFF        59 RECORDS ********
```

```
MOON

1BEGIN PASS 1

 END OF PASS 1
1BEGIN PASS 2

                        /  MOTOR ON ROUTINE.
                        /  WORD TO GIVE FINAL MOTOR STATE IS IN ACC. ON ENTRY.
                        /
                 6101   WEXR=6101
                 6311   WMOTOR=6311
                 4140   CALL=JMS 140
                 5543   RETURN=JMP I 143
                 7360   DELAY=7360
                 6400   WRITE=6400
                 5710   MOFF=5710
                        /
                 2510   *2510
        2510     3123   MOON,    DCA 123      / TEMPORARY SAVE OF MOTOR FINAL STATE
        2511     1336            TAD DLADD
        2512     4140            CALL
        2513     6400            WRITE        / WRITE PRE-BURN DATA (FORMAT 1)
        2514     1167            TAD 167      / MOTOR FLAG
        2515     7450            SNA          / ON ?
        2516     5321            JMP ST       / NO
        2517     4140            CALL         / YES
        2520     5710            MOFF         / MOTOR OFF
        2521     1337   ST,      TAD UNLAT
        2522     6101            WEXR
        2523     6311            WMOTOR       / UNLATCH
        2524     4140            CALL
        2525     7360            DELAY        / 100 MS
        2526     1123            TAD 123      / RECALL DESIRED MOTOR STATE
        2527     6101            WEXR
        2530     6311            WMOTOR
        2531     3167            DCA 167      / WRITE MOTOR FLAG
        2532     4140            CALL
        2533     7360            DELAY         / WAIT 100 MS FOR MOTOR TRANSIENT
        2534     7300            CLL CLA
        2535     5543            RETURN
        2536     5541   DLADD,   5541          / FORMAT 1 DATA CODE ADDRESS
        2537     0010   UNLAT,   0010

 END OF PASS 2

    0 ERRORS DETECTED
1SYMBOL TABLE

 CALL   4140    DELAY  7360    DLADD  2536    MOFF   5710    MOON   2510    RETURN 5543    ST     2521    UNLAT  2537
 WEXR   6101    WMOTOR 6311    WRITE  6400

******** END OF MEMBER MOON        50 RECORDS ********

MULT

1BEGIN PASS 1

 END OF PASS 1
1BEGIN PASS 2

                        /   ROM SUBROUTINE TO MULTIPLY TWO 12- BIT WORDS.
                        /      MULTIPLIER IS IN MQ, MULTIPLICAND IN ACC.
                        /      PRODUCT IS LEFT IN 0132 AND 0133.
                        /
                 5543   RETURN=JMP I 0143
                 0130   MULT1=0130
                 0131   MULT2=0131
                 0132   MPROD1=0132
                 0133   MPROD2=0133
                 0121   MNLOOP=0121
                 3600   *3600                    / PAGE 17 (OCTAL) IN ROM
        3600     3130   MULT,    DCA MULT1
        3601     1236            TAD MCOUNT
        3602     3121            DCA MNLOOP      / INITIALIZE LOOP COUNTER
        3603     3132            DCA MPROD1      / INITIALIZE PRODUCT TO 0
        3604     3133            DCA MPROD2
        3605     7501   MSTART,  MQA             / MQ INTO ACC.
        3606     0237            AND MCONST      / ACC. = LH BIT OF MQ
        3607     7450            SNA             / SKIP IF ACC. NOT = 0
        3610     5217            JMP MLEND       / GO TO END OF PRODUCT ADD
        3611     7300            CLA CLL
        3612     1130            TAD MULT1       / ADD MULTIPLICAND
        3613     1133            TAD MPROD2      /       TO PRODUCT
        3614     3133            DCA MPROD2
        3615     7430            SZL             / SKIP IF LINK = 0
        3616     2132            ISZ MPROD1      / INCREMENT MPROD1 (SKIP IRRELEVANT)
        3617     2121   MLEND,   ISZ MNLOOP
        3620     5222            JMP .+2
        3621     5543            RETURN
        3622     7300            CLA CLL
        3623     7501            MQA             / MQ INTO ACC.
        3624     7004            RAL             / ROTATE ACC. LEFT
        3625     7421            MQL             / ACC. INTO MQ,  ACC. = 0
        3626     7100            CLL
        3627     1133            TAD MPROD2      / ROTATE PRODUCT LEFT --
        3630     7004            RAL
        3631     3133            DCA MPROD2
        3632     1132            TAD MPROD1
        3633     7004            RAL
        3634     3132            DCA MPROD1
        3635     5205            JMP MSTART
        3636     7764   MCOUNT,  7764             / -12 DECIMAL
        3637     4000   MCONST,  4000

 END OF PASS 2

    0 ERRORS DETECTED
1SYMBOL TABLE
```

```
MCONST 3637    MCOUNT 3636    MLEND  3617    MNLOOP 0121    MPROD1 0132    MPROD2 0133    MSTART 3605    MULT   3600   0000000
MULT1  0130    MULT2  0131    RETURN 5543                                                                                   0000000
******** END OF MEMBER MULT        57 RECORDS ********


NDELB


1BEGIN PASS 1


 END OF PASS 1
1BEGIN PASS 2

                        /  ROUTINE TO COMPUTE NEEDED DELTA BUOYANCY (B) AND
                        /     CALL EDGET TO GET
                        /     ENCODER DESTINATION.
                        /     DELTA B LEFT IN 166.
                        /     E.D. LEFT IN 156 AND ACC.
                        /
                 3500   GRAYBI=3500
                 3600   MULT=3600
                 4140   CALL=JMS 140
                 5543   RETURN=JMP I 143
                 7300   DPDIV=7300
                 5600   EDGET=5600
                 6310   RDENC=6310
                 7140   ABVAL=7140
                        /
                 4600   *4600
        4600     7300   NDELB,   CLL CLA
        4601     3131            DCA 131          / SIGN FLAG
        4602     1165            TAD 165          / OLD Z DOT (MM/SEC)
        4603     7041            CIA
        4604     1175            TAD 175          / NEW Z DOT
        4605     4140            CALL
        4606     7140            ABVAL
        4607     7421            MQL
        4610     1126            TAD 126          / OLD V MAGNITUDE (.2CM/SEC)
        4611     4140            CALL
        4612     3600            MULT
        4613     1132            TAD 132          / HIGH ORDER PRODUCT
        4614     7450            SNA              / ZERO DENOMINATOR?
        4615     7001            IAC              / YES, INCREMENT
        4616     3120            DCA 120          / SAVE DIVISOR
        4617     1166            TAD 166          / LAST DELTA B
        4620     4140            CALL
        4621     7140            ABVAL
        4622     7421            MQL
        4623     1127            TAD 127          / CURRENT MAGNITUDE
        4624     4140            CALL
        4625     3600            MULT
        4626     7300            CLA CLL
        4627     1120            TAD 120          / RECOVER DIVISOR
                          / NOTE:  COMPUTED CC PER MM/SEC IS RESTRICTED TO A RANGE
                          /        2 TO 50.
        4630     4140            CALL
        4631     7300            DPDIV            / DOUBLE PRECISION DIVIDE
        4632     1124            TAD 124          / HIGH ORDER QUOTIENT
        4633     7440            SZA              / OK?
        4634     5241            JMP NN3          / NO, GO TO MAX. CC PER MM/SEC
        4635     1125            TAD 125          / YES, MIDDLE QUOT. = CC PER MM/SEC
        4636     1273            TAD NEG50
        4637     7420            SNL              / > 50 DECIMAL CC PER MM/SEC?
        4640     5245            JMP NREG         / NO
        4641     7300   NN3,     CLA CLL          / YES, ACC. = 50 DECIMAL
        4642     1274            TAD X50
        4643     3125            DCA 125          / CC PER MM/SEC = 50
        4644     5252            JMP NN2
        4645     1125   NREG,    TAD 125
        4646     1272            TAD NEG2         / -2
        4647     7430            SZL              / < 2 CC PER MM/SEC?
        4650     5253            JMP .+3          / NO
        4651     7305            CLL CLA IAC RAL  / YES, SET = 2
        4652     7421   NN2,     MQL
        4653     1175            TAD 175          / Z DOT REAL
        4654     7041            CIA
        4655     1565            TAD I 165        / Z DOT DESIRED
        4656     4140            CALL
        4657     7140            ABVAL
        4660     4140            CALL
        4661     3600            MULT
        4662     1133            TAD 133          / LOW ORDER PRODUCT = ABVAL (DELTA B)
        4663     7001            IAC              / GUARANTEE DELTA B NOT = 0
        4664     2131            ISZ 131          / SIGN FLAG FROM ABVAL CALLS
        4665     5267            JMP .+2
        4666     7041            CIA
        4667     4140            CALL             / COMPUTE ENCODER DESTINATION
        4670     5600            EDGET
        4671     5543            RETURN
        4672     7776   NEG2,    -2
        4673     7716   NEG50,   -62
        4674     0062   X50,     62

 END OF PASS 2

    0 ERRORS DETECTED
15YMBOL TABLE

 ABVAL  7140    CALL   4140    DPDIV  7300    EDGET  5600    GRAYBI 3500    MULT   3600    NDELB  4600    NEG2   4672
 NEG50  4673    NN2    4652    NN3    4641    NREG   4645    RDENC  6310    RETURN 5543    X50    4674

******** END OF MEMBER NDELB       93 RECORDS ********
```

```
PARAM

1BEGIN PASS 1

 END OF PASS 1
1BEGIN PASS 2

                        /  PROFILING PARAMETERS.
                        /
                 3200   *3200
        3200     0244           0244     / PRESSURE AT TOP OF LAYER (1 BIT = 5 CM)
        3201     0244           0244
        3202     0000           0000
                 3230   *3230
        3230     0144           0144     / SAMPLING PERIOD (.01 SEC UNITS)
        3231     0144           0144     / 1 SECOND
        3232     0144           0144
                 3260   *3260
        3260     7716           -0062    / Z DOT MAX (ASCENT), UNITS OF MM/SEC.
        3261     7716           -0062    / -5 CM/SEC
        3262     7716           -0062
                 3310   *3310
        3310     6000           -2000      / Z DOT MIN. (ASCENT) , UNITS OF MM/SEC.
        3311     6000           -2000      /
        3312     6000           -2000
                 3344   *3344
        3344     2000           2000       / REST2 Z DOT MAX.
        3345     6000           -2000      / REST2 Z DOT MIN.
        3346     2000           2000       / REST Z DOT MAX. (IN MM/SEC).   5 CM/SEC DESCENT
        3347     6000           -2000      / REST Z DOT MIN.
                 3356   *3356
        3356     7754           -0024      / REST2 Z DOT OPTIMUM
        3357     0024           0024       / REST Z DOT OPTIMUM
                 3450   *3450
        3450     7634           -0144      / ZDOT OPTIMUM FOR ASCENT (MM/SEC)
        3451     7634           -0144
        3452     7634           -0144
                 3350   *3350
        3350     0263           0263       / PRESSURE OF DESCENT TERMINATOR (5 CM UNITS)

 END OF PASS 2

    0 ERRORS DETECTED
1SYMBOL TABLE

******** END OF MEMBER PARAM       44 RECORDS ********

PSTOP

1BEGIN PASS 1

 END OF PASS 1
1BEGIN PASS 2

                        /  ROUTINE TO SERVICE INTERRUPT OF PISTON TRIPPING A MICRO -
                        /     SWITCH NEAR THE LIMITS OF TRAVEL.
                        /   THE PISTON IS BACKED OFF JUST FAR ENOUGH TO RESET THE
                        /     MICROSWITCH.
                        /
                 6212   SKIPPS=6212
                 4100   UCALL=JMS 100
                 2100   UMOFF=2100
                 6747   UDELAY=6747
                 6101   WEXR=6101
                 6311   WMOTOR=6311
                 6310   RDENC=6310
                 6666   GRAYR=6666
                        /
                 3530   *3530
        3530     4100   PSTOP,   UCALL
        3531     2100            UMOFF        / MOTOR OFF AND LATCHED.
        3532     7307            CLL CLA IAC RTL
        3533     7004            RAL          / NOW, 0010 OCTAL IS IN ACC.
        3534     6101            WEXR
        3535     6311            WMOTOR       / MOTOR OFF, RELEASE DETENT SOLENOID ON
        3536     4100            UCALL
        3537     6747            UDELAY       / 100 MS
        3540     7300            CLL CLA
        3541     6310            RDENC        / READ ENCODER
        3542     4100            UCALL
        3543     6666            GRAYR        / GRAY CODE TRANSLATOR FOR RUPTS.
        3544     7100            CLL
        3545     7500            SMA          / PISTON AT TOP OR BOTTOM?
        3546     7120            STL          / BOTTOM (MIN. BUOY.),  LINK = 1
        3547     7205            CLA IAC RAL  / TOP (MAX. BUOY.).  NOW, ACC. = 2 IF TOP,
                                              /    3 IF BOTTOM.
        3550     3147            DCA 147      / SAVE AS PSTOP FLAG
        3551     1147            TAD 147      / RESTORE
        3552     6101            WEXR
        3553     6311            WMOTOR       / MOTOR ON, SOLENOID OFF
        3554     3167            DCA 167      / MOTOR FLAG
        3555     7300            CLL CLA      / WAIT 5 SEC. --
        3556     1367            TAD NUM
        3557     3054            DCA 54       / COUNTER
        3560     4100            UCALL
        3561     6747            UDELAY
        3562     2054            ISZ 54
        3563     5360            JMP .-3
        3564     4100            UCALL
        3565     2100            UMOFF        / MOTOR OFF AND LATCHED
```

```
PSTOP
    47   3566  5432              JMP I 32       / RETURN
    48   3567  7716     NUM,     -0062

 END OF PASS 2

    0 ERRORS DETECTED
1SYMBOL TABLE

 GRAYR  6666    NUM    3567    PSTOP  3530    RDENC  6310    SKIPPS 6212    UCALL  4100    UDELAY 6747    UMOFF  2100
 WEXR   6101    WMOTOR 6311

******** END OF MEMBER PSTOP       62 RECORDS ********

RBEGIN


1BEGIN PASS 1                                                                                                          0000000
                                                                                                                       0000000
                                                                                                                       0000000
 END OF PASS 1                                                                                                         0000000
1BEGIN PASS 2                                                                                                          0000000
                                                                                                                       0000000
     1                 / ROUTINE TO START RECORD CYCLE FOR SEA DATA RECORDER                                           0000000
     2                 /                                                                                               0000000
     3          6101   WEXR=6101                                                                                       0000000
     4          5543   RETURN=JMP I 143                                                                                0000000
     5          6106   SXRDAT=6106                                                                                     0000000
     6          6107   CXRDAT=6107                                                                                     0000000
     7          6113   SKBUSY=6113                                                                                     0000000
     8          6116   SRREQ=6116                                                                                      0000000
     9          6117   CRREQ=6117                                                                                      0000000
    10          3160   *3160                                                                                           0000000
    11   3160   1371   RBEGIN,  TAD RC                                                                                 0000000
    12   3161   3010            DCA 10                                                                                  0000000
    13   3162   1410            TAD I 10                                                                                0000000
    14   3163   6101            WEXR                                                                                    0000000
    15   3164   6106            SXRDAT                                                                                  0000000
    16   3165   6107            CXRDAT                                                                                  0000000
    17                     /    SKBUSY          /  ?                                                                   0000000
    18                     /    JMP .-1                                                                                 0000000
    19   3166   6116            SRREQ                                                                                   0000000
    20   3167   6117            CRREQ                                                                                   0000000
    21   3170   5543            RETURN                                                                                  0000000
    22   3171   0620   RC,      620             / BUFFER ADDRESS                                                        0000000
                                                                                                                       0000000
 END OF PASS 2                                                                                                         0000000
                                                                                                                       0000000
    0 ERRORS DETECTED                                                                                                  0000000
1SYMBOL TABLE                                                                                                          0000000
                                                                                                                       0000000
 CRREQ  6117    CXRDAT 6107    RBEGIN 3160    RC     3171    RETURN 5543    SKBUSY 6113    SRREQ  6116    SXRDAT 6106  0000000
 WEXR   6101                                                                                                           0000000

******** END OF MEMBER RBEGIN       36 RECORDS ********

RECRPT


1BEGIN PASS 1                                                                                                          0000000
                                                                                                                       0000000
                                                                                                                       0000000
 END OF PASS 1                                                                                                         0000000
1BEGIN PASS 2                                                                                                          0000000
                                                                                                                       0000000
     1                 /    SEA DATA TAPE RECORDER ENACTS THIS RUPT WHEN IT                                            0000000
     2                 /        WANTS THE NEXT 12 BITS OF A DATA FRAME.                                                0000000
     3                 /                                                                                               0000000
     4          6101   WEXR=6101                                                                                       0000000
     5          6106   SXRDAT=6106                                                                                     0000000
     6          6107   CXRDAT=6107                                                                                     0000000
     7          0032   RPTOUX=32                                                                                       0000000
     8          0010   *10                                                                                             0000000
     9   0010   0000   RECPTR,  0                    / AUTOINCREMENT BUFFER POINTER                                    0000000
    10          0620   *620                                                                                            0000000
    11   0620   0000   RECBUF,  0                    / START OF BUFFER                                                 0000000
    12          3140   *3140                                                                                           0000000
    13   3140   1410   RR,      TAD I RECPTR         / GET NEXT 12 BITS                                                0000000
    14   3141   6101            WEXR                 / PUT IN EXPANSION REGISTER                                       0000000
    15   3142   6106            SXRDAT               / COPY TO                                                         0000000
    16   3143   6107            CXRDAT               /          DATA REGISTER                                          0000000
    17   3144   5432            JMP I RPTOUX                                                                            0000000
                                                                                                                       0000000
 END OF PASS 2                                                                                                         0000000
                                                                                                                       0000000
    0 ERRORS DETECTED                                                                                                  0000000
1SYMBOL TABLE                                                                                                          0000000
                                                                                                                       0000000
 CXRDAT 6107    RECBUF 0620    RECPTR 0010    RPTOUX 0032    RR     3140    SXRDAT 6106    WEXR   6101               0000000

******** END OF MEMBER RECRPT       30 RECORDS ********

RUPTSERV


1BEGIN PASS 1


 END OF PASS 1
1BEGIN PASS 2

     1                 /  INTERRUPT SERVICE OVERHEAD ROUTINE.
     2                 /
     3                 /     INTERRUPT CAUSES JUMP TO LOCATION 0.
     4          6206   SCLRFL=6206
     5          6207   CCLRFL=6207
     6          0032   *32
     7   0032   2156   RPTOUX,  RPTOUT         / ADDRESS ON PAGE 0
     8                 /
```

```
RUPTSERV
     9          3360    *3360                    / NEAR END OF PAGE 15 (OCTAL)
    10   3360   5770            JMP I 3370       / RUPT VECTOR DESTINATIONS--
    11   3361   5771            JMP I 3371
    12   3362   5772            JMP I 3372
    13   3363   5773            JMP I 3373
    14   3364   5774            JMP I 3374
    15   3365   5775            JMP I 3375
    16   3366   5776            JMP I 3376
    17   3367   5777            JMP I 3377
    18                   /  START ADDRESSES OF RUPT ROUTINES:
    19   3370   3000            3000             / TIME TICK
    20   3371   3140            3140             / RECORD RUPT
    21   3372   2400            2400             / TBRE
    22   3373   2000            2000             / DR
    23   3374   5340            5340             / ATTN1
    24   3375   2156            RPTOUT           / ATTN2  (DOESN'T RUPT)
    25   3376   3530            3530             / PSTOP
    26   3377   2156            RPTOUT           / (SPARE)
    27          0000    *0
    28   0000   0000    RUPT,    0               / RETURN ADDRESS SAVED HERE.
    29   0001   5402            JMP I .+1        / THESE MUST BE INITIALIZED, AND
    30   0002   2150            RUPTP            /  ASSUME NO NESTED RUPTS, I.E.
    31   0003   0000    ASAVE,   0               /  EACH SERVICE COMPLETED BEFORE
    32   0004   0000    MQSAVE,  0               /  NEXT ENABLED.
    33   0005   0000    LSAVE,   0
    34                   / SAVES LIVE REGISTERS FOR ALL SERVICING ROUTINES.
    35                   /
    36          2150    *2150                    / LATTER PART OF PAGE 10 (OCTAL)
    37   2150   3003    RUPTP,   DCA ASAVE       / SAVE ACC.
    38   2151   7501            MQA
    39   2152   3004            DCA MQSAVE       / SAVE MQ
    40   2153   7204            CLA PAL
    41   2154   3005            DCA LSAVE        / SAVE LINK
    42   2155   6002            IOF              / VECTOR TO APPROPRIATE LOCATION
    43                       / SERVICE ROUTINE JUMPS HERE WHEN DONE:
    44   2156   7200    RPTOUT,  CLA
    45   2157   1005            TAD LSAVE
    46   2160   7110            CLL RAR          / RESTORE LINK
    47   2161   1004            TAD MQSAVE
    48   2162   7421            MQL              / RESTORE MQ
    49   2163   1003            TAD ASAVE        / RESTORE ACC.
    50   2164   6206            SCLRFL           / DISABLE CONSOLE INTERRUPTS FOR 2 INST'S
    51   2165   6207            CCLRFL           /    "
    52   2166   6001            ION              / ENABLE INTERRUPT FACILITY
    53   2167   5400            JMP I 0          / RETURN
    54                   /

 END OF PASS 2

    0 ERRORS DETECTED
1SYMBOL TABLE

 ASAVE  0003    CCLRFL 6207    LSAVE  0005    MQSAVE 0004    RPTOUT 2156    RPTOUX 0032    RUPT   0000    RUPTP  2150
 SCLRFL 6206

******** END OF MEMBER RUPTSERV    68 RECORDS ********

SQRT

1BEGIN PASS 1

 END OF PASS 1
1BEGIN PASS 2

     1                   /  SQUARE ROOT.
     2                   /     ARGUMENT IN 122, 123
     3                   /     ANSWER LEFT IN ACC.
     4                   /
     5          4140     CALL=JMS 140
     6          5543     RETURN=JMP I 143
     7          7200     BDIVID=7200
     8          7320     *7320
     9   7320   7350     SQRT,    CLA CLL CMA RAR        / 3777 INTO ACC.
    10   7321   3120     SQST,    DCA 120            / SAVE X
    11   7322   1122              TAD 122            / Z SQUARED INTO DIVIDEND.
    12   7323   3132              DCA 132
    13   7324   1123              TAD 123
    14   7325   3133              DCA 133
    15   7326   1120              TAD 120            / RESTORE X
    16   7327   7120              STL                / FLAG TO BDIVID FOR LOW QUOT.
    17   7330   4140              CALL
    18   7331   7200              BDIVID
    19   7332   1120              TAD 120            / X
    20   7333   7041              CIA
    21   7334   1130              TAD 130            / QUOTIENT Z SQUARED/X
    22   7335   7510              SPA                / NEGATIVE ?
    23   7336   5341              JMP SNEG           / YES
    24   7337   7110              CLL RAR            / NO, DIVIDE BY TWO
    25   7340   5344              JMP SS
    26   7341   7041     SNEG,    CIA                / MAKE POSITIVE
    27   7342   7110              CLL RAR            / DIVIDE BY TWO
    28   7343   7041              CIA                / RESTORE NEGATIVE
    29   7344   7440     SS,      SZA                / DONE?
    30   7345   5350              JMP .+3            / NO
    31   7346   1120              TAD 120            / YES
    32   7347   5543              RETURN
    33   7350   1120              TAD 120
    34   7351   5321              JMP SQST

 END OF PASS 2

    0 ERRORS DETECTED
1SYMBOL TABLE

 BDIVID 7200    CALL   4140    RETURN 5543    SNEG   7341    SQRT   7320    SQST   7321    SS     7344

******** END OF MEMBER SQRT        47 RECORDS ********
```

```
SUBOVR

1BEGIN PASS 1


 END OF PASS 1
1BEGIN PASS 2

     1                 / SOFTWARE STACK ROUTINES FOR SUBROUTINE CALLS.
     2                 /
     3          0140   *140
     4   0140   0000   CALLX,   0000          / ENTRY POINT FOR "CALL" ROUTINE
     5   0141   5542           JMP I .+1      / GO TO "CALL" IN ROM
     6   0142   7000           CALLY          / START OF "CALL" IN ROM
     7   0143   7011   RETX,   RETY           / POINTER TO "RETURN" ROUTINE IN ROM
     8   0144   0720   STACK,  720            / CURRENT STACK POINTER.  INIT TO
     9                                        /    720 BY INITIAL (RESET) ROUTINE
    10   0145   0000   AC,     0000           / TEMPORARY LOC. FOR ACC.
    11                 /
    12          7000   *7000
    13   7000   3145   CALLY,  DCA AC         / SAVE ACC.
    14   7001   2144           ISZ STACK      / UFDATE STACK POINTER
    15   7002   1140           TAD CALLX      / CALLX HAS RETURN ADDRESS
    16   7003   7001           IAC            / INCREMENT BY ONE TO SKIP OVER
    17   7004   3544           DCA I STACK    / ENTRY ADD. OF USER SUBROUTINE--SAVE
    18   7005   1540           TAD I CALLX    / GET USER ROUTINE ENTRY ADD.
    19   7006   3140           DCA CALLX      /   AND SAVE IT IN CALLX
    20   7007   1145           TAD AC         / RESTORE ACC.
    21   7010   5540           JMP I CALLX    / GO TO USER SUBROUTINE
    22   7011   3145   RETY,   DCA AC         / SAVE AC
    23   7012   1544           TAD I STACK    / GET RETURN ADD. FROM STACK
    24   7013   3140           DCA CALLX      /   AND PUT IT IN CALLX
    25   7014   7060           CMA CML        / ACC. = 7777;  COMPLEMENT LINK
    26   7015   1144           TAD STACK      / STACK POINTER-1;  RESTORE LINK
    27   7016   3144           DCA STACK      / UPDATE STACK POINTER
    28   7017   1145           TAD AC         / RESTORE AC
    29   7020   5540           JMP I CALLX    / RETURN
    30                 /
    31                 /
    32          0100   *100
    33   0100   0000   UCALX,  0000        / DITTO AL THE ABOVE FOR RUPT SUBROUTINE CALLS--
    34   0101   5502           JMP I .+1
    35   0102   7040           UCALY
    36   0103   7051   URETX,  URETY
    37   0104   1000   USTACK, 1000
    38   0105   0000   UAC,    0000
    39          7040   *7040
    40   7040   3105   UCALY,  DCA UAC
    41   7041   2104           ISZ USTACK
    42   7042   1100           TAD UCALX
    43   7043   7001           IAC
    44   7044   3504           DCA I USTACK
    45   7045   1500           TAD I UCALX
    46   7046   3100           DCA UCALX
    47   7047   1105           TAD UAC
    48   7050   5500           JMP I UCALX
    49   7051   3105   URETY,  DCA UAC
    50   7052   1504           TAD I USTACK
    51   7053   3100           DCA UCALX
    52   7054   7060           CMA CML
    53   7055   1104           TAD USTACK
    54   7056   3104           DCA USTACK
    55   7057   1105           TAD UAC
    56   7060   5500           JMP I UCALX

 END OF PASS 2

    0 ERRORS DETECTED
1SYMBOL TABLE

 AC     0145   CALLX  0140   CALLY  7000   RETX   0143   RETY   7011   STACK  0144   UAC    0105   UCALX  0100
 UCALY  7040   URETX  0103   URETY  7051   USTACK 0104

******** END OF MEMBER SUBOVR      70 RECORDS ********

SYSOVR

1BEGIN PASS 1


 END OF PASS 1
1BEGIN PASS 2

     1                 /  GENERAL OVERHEAD ROUTINE.
     2                 /
     3          5543   RETURN=JMP I 143
     4          6203   SKIPA2=6203
     5          4140   CALL=JMS 140
     6          6311   WMOTOR=6311
     7          6101   WEXR=6101
     8          7360   DELAY=7360
     9          6215   WCRB2=6215
    10          3040   ATTN2=3040
    11          6201   WFWR=6201
    12          6400   WRITE=6400
    13          5710   MOFF=5710
    14          0071   *71
    15   0071   4246           SYS1
    16   0072   4251           SYS2
    17          4200   *4200
    18   4200   7200   SYSOVR,  CLA
    19   4201   6203           SKIPA2       / HAS ATTN2 RISEN?  I.E. HAS THE MAGNET BEEN
    20                                       /    APPLIED OR REMOVED?
    21   4202   5241           JMP SCONT    / NO
    22   4203   7300           CLL CLA      / YES
```

```
SYSOVR
    23   4204  1167            TAD 167      / MOTOR FLAG
    24   4205  7450            SNA          / MOTOR ON?
    25   4206  5211            JMP SMOFF    / NO
    26   4207  4140            CALL         / YES
    27   4210  5710            MOFF         / MOTOR OFF AND LATCHED.
    28   4211  1237   SMOFF,   TAD K1040    / ATTN2 LEVEL SENSITIVE HIGH
    29   4212  6215            WCRB2
    30   4213  6203            SKIPA2       / ATTN2 HIGH?
    31   4214  5223            JMP SON      / NO,  MAGNET IS ON
    32   4215  7300            CLA CLL      / YES, MAGNET IS OFF
    33   4216  1240            TAD K1000    / ATTN2 LEVEL SENSITIVE LOW
    34   4217  6215            WCRB2
    35   4220  4140            CALL
    36   4221  3040            ATTN2         / START WAIT MODE
    37   4222  5241            JMP SCONT     / CONTINUE
    38   4223  7300   SON,     CLA CLL       / HERE IF MAGNET ON
    39   4224  1253            TAD DLADD
    40   4225  4140            CALL
    41   4226  6400            WRITE         / WRITE FORMAT 1 DATA TO RECORD TIME OF MAG. ON
    42   4227  1253            TAD DLADD
    43   4230  4140            CALL
    44   4231  6400            WRITE         / WRITE DATA AGAIN, IN CASE IT'S THE FINAL FRAME
    45   4232  3177            DCA 177       / MODE ID = 0 , IDLE
    46   4233  6101            WEXR
    47   4234  6201            WPWR          / SENSOR POWER OFF
    48   4235  3057            DCA 57        / SAVE POWER WORD
    49   4236  5241            JMP SCONT
    50   4237  1160   K1040,   1160
    51   4240  1120   K1000,   1120
    52   4241  7300   SCONT,   CLA CLL
    53   4242  1177            TAD 177         / MODE FLAG, =0 IF IDLE
    54   4243  7440            SZA
    55   4244  5250            JMP SYSNI
    56   4245  5471            JMP I 71        / HERE IF IDLE.  GO TO P. 0 ADDRESS
    57   4246  7200   SYS1,    CLA
    58   4247  5200            JMP SYSOVR
    59   4250  5472   SYSNI,   JMP I 72        / HERE IF NOT IDLE.  GO TO P. 0 ADDRESS
    60   4251  7300   SYS2,    CLA CLL
    61   4252  5543            RETURN
    62   4253  5541   DLADD,   5541           / ADDRESS OF DATA CODES FOR FORMAT 1.

 END OF PASS 2

    0 ERRORS DETECTED
1SYMBOL TABLE

 ATTN2  3040   CALL   4140   DELAY  7360   DLADD  4253   K1000  4240   K1040  4237   MOFF   5710   RETURN 5543
 SCONT  4241   SKIPA2 6203   SMOFF  4211   SON    4223   SYSNI  4250   SYSOVR 4200   SYS1   4246   SYS2   4251
 WCRB2  6215   WEXR   6101   WMOTOR 6311   WPWR   6201   WRITE  6400

******** END OF MEMBER SYSOVR      77 RECORDS ********

TAVE64

1BEGIN PASS 1
 END OF PASS 1
1BEGIN PASS 2
     1                 /  ROUTINE TO GET AND AVERAGE 64 PRESSURE VALUES.
     2                 /
     3          3400   ATOD=3400
     4          3412   ATOD2=3412
     5          4140   CALL=JMS 140
     6          5543   RETURN=JMP I 143
     7          0134   PHI=134
     8          6201   WPWR=6201
     9          7362   DELAY2=7362
    10          0135   PLO=135
    11          6101   WEXR=6101
    12          6301   INPUT=6301
    13                 /
    14          6200   *6200
    15   6200   7300   TAVE64,  CLA CLL
    16   6201   1057            TAD 57        / POWER WORD
    17   6202   7450            SNA           / OFF?
    18   6203   5240            JMP TEND      / YES, USE OLD PRESSURE
    19   6204   7300            CLL CLA
    20                 /        TAD PONBIT      / SENSOR POWER ON---
    21                 /        MQL             / PRESSURE POWER BITS INTO MQ
    22                 /        TAD 57          / PRESENT POWER WORD
    23                 /        MQA             / INCLUSIVE OR
    24                 /        WEXR
    25                 /        WPWR            / POWER
    26                 /        CLL CLA
    27                 /        CALL            / .02 SECOND DELAY FOR TRANSIENT
    28                 /        DELAY2
    29   6205   1242            TAD NEG64
    30   6206   3120            DCA 120         / LOOP COUNTER
    31   6207   3134            DCA PHI         / CLEAR 2 WORD DATA ACCUMULATOR---
    32   6210   3135            DCA PLO
    33   6211   7325            CLA CLL CML IAC RAL    / 3 INTO ACC.
    34   6212   4140            CALL
    35   6213   3400            ATOD            / SELECT INPUT AND WAIT FOR TRANSIENT
    36   6214   4140   NEXT,    CALL
    37   6215   3412            ATOD2           / PRESSURE INTO 30 AND ACC.
    38   6216   1135            TAD PLO
    39   6217   3135            DCA PLO         / LOW HALF
    40   6220   7430            SZL             / CARRY ?
    41   6221   2134            ISZ PHI         / YES
    42   6222   2120            ISZ 120         / NO,  DONE?
    43   6223   5214            JMP NEXT        / NO, LOOP.
    44   6224   1243            TAD K30         / YES, 30 (OCTAL) INTO ANSEL.
    45   6225   6101            WEXR
    46   6226   6301            INPUT
    47   6227   7300            CLA CLL
    48   6230   1134            TAD PHI         / NOW, DIVIDE BY 64 TO GET ANSWER---
    49   6231   7002            BSW
    50   6232   3030            DCA 30
    51   6233   1135            TAD PLO
```

```
TAVE64
   52   6234  0242              AND NEG64
   53   6235  7002              BSW              / LOW ORDER BITS
   54   6236  1030              TAD 30           / ANSWER IS NOW IN ACC.
   55   6237  3136              DCA 136          / SAVE IN 136
   56                   /       TAD 57           / OLD POWER
   57                   /       WEXR
   58                   /       WPWR             / RESTORE
   59                   /       CLL CLA
   60   6240  1136      TEND,   TAD 136
   61   6241  5543              RETURN
   62   6242  7700      NEG64,  -100
   63   6243  0030      K30,    30
   64   6244  5001      PONBIT, 5001

 END OF PASS 2

    0 ERRORS DETECTED
1SYMBOL TABLE

 ATOD   3400    ATOD2  3412    CALL   4140    DELAY2 7362    INPUT  6301    K30    6243    NEG64  6242    NEXT   6214
 PHI    0134    PLO    0135    PONBIT 6244    RETURN 5543    TAVE64 6200    TEND   6240    WEXR   6101    WPWR   6201

******** END OF MEMBER TAVE64      78 RECORDS ********

TESTRC

1BEGIN PASS 1

 END OF PASS 1
1BEGIN PASS 2

    1                   /  ROUTINE TO TEST RECORDER WRITE PROGRAMS
    2                   /
    3                   /  ACC. = NO. OF DATA CYCLES TO BE WRITTEN.
    4                   /
    5           4140    CALL=JMS 140
    6           5543    RETURN=JMP I 143
    7           6400    WRITE=6400
    8           6200    *6200
    9   6200    7041    TESTRC, CIA          / NO. OF DATA CLCLES TO BE WRITTEN
   10   6201    3120            DCA 120      / INTO LOOP COUNTER
   11   6202    7200    NEWF,   CLA
   12   6203    1211            TAD DSTART   / ADDRESS OF DATA DESCRIPTOR LIST
   13   6204    4140            CALL
   14   6205    6400            WRITE
   15   6206    2120            ISZ 120      / DONE?
   16   6207    5202            JMP NEWF     / NO, RELOOP
   17   6210    5543            RETURN       / YES
   18   6211    6212    DSTART, STARTA
   19   6212    5005    STARTA, 5005         / FORMAT CODE 0101
   20   6213    2021            2021         / T1
   21   6214    2022            2022         / T0
   22   6215    2120            2120         / LOOP COUNTER
   23   6216    3000            3000         / COMPOSITE TIME
   24   6217    1000            1000         / ENCODER
   25   6220    0000            0000         / ZERO
   26   6221    0003            0003         / EXTERNAL PRESSURE
   27   6222    0013            0013         / AZ
   28   6223    0004            0004         / MX
   29   6224    0100            0100         / -MOTOR VOLTAGE
   30   6225    0200            0200         / -18B VOLTAGE
   31   6226    6000            6000         / STATUS
   32   6227    7777            7777         / TERMINATOR

 END OF PASS 2

    0 ERRORS DETECTED
1SYMBOL TABLE

 CALL   4140    DSTART 6211    NEWF   6202    RETURN 5543    STARTA 6212    TESTRC 6200    WRITE  6400

******** END OF MEMBER TESTRC      45 RECORDS ********

TIMERUPT

1BEGIN PASS 1

 END OF PASS 1
1BEGIN PASS 2

    1                   /   RUPT SERVICE ROUTINE--- TIMER
    2                   /
    3           0020    *20                  / PAGE 0
    4   0020    0000    T2,     0
    5   0021    0000    T1,     0
    6   0022    0000    T0,     0
    7                   /
    8           0032    RPTOUX=32            / ADDRESS OF RUPT SERVICE EXIT
    9           3000    *3000                / PAGE 14 (OCTAL)
   10   3000    2023    TTR,    ISZ 23       /  Z DOT STOPWATCH
   11   3001    7000            NOP
   12   3002    2033            ISZ 33       / DATAGET STOPWATCH
   13   3003    7000            NOP
   14   3004    2022            ISZ T0       / INCREMENT .01 SECOND COUNTER
   15   3005    5432            JMP I RPTOUX      / NO,  RETURN
   16   3006    2021            ISZ T1       /   INCREMENT 40.96 SEC. COUNTER
   17   3007    5215            JMP TMONIT    /   GO TO 40.96 SEC. MONITOR STATEMENTS
   18   3010    2020            ISZ T2        /   INCREMENT DAY COUNTER
   19   3011    7000            NOP
   20   3012    5215            JMP TMONIT    / GO TO 30 SEC. MONITOR STATEMENTS
   21   3013    2110    TIM1,   -5670         / -3000 DECIMAL
   22   3014    2610    TIM2,   -5170         / -2880 DECIMAL
   23   3015    7000    TMONIT, NOP           / PUT STATEMENTS HERE TO MONITOR, ETC. EACH
   24   3016    7200            CLA           /          30 SECONDS.
   25   3017    1046            TAD 46        / MONITOR FLAG INTO ACC.
   26   3020    7450            SNA           / ZERO?
   27   3021    5432            JMP I RPTOUX  / YES, RETURN
   28   3022    5446            JMP I 46      / NO, GO TO MONITOR UART COMMAND.
```

```
END OF PASS 2

   0 ERRORS DETECTED
1SYMBOL TABLE

RPTOUX 0032    TIM1   3013    TIM2   3014    TMONIT 3015    TTR    3000    T0     0022    T1     0021    T2     0020

******** END OF MEMBER TIMERUPT    41 RECORDS ********

TPGET


1BEGIN PASS 1


END OF PASS 1
1BEGIN PASS 2

     1                 /   GET EXTERNAL PRESSURE INTO 136 AND ACC.
     2                 /
     3                 /
     4          5543   RETURN=JMP I 143
     5          6301   INPUT=6301
     6          6101   WEXR=6101
     7          3400   ATOD=3400
     8          7362   DELAY2=7362
     9          6201   WPWR=6201
    10          4140   CALL=JMS 140
    11          4500   *4500
    12   4500   7300   TPGET,   CLA CLL
    13   4501   1057            TAD 57        / POWER WORD
    14   4502   7450            SNA           / OFF?
    15   4503   5315            JMP TEND      / YES, USE OLD PRESSURE.
    16   4504   7300            CLL CLA       / NO, CONTINUE
    17                 /        TAD PONBIT                / PRESSURE POWER BITS
    18                 /        MQL
    19                 /        TAD 57                 / PRESENT POWER WORD
    20                 /        MQA                    / PRESSURE BITS OR (INCLUSIVE)
    21                                                  /    PRESENT POWER
    22                 /        WEXR
    23                 /        WPWR
    24                 /        CLA CLL
    25                 /        CALL
    26                 /        DELAY2                 / .016 SECOND DELAY
    27   4505   7325            CLA CLL CML IAC RAL      / 3 INTO ACC.
    28   4506   4140            CALL
    29   4507   3400            ATOD
    30   4510   3136            DCA 136
    31   4511   1320            TAD K30
    32   4512   6101            WEXR
    33   4513   6301            INPUT            / ANSEL = 30 TO CONSERVE POWER
    34   4514   7200            CLA
    35                 /        TAD 57                 / OLD POWER WORD
    36                 /        WEXR
    37                 /        WPWR
    38                 /        CLA
    39   4515   1136   TEND,    TAD 136                / PRESSURE INTO ACC.
    40   4516   5543            RETURN
    41   4517   5001   PONBIT,  5001
    42   4520   0030   K30,     30

END OF PASS 2

   0 ERRORS DETECTED
1SYMBOL TABLE

ATOD   3400    CALL   4140    DELAY2 7362    INPUT  6301    K30    4520    PONBIT 4517    RETURN 5543    TEND   4515
TPGET  4500    WEXR   6101    WPWR   6201

******** END OF MEMBER TPGET       56 RECORDS ********

UARTCOMS


1BEGIN PASS 1


END OF PASS 1
1BEGIN PASS 2

     1                 / KEYBOARD COMMANDS TO MICROPROCESSOR.
     2                 /
     3          2600   *2600                     / PAGE 13 (OCTAL)   (ROM)
     4          2320   URETN=2320                 / RETURN ADDRESS IN ROUTINE UARTSERV
     5          6216   SMR=6216
     6          6217   CMR=6217
     7          4100   UCALL=JMS 100
     8          2100   UMOFF=2100
     9          5503   URET=JMP I 103
    10          6705   UATOD=6705
    11          6666   GRAYR=6666
    12          0040   UTYPAD=40
    13          6105   WCRA1=6105
    14                 /
    15                 /  COMMAND "S" --- (PRINT TIME, PRESS., PISTON, MOTOR FLAG,
    16                 /                          MODE ID EVERY 41 SECONDS)
    17                 /
    18   2600   7200   UARTS,   CLA
    19   2601   1046            TAD 46            / TIMER MONITOR FLAG.
    20   2602   7450            SNA               /   TURN OFF IF ON.
    21   2603   5207            JMP USON
    22   2604   7200            CLA
    23   2605   3046            DCA 46
    24   2606   5613            JMP I URETA
    25   2607   1212   USON,    TAD USJA          / ADDRESS INTO TIMER MONITOR FLAG
    26   2610   3046            DCA 46
    27   2611   5253   USJ,     JMP UARTP         / GO TO "P" COMMAND; TIMER JUMPS HERE
```

UARTCOMS

```
2612  2611   USJA,    USJ
2613  2320   URETA,   URETN
             /
             /  COMMAND "Z" ---   (PRINT 'PROGRAM COUNTER' (ACTUALLY MEMORY
             /                       LOCATION 0).  THIS TELLS YOU WHERE YOU'RE
             /                       AT IN BACKGROUND.)
2614  7200   UARTZ,   CLA
2615  1000            TAD 0
2616  4100            UCALL
2617  6612            DUMP
2620  5613            JMP I URETA
             /
             / COMMAND "W" --      (WRITE INTO MEMORY.  0150 = OCTAL WORD
             /                       TO BE ENTERED.  0151 = ADDRESS TO BE
             /                       WRITTEN IN.)
2621  7200   UARTW,   CLA
2622  1150            TAD 0150
2623  3551            DCA I 0151
2624  5751            JMP I URETX
             /
             / COMMAND "M" --      (MEMORY DUMP..  THIS JUST FLAGS;  TBRE
             /                       INTERRUPT DOES THE WORK.
             /                       ARG1=0150 = NO. OF WORDS TO BE DUMPED.
             /                       ARG2=0151 = ADD. WHERE DUMP STARTS.
2625  7301   UARTM,   CLA CLL IAC
2626  3043            DCA 43              / SET MEMORY DUMP ON FLAG.
2627  1150            TAD 0150
2630  7450            SNA
2631  7001            IAC
2632  7041            CIA
2633  3150            DCA 0150            / SET UP COUNTER IN ARG1=0150
2634  5750            JMP I URETE
             /
             / COMMAND "G" --   LOAD CRA1, PIE #1 CONTROL REGISTER A
             /      56 = TIME RUPT OFF
             /      57 = TIME RUPT ON
2635  7200   UARTG,   CLA
2636  1151            TAD 0151
2637  6105            WCRA1
2640  5751            JMP I URETX
             /
             /  COMMAND "B:--      (POWER CONTROL,  ARG.=0151 = POWER
             /                          CONTROL WORD)
             /
        6101 WEXR=6101
        6201 WPWR=6201
2641  1151   UARTB,   TAD 0151
2642  6101            WEXR
2643  6201            WPWR
2644  3057            DCA 57            / SAVE POWER CONTROL WORD
2645  5751            JMP I URETX
             /
             /
             /  COMMAND "T"---     (READ BINARY TAPE)
             /
2646  7201   UARTT,   CLA IAC
2647  3041            DCA 41            / SET PAPER TAPE FLAG
2650  3044            DCA 44            / UNSET LEADER-TRAILER FLAG
2651  3045            DCA 45            / BYTE FLAG = 0
2652  5751            JMP I URETX       / RETURN TO UART SERVICE ROUTINE
             /
             /
             /  COMMAND "P"--      (PRINT TIME, PRESSURE, PISTON POSITION,
             /                          MOTOR FLAG, MODE ID.)
             /
        0021 T1=21
        0022 T0=22
        6612 DUMP=6612
        6310 RDENC=6310
        6301 INPUT=6301
2653  7300   UARTP,   CLA CLL
2654  1021            TAD T1           / PRINT TIME WORDS--
2655  4100            UCALL
2656  6612            DUMP
2657  7200            CLA
2660  1022            TAD T0
2661  4100            UCALL
2662  6612            DUMP
2663  7325            CLA CLL CML IAC RAL    / 3 INTO ACC. , ANSEL FOR PRESSURE
2664  7000            NOP
2665  7000            NOP
2666  4100            UCALL
2667  6705            UATOD              / CALL A TO D
2670  4100            UCALL
2671  6612            DUMP               / PRINT PRESSURE
2672  7200            CLA
2673  6310            RDENC              / READ ENCODER
2674  4100            UCALL
2675  6666            GRAYR               / CALL GRAY CODE TRANSLATOR
2676  4100            UCALL
2677  6612            DUMP               / PRINT PISTON POSITION
2700  7200            CLA
2701  1167            TAD 167            / MOTOR FLAG
2702  4100            UCALL
2703  6612            DUMP
2704  7200            CLA
2705  1177            TAD 177            / MODE ID
2706  4100            UCALL
2707  6612            DUMP
2710  5613            JMP I URETA        / RETURN
             /
             /
             /  COMMAND "D"---     (OUTPUT A DATA ITEM.  ARG.=0151 CONTAINS
             /                          INPUT SELECT CODE.)
             /
```

UARTCOMS

```
2711  7300   UARTD,   CLA CLL
2712  1151            TAD 0151          / ARG. INTO ACC.
2713  6216            SMR               / RESET UART, JUST IN CASE IT IS HUNG UP
2714  6217            CMR
2715  4100            UCALL
2716  6705            UATOD             / CALL A TO D
2717  4100            UCALL
2720  6612            DUMP
2721  5613            JMP I URETA       / RETURN
                /
                /
                /  COMMAND 'A'---     (SUBROUTINE TEST.   0150 = MQ,
                /                        0151 = ACC.,  0152 = SUBROUTINE ADDRESS
                /                        0153 = LINK.
                /                        (THIS MUST BE DEFINED WITH 'W' COMMAND)
                /                       NEW MQ AND ACC. ARE TYPED ON TTY.)
                /
2722  7300   UARTA,   CLL CLA
2723  1153            TAD 153
2724  7010            RAR               / LOAD LINK
2725  7200            CLA
2726  1150            TAD 0150
2727  7421            MQL
2730  1346            TAD UABACA
2731  2144            ISZ 144           / INCREMENT STACK POINTER
2732  3544            DCA I 144         / SAVE RETURN ADDRESS IN STACK
2733  1151            TAD 0151          / LOAD ACC.
2734  5552            JMP I 0152        / GO TO SUBROUTINE
2735  3150   UABACK,  DCA 150           / SAVE ACC.
2736  7501            MQA
2737  4100            UCALL
2740  6612            DUMP              / WRITE MQ
2741  7200            CLA
2742  1150            TAD 150
2743  4100            UCALL
2744  6612            DUMP              / WRITE ACC.
2745  5613            JMP I URETA       / RETURN
2746  2735   UABACA,  UABACK
2747  0720   UAZ,     0720              / RAM ADDRESS
2750  2333   URETE,   URETN+13          / RETURN ADD. IF 150, 151 NOT TO BE CLEARED
2751  2330   URETX,   URETN+10          / RETURN ADD. IF NO CARR. RET. AND LINFEED
                /
       6311    WMOTOR=6311
                /
                /  COMMAND 'K'---     SUM ALL ROM LOCATIONS
                /
2752  7200   UARTK,   CLA
2753  1363            TAD KSTX
2754  3027            DCA 27
2755  1427            TAD I 27
2756  2027            ISZ 27
2757  5355            JMP .-2
2760  4100            UCALL
2761  6612            DUMP
2762  5613            JMP I URETA
2763  2000   KSTX,    2000              / START OF ROM
                /
                /
                /  COMMAND "Y"--- MOTOR CONTROL.
                /     ARGUMENT DEFINITIONS:
                /
                /  SIMPLE COMMANDS-
                /     20 = OFF
                /     21 = BRAKE
                /     22 = DOWN
                /     23 = UP
                /     24 = "DETENT SOLENOID" ON, MOTOR OFF
                /     30 = "RELEASE DETENT SOLENOID" ON, MOTOR OFF
                /
                /  COMPLEX COMMANDS-
                /     0 = MOTOR OFF, BRAKE ON, WAIT, APPLY DETENT (BRAKE STILL ON),
                /           WAIT, DETENT SOLENOID OFF, BRAKE OFF.
                /     2 = RELEASE DETENT ON, WAIT 100MS, DETENT SOLENOID OFF
                /           AND MOTOR DOWN
                /     3 = RELEASE DETENT ON, WAIT 100MS, DETENT SOLENOID OFF
                /           AND MOTOR UP
                /
       6747    UDELAY=6747
                /
       6300    *6300
6300  7300   UARTY,   CLA CLL
6301  1151            TAD 151           / COMMAND ARGUMENT
6302  0356            AND BIT7          / GET BIT 7
6303  7450            SNA               / COMPLEX COMMAND?
6304  5313            JMP CMPLX         / YES
6305  7041            CIA
6306  1151            TAD 151           / NO
6307  6101            WEXR
6310  6311            WMOTOR
6311  3167            DCA 167           / MOTOR FLAG
6312  5760            JMP I URETA2      / RETURN
6313  7200   CMPLX,   CLA
6314  1151            TAD 151           / HERE IF COMPLEX COMMAND
6315  7440            SZA               / STOP MOTOR?
6316  5322            JMP Y2            / NO
6317  4100            UCALL             / YES
6320  2100            UMOFF             / MOTOR OFF AND LATCHED
6321  5760            JMP I URETA2      / RETURN
6322  7344   Y2,      CLA CLL CMA RAL   / -2 INTO ACC.
6323  1151            TAD 151
6324  7440            SZA               / MOTOR DOWN?
6325  5340            JMP Y3            / NO
6326  1357            TAD K10           / YES
6327  6101            WEXR
6330  6311            WMOTOR            / RELEASE DETENT, MOTOR STILL OFF
```

UARTCOMS

```
  238   6331  4100            UCALL
  239   6332  6747            UDELAY
  240   6333  7305            CLA CLL IAC RAL     / 2 INTO ACC.
  241   6334  6101            WEXR
  242   6335  6311            WMOTOR              / MOTOR DOWN, DETENT SOLENOIDS OFF
  243   6336  3167            DCA 167             / MOTOR FLAG
  244   6337  5760            JMP I URETA2        / RETURN
  245   6340  7346    Y3,     CLA CLL CMA RTL     / -3 INTO ACC.
  246   6341  1151            TAD 151
  247   6342  7440            SZA                 / UP MOTOR?
  248   6343  5760            JMP I URETA2        / NO, RETURN
  249   6344  1357            TAD K10             / YES
  250   6345  6101            WEXR
  251   6346  6311            WMOTOR              / RELEASE DETENT, MOTOR STILL OFF
  252   6347  4100            UCALL
  253   6350  6747            UDELAY
  254   6351  7325            CLA CLL CML IAC RAL   / 3 INTO ACC.
  255   6352  6101            WEXR
  256   6353  6311            WMOTOR              / MOTOR UP
  257   6354  3167            DCA 167             / MOTOR FLAG
  258   6355  5760            JMP I URETA2        / RETURN
  259   6356  0020    BIT7,   0020
  260   6357  0010    K10,    10
  261   6360  2320    URETA2, 2320                / RETURN ADDRESS IN UARTSERV

 END OF PASS 2

    0 ERRORS DETECTED
1SYMBOL TABLE

 BIT7   6356    CMPLX  6313    CMR    6217    DUMP   6612    GRAYR  6666    INPUT  6301    KSTX   2763    K10    6357
 RDENC  6310    SMR    6216    TO     0022    T1     0021    UABACA 2746    UABACK 2735    UARTA  2722    UARTB  2641
 UARTD  2711    UARTG  2635    UARTK  2752    UARTM  2625    UARTP  2653    UARTS  2600    UARTT  2646    UARTW  2621
 UARTY  6300    UARTZ  2614    UATOD  6705    UAZ    2747    UCALL  4100    UDELAY 6747    UMOFF  2100    URET   5503
 URETA  2613    URETA2 6360    URETE  2750    URETN  2320    URETX  2751    USJ    2611    USJA   2612    USON   2607
 UTYPAD 0040    WCRA1  6105    WEXR   6101    WMOTOR 6311    WPWR   6201    Y2     6322    Y3     6340

******** END OF MEMBER UARTCOMS   279 RECORDS ********
```

UARTSERV

```
1BEGIN PASS 1

 END OF PASS 1
1BEGIN PASS 2

     1                  / UART SERVICE, ENTEPED VIA DR INTERRUPT.
     2                  /
     3          0061    *61                         / PAGE 0
     4   0061   0000    UCOUNT,  0
     5          2000    *2000                 / PAGE 10 (OCTAL)  (START OF ROM)
     6          4100    UCALL=JMS 100         / LOCATION OF BUFFER WRITE ROUTINE
     7          6600    PRINT=6600            / BUFFER WRITE ROUTINE
     8          6110    RUART=6110
     9          0151    ARG2=0151
    10          0150    ARG1=0150
    11          0032    RPTOUX=32             / LOC. OF ADD. OF RUPT SERVICE EXIT
    12                  /
    13   2000   6110    UARTS,   RUART             / ACC = CHARACTER
    14   2001   0260             AND UC3           / BIT 0 TO 3 = 0
    15   2002   7421             MQL
    16   2003   3043             DCA 43           / CLEAR MEMORY DUMP ON FLAG
    17   2004   7501             MQA
    18                  /  PAPER TAPE READ BRANCH.
    19   2005   7200    UTREAD,  CLA
    20   2006   1041             TAD 41            / UART TAPE FLAG
    21   2007   7450             SNA
    22   2010   5263             JMP UNONTP        / GO TO KEYBOARD READ
    23   2011   7701             CLA MQA           / 8 BITS INTO ACC.
    24   2012   1254             TAD UTR1          / 0 IF LEADER OR TRAILER
    25   2013   7440             SZA
    26   2014   5223             JMP UNOTLT        / GO TO NOT LEADER-TRAILER
    27   2015   1044             TAD 44            / LEADER-TRAILER FLAG
    28   2016   7450             SNA
    29   2017   5432             JMP I RPTOUX      / IGNORE LEADER, END RUPT
    30   2020   7200             CLA               / TRAILER ACTS AS TERMINATOR
    31   2021   3041             DCA 41            / UNSET PAPER TAPE FLAG
    32   2022   5432             JMP I RPTOUX      / END RUPT
    33   2023   7201    UNOTLT,  CLA IAC           / HERE IF NOT LEADER- TRAILER
    34   2024   3044             DCA 44            / SET LEADER-TRAILER FLAG
    35   2025   1045             TAD 45            / BYTE FLAG
    36   2026   7440             SZA
    37   2027   5234             JMP UBYTE2
    38   2030   7701             CLA MQA           / BYTE 1
    39   2031   3151             DCA ARG2          / 7 BITS INTO ARG2
    40   2032   2045             ISZ 45            / BYTE FLAG = 1 (I.E. BYTE NO. 2)
    41   2033   5432             JMP I RPTOUX      / END RUPT
    42   2034   7300    UBYTE2,  CLA CLL           / BYTE 2
    43   2035   3045             DCA 45            / BYTE FLAG = 0 (I.E. BYTE NO. 1)
    44   2036   7501             MQA
    45   2037   7002             BSW               / SHIFT 7 LEFT
    46   2040   7004             RAL
    47   2041   1151             TAD ARG2          / ADD BYTE 1 (7 BITS)
    48   2042   7006             RTL               / POTATE 6 LEFT
    49   2043   7006             RTL
    50   2044   7006             RTL
    51   2045   7420             SNL               / LINK = 1 IF ADDRESS
    52   2046   5251             JMP .+3
    53   2047   3150             DCA ARG1          / ENTER ADDRESS
    54   2050   5432             JMP I RPTOUX      / END RUPT
    55   2051   3550             DCA I ARG1        / ENTER DATA
    56   2052   2150             ISZ ARG1          / INCREMENT ADDRESS
    57   2053   5432             JMP I RPTOUX      / END
    58   2054   7600    UTR1,    7600              / THIS + LEADER-TRAILER = 0
```

```
2055  0100   UTR2,    0100              / BIT 5
2056  3400   UCERR,   3400              / EPROR BITS
2057  0305   UCE,     0305
2060  0377   UC3,     0377
2061  0160            UC1,     160
2062  0060            UCNUM,   60
                / END OF PAPER TAPE READ BRANCH.
2063  7701   UNONTP,  CLA MQA           / GO HERE IF KEYBOARD CHARACTER
2064  4100            UCALL
2065  6600            PRINT             / ECHO
2066  7701            CLA MQA
2067  0261            AND UC1           / BITS 0,1,2,3,4,8,9,10,11 = 0
2070  7041            CIA               / TEST TO SEE IF NUMERIC
2071  1262            TAD UCNUM         / CHARACTER
2072  5673            JMP I .+1         / GO TO NEXT PAGE
2073  2200            2200
      2200   *2200                      / PAGE 11 (OCTAL)
2200  7440            SZA               / SKIP IF NUMBER
2201  5223            JMP U1            / SKIP NUMBER ENTERING
2202  7346            CLL CLA CMA RTL   / SET LOOP COUNTER TO -3
2203  3061            DCA UCOUNT
2204  7100            CLL
2205  1151            TAD 0151          / ROTATE ARGUMENT WORDS 3 LEFT--
2206  7004            RAL
2207  3151            DCA 0151
2210  1150            TAD 0150
2211  7004            RAL
2212  3150            DCA 0150
2213  7100            CLL
2214  2061            ISZ UCOUNT
2215  5205            JMP .-10          / OCTAL
2216  7501            MQA               / CHAR. INTO ACC.
2217  0353            AND UC2           / LEFT HAND 9 BITS = 0
2220  1151            TAD 0151          / ADD TO ARGUMENT REGISTER
2221  3151            DCA 0151          /          ON PAGE 0
2222  5333            JMP UEND      / RETURN
2223  7701   U1,      CLA MQA
2224  1374            TAD BLANK
2225  7450            SNA
2226  5333            JMP UEND
2227  7200            CLA
2230  1372            TAD CRGRET        / CARRIAGE RETURN
2231  4100            UCALL
2232  6600            PRINT
2233  7200            CLA
2234  1373            TAD LINFED        / LINE FEED
2235  4100            UCALL
2236  6600            PRINT
2237  7701            CLA MQA           / START OF COMMAND SKIP CHAIN
2240  1337            TAD UCM
2241  7450            SNA
2242  5755            JMP I UCMA
2243  7701            CLA MQA
2244  1340            TAD UCW
2245  7450            SNA
2246  5756            JMP I UCWA
2247  7701            CLA MQA
2250  1341            TAD UCZ
2251  7450            SNA
2252  5757            JMP I UCZA
2253  7701            CLA MQA
2254  1342            TAD UCA
2255  7450            SNA
2256  5760            JMP I UCAA
2257  7701            CLA MQA
2260  1343            TAD UCS
2261  7450            SNA
2262  5761            JMP I UCSA
2263  7701            CLA MQA
2264  1344            TAD UCB
2265  7450            SNA
2266  5762            JMP I UCBA
2267  7701            CLA MQA
2270  1345            TAD UCK
2271  7450            SNA
2272  5763            JMP I UCKA
2273  7701            CLA MQA
2274  1346            TAD UCY
2275  7450            SNA
2276  5764            JMP I UCYA
2277  7701            CLA MQA
2300  1347            TAD UCT
2301  7450            SNA
2302  5765            JMP I UCTA
2303  7701            CLA MQA
2304  1350            TAD UCG
2305  7450            SNA
2306  5766            JMP I UCGA
2307  7701            CLA MQA
2310  1351            TAD UCP
2311  7450            SNA
2312  5767            JMP I UCPA
2313  7701            CLA MQA
2314  1352            TAD UCD
2315  7450            SNA
2316  5770            JMP I UCDA
2317  5330            JMP URETN2
2320  7200   URETN,   CLA                 / UARY COMMAND RETURNS TO HERE
2321  1372            TAD CRGRET
2322  4100            UCALL
2323  6600            PRINT
2324  7200            CLA
2325  1373            TAD LINFED
2326  4100            UCALL
2327  6600            PRINT
2330  7200   URETN2,  CLA
2331  3150            DCA 0150          / CLEAR UART ARGUMENT REGISTERS
```

UARTSERV

```
166   2332  3151            DCA 0151
167   2333  1042   UEND,    TAD 42              / TBRE OFF FLAG
168   2334  7450            SNA
169   2335  5432            JMP I RPTOUX
170   2336  5771            JMP I UTBRE         / GO TO TBRE SERVICE IF TBRE IS OFF
171   2337  7663   UCM,     -0115
172   2340  7451   UCW,     -0327
173   2341  7646   UCZ,     -0132
174   2342  7677   UCA,     -0101
175   2343  7655   UCS,     -0123
176   2344  7676   UCB,     -0102
177   2345  7665   UCK,     -0113
178   2346  7647   UCY,     -0131
179   2347  7454   UCT,     -0324
180   2350  7671   UCG,     -0107
181   2351  7650   UCP,     -0120
182   2352  7674   UCD,     -0104
183   2353  0007   UC2,     0007
184   2354  0100   UBIT5,   0100
185   2355  2625   UCMA,    2625               / COMMAND ADDRESSES--
186   2356  2621   UCWA,    2621
187   2357  2614   UCZA,    2614
188   2360  2722   UCAA,    2722
189   2361  2600   UCSA,    2600
190   2362  2641   UCBA,    2641
191   2363  2752   UCKA,    2752
192   2364  6300   UCYA,    6300
193   2365  2330   UCTA,    URETN2            / PUT 2646 OCTAL HERE TO ACTIVATE PAPER
194   2366  2635   UCGA,    2635              /    TAPE READ COMMAND.
195   2367  2653   UCPA,    2653
196   2370  2711   UCDA,    2711
197   2371  2400   UTBRE,   2400              / ADDRESS OF TBRE ROUTINE
198   2372  0215   CRGRET,  0215              / CARRIAGE RETURN BITS (ASCII)
199   2373  0012   LINFED,  0012              / LINE FEED BITS (ASCII)
200   2374  7540   BLANK,   -0240             / SPACE BITS (ASCII)
201                /
```

END OF PASS 2

0 ERRORS DETECTED

1SYMBOL TABLE

| | | | | | | | | | | | | | | | | | |
|---|---|---|---|---|---|---|---|---|---|---|---|---|---|---|---|---|---|
| ARG1 | 0150 | ARG2 | 0151 | BLANK | 2374 | CRGRET | 2372 | LINFED | 2373 | PRINT | 6600 | RPTOUX | 0032 | RUART | 6110 |
| UARTS | 2000 | UBIT5 | 2354 | UBYTE2 | 2034 | UCA | 2342 | UCAA | 2360 | UCALL | 4100 | UCB | 2344 | UCBA | 2362 |
| UCD | 2352 | UCDA | 2370 | UCE | 2057 | UCEPR | 2056 | UCG | 2350 | UCGA | 2366 | UCK | 2345 | UCKA | 2363 |
| UCM | 2337 | UCMA | 2355 | UCNUM | 2062 | UCOUNT | 0061 | UCP | 2351 | UCPA | 2367 | UCS | 2343 | UCSA | 2361 |
| UCT | 2347 | UCTA | 2365 | UCW | 2340 | UCWA | 2356 | UCY | 2346 | UCYA | 2364 | UCZ | 2341 | UCZA | 2357 |
| UC1 | 2061 | UC2 | 2353 | UC3 | 2060 | UEND | 2333 | UNONTP | 2063 | UNOTLT | 2023 | URETN | 2320 | URETN2 | 2330 |
| UTBRE | 2371 | UTREAD | 2005 | UTR1 | 2054 | UTR2 | 2055 | U1 | 2223 | | | | | | |

****** END OF MEMBER UARTSERV 220 RECORDS ******

UARTTBRE

1BEGIN PASS 1

END OF PASS 1

1BEGIN PASS 2

```
1                   / ROUTINE TO SERVICE TBRE INTERRUPT.
2                   /
3          0062     *62                        / PAGE 0
4   0062   0000     TBCNT,   0
5   0063   0000     TB1,     0
6   0064   0000     TB2,     0
7          2400     *2400
8          4100             UCALL=JMS 100
9          6111     WRUART=6111
10         0032     RPTOUX=32                  / LOC. OF ADD. OF RUPT SERVICE EXIT
11         6600     PRINT=6600                 / BUFFER WRITE ROUTINE
12         0146     BUFWAD=0146                / BUFFER WRITE ADDRESS
13         6612     UTYPE=6612
14         2156     RPTOUT=2156
15                  /
16   2400  7300     TBREA,   CLA CLL
17   2401  1146              TAD BUFWAD
18   2402  7041              CIA
19   2403  1301              TAD BUFSRT        / 0 IF BUFFER EMPTY
20   2404  7440              SZA
21   2405  5245              JMP TBRE1         / IF BUFFER NOT EMPTY
22   2406  1043              TAD 43            / GO HERE IF BUFFER EMPTY
23   2407  7440              SZA               / MEMORY DUMP FLAG
24   2410  5214              JMP .+4
25   2411  7001              IAC               / GO HERE IF NO MEMORY DUMP
26   2412  3042              DCA 42            / SET TBRE OFF FLAG
27   2413  5432              JMP I RPTOUX      / RETURN
28   2414  7300              CLA CLL           / GO HERE IF MEMORY DUMP
29   2415  1151              TAD 0151          / ADDRESS INTO ACCUMULATOR
30   2416  4100              UCALL             / CALL UTYPE, WRITE ADDRESS INTO BUFFER
31   2417  6612              UTYPE
32   2420  7200              CLA
33   2421  4100              UCALL
34   2422  6600              PRINT             / WRITE BLANK INTO BUFFER
35   2423  7200              CLA
36   2424  1551              TAD I 0151        / DATA INTO ACC.
37   2425  4100              UCALL             / CALL UTYPE, WRITE DATA INTO BUFFER
38   2426  6612              UTYPE
39   2427  7200              CLA
40   2430  1302              TAD CRGRET        / CARRIAGE RETURN INTO BUFFER
41   2431  4100              UCALL
42   2432  6600              PRINT
43   2433  7200              CLA
```

UARTTBRE

```
44   2434  1303            TAD LINFED       / LINE FEED INTO BUFFER
45   2435  4100            UCALL
46   2436  6600            FRINT
47   2437  2151            ISZ 0151
48   2440  2150            ISZ 0150         / SKIP IF END OF MEMORY DUMP
49   2441  5245            JMP .+4
50   2442  7200            CLA
51   2443  3043            DCA 43           / TURN OFF MEMORY DUMP FLAG
52   2444  3151            DCA 151           / CLEAR ARGUMENT REGISTER
53   2445  7200    TBRE1,  CLA              / GO HERE IF BUFFER NOT EMPTY
54   2446  1701            TAD I BUFSRT     / SEND NEXT CHAR. FROM BUFFER TO UART
55   2447  6111            WRUART
56                 /  SHIFT BUFFER LEFT-
57   2450  7200            CLA
58   2451  1146            TAD BUFWAD       / GET: -(NO. OF BUF. WORDS OCCUPIED - 1)
59   2452  7041            CIA
60   2453  7001            IAC
61   2454  1301            TAD BUFSRT
62   2455  7440            SZA              / BUFFER EMPTY?
63   2456  5262            JMP .+4          / NO, PROCEED
64   2457  1301            TAD BUFSRT       / YES, RESET POINTER AND RETURN
65   2460  3146            DCA BUFWAD
66   2461  5432            JMP I RPTOUX
67   2462  3062            DCA TBCNT        / LOAD COUNTER
68   2463  1301            TAD BUFSRT
69   2464  3063            DCA TB1          / TEMPORARY ADDRESS
70   2465  1301            TAD BUFSRT
71   2466  7001            IAC
72   2467  3064            DCA TB2          /  DITTO
73   2470  1464            TAD I TB2        / SHIFT
74   2471  3463            DCA I TB1
75   2472  2063            ISZ TB1
76   2473  2064            ISZ TB2
77   2474  2062            ISZ TBCNT
78   2475  5270            JMP .-5
79   2476  1063            TAD TB1
80   2477  3146            DCA BUFWAD       / BUFWAD = BUFWAD - 1
81   2500  5432            JMP I RPTOUX     / RETURN
82   2501  0200    BUFSRT, 0200             / BUFFER START ADDRESS
83   2502  0215    CRGRET, 0215             / ASCII CARRIAGE RETURN
84   2503  0212    LINFED, 0212             / ASCII LINE FEED
85                 /
```

END OF PASS 2

0 ERRORS DETECTED
1SYMBOL TABLE

```
BUFSRT 2501   BUFWAD 0146   CRGRET 2502   LINFED 2503   PRINT  6600   RPTOUT 2156   RPTOUX 0032   TBCNT  0062
TBREA  2400   TBRE1  2445   TB1    0063   TB2    0064   UCALL  4100   UTYPE  6612   WRUART 6111
```

****** END OF MEMBER UARTTBRE  99 RECORDS ******

UMOFF

1BEGIN PASS 1

END OF PASS 1
1BEGIN PASS 2

```
1                  /  ROUTINE TO TURN MOTOR OFF AND APPLY LATCH;  FOR RUPTS ONLY.
2                  /
3          4100    UCALL=JMS 100
4          5503    URET=JMP I 103
5          6747    UDELAY=6747
6          6311    WMOTOR=6311
7          6101    WEXR=6101
8                  /
9          2100    *2100
10   2100  7301    UMOFF,  CLL CLA IAC
11   2101  6101            WEXR
12   2102  6311            WMOTOR           / MOTOR OFF, BRAKES ON
13   2103  7346            CLA CLL CMA RTL   / -3
14   2104  1167            TAD 167          / MOTOR FLAG
15   2105  7440            SZA              / UP ?
16   2106  5311            JMP MDOWN        / NO
17   2107  7000            NOP              / YES
18   2110  7000            NOP
19   2111  4100    MDOWN,  UCALL
20   2112  6747            UDELAY           / 100 MS
21   2113  7000            NOP
22   2114  7000            NOP
23   2115  4100            UCALL
24   2116  6747            UDELAY
25   2117  7000            NOP
26   2120  7000            NOP
27   2121  7307            CLA CLL IAC RTL     / 4
28   2122  7001            IAC              / 5
29   2123  6101            WEXR
30   2124  6311            WMOTOR           / MOTOR STILL OFF, BRAKES STILL ON, LATCH SOL. ON
31   2125  4100            UCALL
32   2126  6747            UDELAY
33   2127  4100            UCALL
34   2130  6747            UDELAY
35   2131  4100            UCALL
36   2132  6747            UDELAY
37   2133  4100            UCALL
38   2134  6747            UDELAY
39   2135  7200            CLA
40   2136  6101            WEXR
41   2137  6311            WMOTOR           / ALL OFF
42   2140  3167            DCA 167          / ZERO INTO MOTOR FLAG
43   2141  7001            IAC
44   2142  3107            DCA 107          / DELTA B DAMPING FLAG = +1
45   2143  3077            DCA 77           / LAUNCH FLAG = 0
46   2144  5503            URET
```

END OF PASS 2

```
    0 ERRORS DETECTED
1SYMBOL TABLE
 MDOWN  2111    UCALL  4100    UDELAY 6747    UMOFF  2100    URET   5503    WEXR   6101    WMOTOR 6311

******** END OF MEMBER UMOFF       59 RECORDS ********

USUBS

1BEGIN PASS 1


 END OF PASS 1
1BEGIN PASS 2

     1                  / THIS FILE CONTAINS SUBROUTINES IN ROM, CALLED
     2                  /    TO BY THE UART SERVICE ROUTINES.  THESE
     3                  /    SUBROUTINES ARE NOT ACCESSED BY THE NORMAL
     4                  /    (BACKGROUND) SUBROUTINE CALLS.
     5                  /
     6                  /
     7                  / ROUTINE TO WRITE A WORD IN THE UART TTY BUFFER.
     8                  /   CHECKS ARE MADE TO AVOID OVERFLOW.
     9                  /
    10          3546    WRBUF=DCA I 0146
    11          0146    BUFWAD=0146
    12          4100    UCALL=JMS 100
    13          5503    URET=JMP I 103
    14          0050    *0050                       / PAGE 0
    15    0050  0000    GRACNT,  0000
    16    0051  0000    UMCNT,   0000
    17    0052  0000    UARRX,   0000
    18    0053  0000    ULCOP,   0000
    19          6600    *6600                       / PAGE 2 (RAM)
    20    6600  3546    UBUFW,   WRBUF
    21    6601  7300             CLA CLL
    22    6602  1146             TAD BUFWAD          / BUFFER WRITE ADDRESS
    23    6603  7041             CIA
    24    6604  1211             TAD BUFLIM          / BUFLIM - BUFWAD (ZERO IF
    25    6605  7510             SPA                 /      BUFFER FULL)
    26    6606  5503             URET                / RETURN WITHOUT INCREMENTING POINTER
    27    6607  2146             ISZ BUFWAD
    28    6610  5503             URET
    29    6611  0377    BUFLIM,  0377                / BUFFER ADDRESS UPPER LIMIT
    30                  /
    31                  /
    32                  /
    33                  /  ROUTINE TO WRITE A 12 BIT WORD ON TTY AS 4 OCTAL CHARACTERS.
    34                  /
    35    6612  7100    UTYPE,   CLL
    36    6613  7004             RAL                     / ROTATE 3 LEFT--
    37    6614  7430             SZL
    38    6615  7101             CLL IAC
    39    6616  7004             RAL
    40    6617  7430             SZL
    41    6620  7101             CLL IAC
    42    6621  7004             RAL
    43    6622  7430             SZL
    44    6623  7101             CLL IAC
    45    6624  7421             MQL
    46    6625  7501             MQA
    47    6626  0264             AND UMC2            / LEFT HAND 9 BITS = 0
    48    6627  1263             TAD UMC1            / LEFT HAND 9 BITS = 026
    49    6630  4100             UCALL
    50    6631  6600             UBUFW
    51    6632  7346             CLA CLL CMA RTL     / -3 INTO ACC.
    52    6633  3051             DCA UMCNT           / ACC. INTO LOOP COUNTER
    53    6634  7701    STARL,   CLA MQA
    54    6635  7104             CLL RAL
    55    6636  7430             SZL                                                    0
    56    6637  7101             CLL IAC
    57    6640  7004             RAL
    58    6641  7430             SZL
    59    6642  7101             CLL IAC
    60    6643  7004             RAL
    61    6644  7430             SZL
    62    6645  7101             CLL IAC
    63    6646  7421             MQL
    64    6647  7501             MQA
    65    6650  0264             AND UMC2
    66    6651  1263             TAD UMC1
    67    6652  4100             UCALL
    68    6653  6600             UBUFW
    69    6654  2051             ISZ UMCNT
    70    6655  5234             JMP STARL
    71    6656  7200             CLA
    72    6657  1265             TAD USPACE
    73    6660  4100             UCALL               / WRITE BLANK
    74    6661  6600             UBUFW
    75    6662  5503             URET                / RETURN
    76    6663  0260    UMC1,    0260
    77    6664  0007    UMC2,    0007
    78    6665  0240    USPACE,  240                 / ASCII SPACE
    79                  /
    80                  /
    81                  /  GRAY CODE TRANSLATE ROUTINE FOR INTERRUPTS.
    82                  /
    83    6666  7421    GRAYR,   MQL                 / SAVE INPUT
    84    6667  1304             TAD GRAY1
    85    6670  3050             DCA GRACNT          / LOOP COUNTER
    86    6671  7501             MQA
    87    6672  7040             CMA                 / COMPLEMENT, SINCE ENCODER
    88    6673  7004    GLOOP,   RAL
    89    6674  2050             ISZ GRACNT          / DONE?
    90    6675  5277             JMP GTEST           / NO
    91    6676  5503             URET                / YES
```

USUBS

```
 92   6677  7420    GTEST,   SNL                 / L = 0 ?
 93   6700  5273             JMP GLOOP
 94   6701  7004             RAL                 / YES, JUST ROTATE AND
 95   6702  7020             CML                 /              INVERT
 96   6703  5274             JMP GLOOP+1
 97   6704  7763    GRAY1,   -15
 98                 /
 99                 /
100                 /  SUCCESSIVE APPROX. A TO D FOR INTERRUPTS.
101                 /     LEAVES OFFSET BINARY VALUE OF SELECTED INPUT IN
102                 /     ACCUMULATOR AND OFFSET BINARY VALUE IN UAPPRX.
103                 /
104   6705  6101    UATOD,   WEXR
105   6706  6301             INPUT               / SELECT ANALOG INPUT
106   6707  0363             AND BITS
107   6710  7450             SNA                 / BATTERY MONITOR?
108   6711  5316             JMP NBM             / NO
109   6712  7300             CLL CLA             / YES
110   6713  4100             UCALL
111   6714  6751             UDEL2               / WAIT 10 MS
112   6715  7000             NOP
113   6716  4100    NBM,     UCALL
114   6717  6752             UDEL3               / WAIT 10 MS
115   6720  7330             CLA CLL CML RAR     / 4000 INTO ACC.
116   6721  7421             MQL
117   6722  3052             DCA UAPPRX          / 0 INTO UAPPRX
118   6723  1052    UADLP,   TAD UAPPRX
119   6724  7501             MQA
120   6725  6101             WEXR
121   6726  6211             WDAC
122   6727  7200             CLA
123   6730  1052             TAD UAPPRX           / RECOVER UAPPRX AND KILL TIME
124   6731  6312             SKIFDH              / DAC TOO HIGH?
125   6732  7501             MQA                 / NO.  OR IN BITPOS
126   6733  3052             DCA UAPPRX          /       AND PUT BACK
127   6734  7701             CLA MQA
128   6735  7110             CLL RAR             / UPDATE BITPOSITION
129   6736  7450             SNA                 / DONE?
130   6737  5342             JMP UADOUT          / YES
131   6740  7421             MQL                 / NO.  CONTINUE
132   6741  5323             JMP UADLP
133   6742  7300    UADOUT,  CLA CLL
134   6743  6101             WEXR
135   6744  6211             WDAC        / CLEAR DAC
136   6745  1052             TAD UAPPRX          / OFFSET BINARY INTO ACC.
137   6746  5503             URET                / RETURN
138                 /
139                 /
140                 /
141         6101    WEXR=6101
142         6301    INPUT=6301
143         6211    WDAC=6211
144         6312    SKIFDH=6312
145                 /
146                 /  ROUTINE TO DELAY EITHER .01 OR .1 OR .02 SECONDS.
147                 /
148   6747  7300    UDELAY,  CLA CLL
149   6750  1360             TAD UP84
150   6751  1361    UDEL2,   TAD UP11
151   6752  1362    UDEL3,   TAD UP5
152   6753  3053             DCA ULOOP
153   6754  2053             ISZ ULOOP
154   6755  5354             JMP .-1
155   6756  7100             CLL
156   6757  5503             URET
157   6760  5100    UP84,    -2700
158   6761  7550    UP11,    -0230
159   6762  7550    UP5,     -0230
160   6763  0700    BITS,    0700
```

END OF PASS 2

0 ERRORS DETECTED

1SYMBOL TABLE

| | | | | | | | | | | | | | | | |
|---|---|---|---|---|---|---|---|---|---|---|---|---|---|---|---|
| BITS | 6763 | BUFLIN | 6611 | BUFWAD | 0146 | GLOOP | 6673 | GRACNT | 0050 | GRAYR | 6666 | GRAY1 | 6704 | GTEST | 6677 |
| INPUT | 6301 | NBM | 6716 | SKIFDH | 6312 | STARL | 6634 | UADLP | 6723 | UADOUT | 6742 | UAPPRX | 0052 | UATOD | 6705 |
| UBUFW | 6600 | UCALL | 4100 | UDELAY | 6747 | UDEL2 | 6751 | UDEL3 | 6752 | ULOOP | 0053 | UMCNT | 0051 | UMC1 | 6663 |
| UMC2 | 6664 | UP11 | 6761 | UP5 | 6762 | UP84 | 6760 | URET | 5503 | USPACE | 6665 | UTYPE | 6612 | WDAC | 6211 |
| WEXR | 6101 | WRBUF | 3546 | | | | | | | | | | | | |

****** END OF MEMBER USUBS  177 RECORDS ******

VMAGET

1BEGIN PASS 1

END OF PASS 1

1BEGIN PASS 2

```
  1                 /  ROUTINE TO GET CURRENT MAGNITUDE AND LEAVE IT IN 127,
  2                 /      SCALED DOWN BY 2  (I.E. LSB = .39 CM/SEC.).
  3                 /  ASSUMES VX AND VY SENSORS HAVE BEEN POWERED UP
  4                 /      PREVIOUSLY.
  5                 /
  6         4140    CALL=JMS 140
  7         5543    RETURN=JMR I 143
  8         6301    INPUT=6301
  9         0030    APPROX=30
 10         3400    ATOD=3400
 11         7320            SQRT=7320
 12         6101    WEXR=6101
 13         3600    MULT=3600
 14         3700    *3700
 15   3700  7301    VMAGET,  CLA CLL IAC
```

```
VMAGET
   16   3701  4140            CALL
   17   3702  3400            ATOD
   18   3703  7330            CLA CLL CML RAR      / CONVERT TO 2'S COMPLEMENT
   19   3704  1030            TAD APPROX
   20   3705  7510            SPA                  / VX NEGATIVE?
   21   3706  7041            CIA                  / YES, INVERT
   22   3707  7110            CLL RAR              / NO, DIVIDE BY 2
   23   3710  7421            MQL
   24   3711  7501            MQA
   25   3712  4140            CALL
   26   3713  3600            MULT                 / VX SQUARED
   27   3714  1132            TAD 132
   28   3715  3122            DCA 122
   29   3716  1133            TAD 133
   30   3717  3123            DCA 123              / SAVE
   31   3720  7105            CLL IAC RAL
   32   3721  4140            CALL
   33   3722  3400            ATOD                 / VY
   34   3723  7300            CLL CLA
   35   3724  1371            TAD K30
   36   3725  6101            WEXR
   37   3726  6301            INPUT                / ANSEL = 30 TO SAVE POWER.
   38   3727  7330            CLA CLL CML RAR
   39   3730  1030            TAD APPROX           / CONVERT TO 2'S COMPLEMENT
   40   3731  7510            SPA                  / VY NEGATIVE?
   41   3732  7041            CIA                  / YES, INVERT
   42   3733  7110            CLL RAR              / NO, DIVIDE BY 2
   43   3734  7421            MQL
   44   3735  7501            MQA
   45   3736  4140            CALL
   46   3737  3600            MULT                 / VY SQUARED
   47   3740  7100            CLL
   48   3741  1123            TAD 123              / ADD TO VX SQUARED
   49   3742  1133            TAD 133
   50   3743  3123            DCA 123
   51   3744  7004            RAL
   52   3745  1122            TAD 122
   53   3746  1132            TAD 132
   54   3747  3122            DCA 122
   55   3750  4140            CALL
   56   3751  7320            SQRT
   57   3752  7110            CLL RAR              / NOW, UPDATA WEIGHTED AVG. IN 127
   58   3753  7110            CLL RAR
   59   3754  7110            CLL RAR              / DIVIDE BY 8
   60   3755  7421            MQL                  / SAVE
   61   3756  1127            TAD 127              / OLD V MAGNITUDE
   62   3757  7110            CLL RAR
   63   3760  7110            CLL RAR
   64   3761  7110            CLL RAR              / DIVIDE BY 8
   65   3762  7041            CIA
   66   3763  1127            TAD 127              / 7/8 OLD V MAG.
   67   3764  3127            DCA 127
   68   3765  7701            CLA MQA
   69   3766  1127            TAD 127
   70   3767  3127            DCA 127              / 7/8 OLD VMAG + 1/8 NEW VMAG
   71   3770  5543            RETURN
   72   3771  0030    K30,    30

 END OF PASS 2

    0 ERRORS DETECTED
1SYMBOL TABLE

 APPROX 0030    ATOD   3400    CALL   4140    INPUT  6301    K30    3771    MULT   3600    RETURN 5543    SQRT   7320
 VMAGET 3700    WEXR   6101

******** END OF MEMBER VMAGET      86 RECORDS ********

WRITE


1BEGIN PASS 1


 END OF PASS 1
1BEGIN PASS 2

    1                  /  WRITES DATA ON SEA DATA TAPE RECORDER.
    2                  /   ACC. CONTAINS ADDRESS OF DATA DESCPIPTOR LIST:
    3                  /   0XXX = INPUT SELECT CODE (ANSEL)
    4                  /   0000 = ZERO
    5                  /   1000 = ENCODER
    6                  /   2XXX = XXX ADDRESS ON PAGE 0
    7                  /   3000 = LEFT BITS OF T0 PLUS RIGHT BITS OF T1 (TIME)
    8                  /   50AB = CLOSE LAST FRAME IF REQUIRED.  ENTER NEW FORMAT
    9                  /           CODE AB
   10                  /   6000 = STATUS (MODE ID, MOTOR FLAG, LAUNCH FLAG, DELTA B
   11                  /           DAMPING FLAG)
   12                  /   7777 = TERMINATOR OF LIST
   13                  /
   14          0013    DATA=13
   15          0022    T0=22
   16          0021    T1=21
   17          4140    CALL=JMS 140
   18          5543    RETURN=JMP I 143
   19          6140    ENCGET=6140
   20          3400    ATOD=3400
   21          3160    REEGIN=3160
   22          7360    DELAY=7360
   23          6301    INPUT=6301
   24          6101    WEXR=6101
   25                  /
   26          6400    *6400
   27   6400   7041    WRITE,   CMA IAC
   28   6401   7040             CMA          / SUBTRACT 1 FROM DATA LIST ADDRESS, SINCE INDIRECT
   29   6402   3013             DCA 13       /    REFERENCE INCREMENTS IT BEFORE FETCHING
```

WRITE

```
6403  7300            CLL CLA
6404  1413            TAD I 13          / DATA DESCRIPTER
6405  7421            MQL               / SAVE
6406  7501            MQA
6407  1366            TAD KSTAT
6410  7440            SZA               / STATUS?
6411  5239            JMP X1            / NO
6412  1177            TAD 177           / YES; MODE ID
6413  7106            CLL RTL
6414  7004            RAL
6415  1167            TAD 167           / MOTOR FLAG
6416  7006            RTL
6417  7004            RAL
6420  1077            TAD 77            / LAUNCH FLAG
6421  7004            RAL
6422  1107            TAD 107           / DELTA B DAMPING TIME FLAG
6423  7006            RTL
6424  1147            TAD 147           / PSTOP FLAG
6425  3410            DCA I 10          / WORD INTO BUFFER
6426  3147            DCA 147           / CLEAR PSTOP FLAG
6427  5344            JMP ENDL
6430  7701    X1,     CLA MQA
6431  7001            IAC
6432  7450            SNA               / TERMINATOR
6433  5543            RETURN            / YES;  DONE
6434  7701            CLA MQA           / NO
6435  7440            SZA               / ZERO?
6436  5241            JMP X2            / NO
6437  3410            DCA I 10          / YES;  ZERO INTO BUFFER
6440  5344            JMP ENDL
6441  0365    X2,     AND K9            / BITS 3 - 11 = 0
6442  1367            TAD KPAGE
6443  7440            SZA               / PAGE 0 REFERENCE?
6444  5253            JMP X3            / NO
6445  7701            CLA MQA           / YES
6446  0364            AND K3            / PAGE 0 ADDRESS
6447  3124            DCA 124           / DEPOSIT FOR INDIRECT REFERENCE
6450  1524            TAD I 124
6451  3410            DCA I 10          / PAGE 0 ADDRESS CONTENTS INTO BUF
6452  5344            JMP ENDL
6453  7701    X3,     CLA MQA
6454  0365            AND K9            / BITS 3 - 11 = 0
6455  1370            TAD KCODE
6456  7440            SZA               / FORMAT CODE?
6457  5307            JMP X4            / NO
6460  1010    BUFEMT, TAD 10            / YES;  GET BUFFER POINTER
6461  1372            TAD RCM
6462  7450            SNA               / BUFFER EMPTY?
6463  5272            JMP Y1            / YES
6464  1373            TAD M12           / NO
6465  7440            SZA               / ONE SPACE LEFT IN BUFFER??
6466  5276            JMP Y2            / NO
6467  1056            TAD 56            / YES;  GET OLD FORMAT CODE
6470  7000            NOP
6471  3410            DCA I 10          / CODE INTO BUFFER
6472  7701    Y1,     CLA MQA           / HERE IF BUFFER EMPTY
6473  0364            AND K3
6474  3056            DCA 56            / NEW CODE INTO 56
6475  5344            JMP ENDL
6476  7701    Y2,     CLA MQA           / HERE IF MORE THAN ONE SPACE LEFT
                                        /    IN BUFFER
6477  0364            AND K3            / FORMAT CODE
6500  7041            CIA
6501  1056            TAD 56            / OLD CODE
6502  7450            SNA               / EQUAL?
6503  5344            JMP ENDL          / YES;  DO NOTHING
6504  7200            CLA               / NO
6505  3410            DCA I 10          / 0 INTO BUFFER
6506  5260            JMP BUFEMT        / GO BACK TO FILL REST OF FRAME
6507  7701    X4,     CLA MQA
6510  1374            TAD KTIME
6511  7440            SZA               / TIME?
6512  5325            JMP X5            / NO
6513  1022            TAD T0            / YES
6514  7002            BSW
6515  0363            AND K6            / GET LH BITS AT RH
6516  3125            DCA 125
6517  1021            TAD T1
6520  0363            AND K6
6521  7002            BSW
6522  1125            TAD 125           / COMPOSITE TIME
6523  3410            DCA I 10          / INTO BUFFER
6524  5344            JMP ENDL
6525  7701    X5,     CLA MQA
6526  1375            TAD KENC
6527  7440            SZA               / ENCODER?
6530  5335            JMP X6            / NO
6531  4140            CALL              / YES
6532  6140            ENCGET
6533  3410            DCA I 10          / ENCODER INTO BUFFER
6534  5344            JMP ENDL
6535  7701    X6,     CLA MQA           / ANALOG INPUT SELECT CODE
6536  4140            CALL
6537  3400            ATOD
6540  3410            DCA I 10
6541  1376            TAD K30
6542  6101            WEXR
6543  6301            INPUT             / ANSEL POWER OFF
6544  7200    ENDL,   CLA
6545  1010            TAD 10            / BUFFER POINTER
6546  1377            TAD RCFULL
6547  7440            SZA               / BUFFER FULL?
6550  5203            JMP WRITE+3       / NO;  RELOOP
6551  4140            CALL              / YES;  BEGIN RECORD CYCLE
6552  3160            REEGIN
```

```
WRITE

  135   6553  4140              CALL
  136   6554  7360              DELAY            / WAIT .2 SEC.
  137   6555  4140              CALL
  139   6556  7360              DELAY
  139   6557  7200              CLA
  140   6560  1371              TAD RC
  141   6561  3010              DCA I0           / RESET BUFFER ADDRESS POINTER
  142   6562  5203              JMP WRITE+3      / RELOOP
  143   6563  0077    K6,       0077
  144   6564  0777    K3,       0777
  145   6565  7000    K9,       7000
  146   6566  2000    KSTAT,    -6000
  147   6567  6000    KPAGE,    -2000
  148   6570  3000    KCODE,    -5000
  149   6571  0620    RC,       620
  150   6572  7160    RCM,      -620
  151   6573  7764    M12,      -14
  152   6574  5000    KTIME,    -3000
  153   6575  7000    KENC,     -1000
  154   6576  0030    K30,      30
  155   6577  7143    RCFULL,   -635

 END OF PASS 2

    0 ERRORS DETECTED
1SYMBOL TABLE

 ATOD   3400    BUFEMT 6460    CALL   4140    DATA   0013    DELAY  7360    ENCGET 6140    ENDL   6544    INPUT  6301
 KCODE  6570    KENC   6575    KPAGE  6567    KSTAT  6566    KTIME  6574    K3     6564    K30    6576    K6     6563
 K9     6565    M12    6573    RBEGIN 3160    RC     6571    RCFULL 6577    RCM    6572    RETURN 5543    T0     0022
 T1     0021    WEXR   6101    WRITE  6400    X1     6430    X2     6441    X3     6453    X4     6507    X5     6525
 X6     6535    Y1     6472    Y2     6476

******** END OF MEMBER WRITE      172 RECORDS ********


ZDGET


1BEGIN PASS 1


 END OF PASS 1
1BEGIN PASS 2

     1                  /  ROUTINE TO GET Z DOT IN MM/SEC, AND LEAVE IT 175.
     2                  /    OLDP (137) IS UPDATED.
     3                  /
     4          6140    ENCGET=6140
     5          3160    REEGIN=3160
     6          4500    TPGET=4500
     7          3400    ATOD=3400
     8          6301    INPUT=6301
     9          3600    MULT=3600
    10          7140    ABVAL=7140
    11          4140    CALL=JMS 140
    12          5543    RETURN=JMP I 143
    13          6200    TAVE64=6200
    14                  /
    15          0155    *155
    16   0155   5670    ZDTI,     5670           / 30 SEC.
    17          4300    *4300
    18   4300   7300    ZDGET,    CLL CLA
    19   4301   3131              DCA 131        / CLEAR SIGN FLAG
    20   4302   4140              CALL           / EXTERNAL PRESSURE INTO 136 (64 POINT AVERAGE)
    21   4303   6200              TAVE64
    22   4304   7041              CIA
    23   4305   1137              TAD 137        / OLD P
    24   4306   7041              CIA            / P - OLD P
    25   4307   4140              CALL
    26   4310   7140              ABVAL
    27   4311   7421              MQL
    28   4312   1327              TAD ZDCON      / FACTOR TO GET MM/.5SEC.
    29   4313   4140              CALL
    30   4314   3600              MULT
    31   4315   1132              TAD 132        / HIGH ORDER PRODUCT
    32   4316   7104              CLL RAL        / MM./SEC.
    33   4317   2131              ISZ 131        / SIGN FLAG FROM ABVAL
    34   4320   5322              JMP .+2
    35   4321   7041              CIA
    36   4322   3175              DCA 175        / SAVE ZDOT
    37   4323   1136              TAD 136
    38   4324   3137              DCA 137        / UPDATE OLDP
    39   4325   3023              DCA 23         / ZERO Z DOT STOPWATCH
    40   4326   5543              RETURN
    41   4327   7446    ZDCON,    7446           / .5 X (MM/SEC PER PRESSURE COUNT IN 30 SEC)
    42                                           /  THIS IS 6520 OCTAL FOR 1 BIT PRESSURE = 5 CM.
    43                                           /  IT IS 7446 OCTAL FOR 1 BIT PRESSURE = 5.69 CM.

 END OF PASS 2

    0 ERRORS DETECTED
1SYMBOL TABLE

 ABVAL  7140    ATOD   3400    CALL   4140    ENCGET 6140    INPUT  6301    MULT   3600    RBEGIN 3160    RETURN 5543
 TAVE64 6200    TPGET  4500    ZDCON  4327    ZDGET  4300    ZDTI   0155

******** END OF MEMBER ZDGET       57 RECORDS ********
```

We claim:

1. A controlled buoyancy platform adapted to pass between two vertically displaced underwater points, comprising:

one or more displacement pistons and associated cylinder assemblies affixed to said platform, each of said cylinder assemblies including a port means for coupling the interior region of said cylinder on one side of said piston to the region exterior to said platform, control means for generating a buoyancy control signal representative of a desired buoyancy for said platform, sealing means for establishing a water-tight seal between each of said pistons and its associated cylinder, whereby the interior regions of said cylinder on opposite sides of said pistons are isolated, and actuating means responsive to said buoyancy control signal for selectively translating each of said pistons to a point in its associated cylinder assembly whereby the buoyancy of said platform as established by the volume displaced by the respective pistons in their associated cylinder assemblies corresponds to said desired buoyancy.

2. A platform according to claim 1 further comprising means to limit said platform motion along a mooring line passing through said underwater points.

3. A platform according to claim 1 wherein said sealing means includes a rolling diaphragm seal.

4. A platform according to claim 3 wherein said actuating means for said pistons is a torque motor coupled by ball screw and ball nut assemblies to said pistons.

5. A platform according to claim 1 wherein said actuating means for said pistons is a torque motor coupled by ball screw and ball nut assemblies to said pistons.

6. A platform according to claim 1 wherein said control means includes at least one sensor and is responsive to sensor signals from said sensors to generate said control signals, said sensor signals being representative of water characteristics outside said platform.

7. A platform according to claim 6 wherein said control means is adapted to generate signals for controlling the vertical speed of said platform.

8. A platform according to claim 6 wherein at least one of said sensors generates a signal representative of the pressure of said water outside said platform.

9. A platform according to claim 6 wherein at least one of said sensors generates a signal representative of the temperature of said water outside said platform.

10. A platform according to claim 6 wherein at least one of said sensors generates a signal representative of the salinity of said water outside said platform.

11. A platform according to claim 6 wherein at least one of said sensors generates a signal representative of acoustic characteristics of said water outside said platform.

12. A platform according to claim 1 wherein said control means includes means to generate signals for selectively controlling the vertical speed of said platform.

13. A platform according to claim 1 wherein said control means generates said control signals at programmably selected times.

14. A platform according to claim 1 wherein said control means includes a programmed microprocessor.

* * * * *